US007662074B2

(12) United States Patent
Webb

(10) Patent No.: US 7,662,074 B2
(45) Date of Patent: Feb. 16, 2010

(54) EXERCISE MACHINE HAVING ROTATABLE WEIGHT SELECTION INDEX

(75) Inventor: Gregory M. Webb, Independence, VA (US)

(73) Assignee: Nautilus, Inc., Vancouver, WA (US)

( * ) Notice: Subject to any disclaimer, the term of this patent is extended or adjusted under 35 U.S.C. 154(b) by 0 days.

(21) Appl. No.: 12/142,904

(22) Filed: Jun. 20, 2008

(65) Prior Publication Data

US 2008/0254952 A1 Oct. 16, 2008

Related U.S. Application Data

(63) Continuation of application No. 11/242,320, filed on Oct. 3, 2005.

(60) Provisional application No. 60/616,003, filed on Oct. 4, 2004, provisional application No. 60/616,387, filed on Oct. 5, 2004.

(51) Int. Cl.
*A63B 21/06* (2006.01)

(52) U.S. Cl. ..... 482/97; 482/99

(58) Field of Classification Search ..... 482/92–94, 482/97–103, 104, 106–108
See application file for complete search history.

(56) References Cited

U.S. PATENT DOCUMENTS 2,855,199 A * 10/1958 Noland et al. ..... 482/97
2,921,791 A 1/1960 Berne
3,306,611 A 2/1967 Gaul
3,588,101 A 6/1971 Jungreis
3,638,941 A 2/1972 Kulkens
3,662,602 A 5/1972 Weiss
3,822,599 A 7/1974 Brentham
3,856,297 A 12/1974 Schnell
4,076,236 A 2/1978 Ionel
4,290,597 A 9/1981 Schleffendorf
4,336,934 A 6/1982 Hanagan et al.

(Continued)

FOREIGN PATENT DOCUMENTS

CN 2430184 Y 5/2001

(Continued)

OTHER PUBLICATIONS

Cybex International, Inc., Commercial Strength Systems brochure, 4535 Arm Curl, 5255 Rear Delt, 5281 Arm Curl, pp. 9 and 36 (Apr. 2000).

(Continued)

*Primary Examiner*—Loan H Thanh
*Assistant Examiner*—Victor K Hwang
(74) *Attorney, Agent, or Firm*—Dorsey & Whitney LLP

(57) ABSTRACT

The present invention is a weight exercise machine for use by a user. The machine comprises an exercise member, a plurality of weights, and an index. The user exerts an exercise force against the exercise member when using the machine to exercise. The index is rotated to operably couple the exercise member to at least one of the weight plates such that the displacement of the exercise member causes the at least one of the weight plates to displace. The plurality of weight plates includes a first weight plate type and a second weight plate type having configurations and masses that differ. The index allows selection of different combinations of weight plates for operable coupling to the exercise member.

14 Claims, 46 Drawing Sheets

U.S. PATENT DOCUMENTS

| | | | | | |
|---|---|---|---|---|---|
| 4,357,010 | A | | 11/1982 | Telle | |
| 4,405,128 | A | | 9/1983 | McLaughlin et al. | |
| 4,426,077 | A | | 1/1984 | Becker | |
| 4,453,710 | A | | 6/1984 | Plötz | |
| 4,478,411 | A | | 10/1984 | Baldwin | |
| 4,502,681 | A | | 3/1985 | Blomqvist | |
| 4,529,198 | A | | 7/1985 | Hettick, Jr. | |
| 4,538,805 | A | * | 9/1985 | Parviainen | 482/98 |
| 4,546,971 | A | | 10/1985 | Raasoch | |
| 4,598,908 | A | | 7/1986 | Morgan | |
| 4,627,614 | A | | 12/1986 | de Angeli | |
| 4,627,615 | A | * | 12/1986 | Nurkowski | 482/98 |
| 4,700,944 | A | | 10/1987 | Sterba et al. | |
| 4,722,522 | A | | 2/1988 | Lundgren | |
| 4,756,526 | A | | 7/1988 | Broussard | |
| 4,787,629 | A | | 11/1988 | DeMyer | |
| 4,804,179 | A | | 2/1989 | Murphy et al. | |
| 4,822,034 | A | | 4/1989 | Shields | |
| 4,834,396 | A | * | 5/1989 | Schnell | 482/97 |
| 4,854,578 | A | * | 8/1989 | Fulks | 482/100 |
| 4,858,915 | A | | 8/1989 | Szabo | |
| 4,861,025 | A | | 8/1989 | Rockwell | |
| 4,880,229 | A | | 11/1989 | Broussard | |
| 4,902,007 | A | | 2/1990 | Ferrari | |
| 4,944,511 | A | | 7/1990 | Francis | |
| 4,951,939 | A | | 8/1990 | Peters | |
| 4,971,305 | A | | 11/1990 | Rennex | |
| 4,982,957 | A | | 1/1991 | Shields | |
| 5,002,271 | A | | 3/1991 | Gonzales | |
| 5,050,873 | A | | 9/1991 | Jones | |
| D321,025 | S | | 10/1991 | Jones | |
| D321,026 | S | | 10/1991 | Jones | |
| D321,027 | S | | 10/1991 | Jones | |
| D321,028 | S | | 10/1991 | Jones | |
| 5,060,938 | A | | 10/1991 | Hawley, Jr. | |
| D321,387 | S | | 11/1991 | Jones | |
| D321,389 | S | | 11/1991 | Jones | |
| D321,390 | S | | 11/1991 | Jones | |
| D321,391 | S | | 11/1991 | Jones | |
| 5,066,003 | A | | 11/1991 | Jones | |
| 5,066,004 | A | | 11/1991 | Jones | |
| 5,094,450 | A | | 3/1992 | Stearns | |
| 5,106,080 | A | | 4/1992 | Jones | |
| 5,116,297 | A | | 5/1992 | Stonecipher | |
| 5,123,885 | A | | 6/1992 | Shields | |
| 5,125,881 | A | | 6/1992 | Jones | |
| 5,135,449 | A | | 8/1992 | Jones | |
| 5,135,456 | A | | 8/1992 | Jones | |
| 5,171,198 | A | | 12/1992 | Jones | |
| 5,180,354 | A | | 1/1993 | Jones | |
| 5,181,896 | A | | 1/1993 | Jones | |
| 5,230,680 | A | | 7/1993 | Wu | |
| 5,263,915 | A | | 11/1993 | Habing | |
| 5,273,504 | A | | 12/1993 | Jones | |
| 5,273,505 | A | | 12/1993 | Jones | |
| 5,306,221 | A | | 4/1994 | Itaru | |
| 5,308,303 | A | | 5/1994 | Rawls et al. | |
| 5,336,148 | A | | 8/1994 | Ish, III | |
| 5,380,258 | A | | 1/1995 | Hawley, Jr. | |
| 5,387,170 | A | | 2/1995 | Rawls et al. | |
| D359,778 | S | | 6/1995 | Towley, III et al. | |
| 5,429,570 | A | * | 7/1995 | Beyer | 482/104 |
| 5,484,367 | A | | 1/1996 | Martinez | |
| 5,554,084 | A | | 9/1996 | Jones | |
| 5,554,089 | A | | 9/1996 | Jones | |
| 5,554,090 | A | | 9/1996 | Jones | |
| 5,562,577 | A | | 10/1996 | Nichols, Sr. et al. | |
| 5,628,715 | A | | 5/1997 | Simonson | |
| 5,632,710 | A | | 5/1997 | England et al. | |
| 5,637,064 | A | | 6/1997 | Olson et al. | |
| 5,749,813 | A | | 5/1998 | Domzalski | |
| 5,769,757 | A | | 6/1998 | Fulks | |
| 5,769,762 | A | | 6/1998 | Towley, III et al. | |
| 5,779,604 | A | | 7/1998 | Towley, III et al. | |
| 5,788,615 | A | | 8/1998 | Jones | |
| 5,788,616 | A | | 8/1998 | Polidi | |
| 5,810,701 | A | | 9/1998 | Ellis et al. | |
| 5,839,997 | A | | 11/1998 | Roth et al. | |
| 5,876,313 | A | | 3/1999 | Krull | |
| 6,015,367 | A | | 1/2000 | Scaramucci | |
| 6,033,350 | A | | 3/2000 | Krull | |
| D422,654 | S | | 4/2000 | Chen | |
| 6,045,491 | A | | 4/2000 | McNergney et al. | |
| 6,095,955 | A | | 8/2000 | Lee | |
| 6,099,442 | A | | 8/2000 | Krull | |
| 6,117,049 | A | | 9/2000 | Lowe | |
| 6,149,558 | A | | 11/2000 | Chen | |
| 6,174,265 | B1 | | 1/2001 | Alessandri | |
| 6,186,927 | B1 | | 2/2001 | Krull | |
| 6,186,928 | B1 | | 2/2001 | Chen | |
| 6,196,952 | B1 | | 3/2001 | Chen | |
| 6,203,474 | B1 | | 3/2001 | Jones | |
| 6,228,003 | B1 | | 5/2001 | Hald et al. | |
| 6,261,022 | B1 | | 7/2001 | Dalebout et al. | |
| 6,322,481 | B1 | | 11/2001 | Krull | |
| 6,364,815 | B1 | | 4/2002 | Lapcevic | |
| 6,402,666 | B2 | | 6/2002 | Krull | |
| 6,416,446 | B1 | | 7/2002 | Krull | |
| 6,422,979 | B1 | | 7/2002 | Krull | |
| 6,436,013 | B1 | | 8/2002 | Krull | |
| 6,440,044 | B1 | | 8/2002 | Francis et al. | |
| 6,482,139 | B1 | | 11/2002 | Haag | |
| 6,500,101 | B1 | | 12/2002 | Chen | |
| 6,500,106 | B1 | | 12/2002 | Fulks | |
| 6,517,468 | B1 | | 2/2003 | Lapcevic | |
| 6,540,650 | B1 | | 4/2003 | Krull | |
| 6,561,960 | B2 | | 5/2003 | Webber | |
| 6,595,902 | B1 | | 7/2003 | Savage et al. | |
| 6,605,024 | B2 | | 8/2003 | Stearns | |
| 6,629,910 | B1 | | 10/2003 | Krull | |
| 6,656,093 | B2 | | 12/2003 | Chen | |
| 6,669,606 | B2 | | 12/2003 | Krull | |
| 6,682,464 | B2 | | 1/2004 | Shifferaw | |
| 6,719,672 | B1 | | 4/2004 | Ellis et al. | |
| 6,719,674 | B2 | | 4/2004 | Krull | |
| 6,733,424 | B2 | | 5/2004 | Krull | |
| 6,746,381 | B2 | | 6/2004 | Krull | |
| 6,749,547 | B2 | | 6/2004 | Krull | |
| 6,802,800 | B1 | | 10/2004 | Hobson | |
| D498,272 | S | | 11/2004 | Sanford-Schwentke et al. | |
| D500,820 | S | | 1/2005 | Krull | |
| 6,855,097 | B2 | | 2/2005 | Krull | |
| 6,902,516 | B2 | | 6/2005 | Krull | |
| D508,628 | S | | 8/2005 | Crawford et al. | |
| 6,974,405 | B2 | | 12/2005 | Krull | |
| 7,018,325 | B2 | * | 3/2006 | Shifferaw | 482/104 |
| D521,087 | S | | 5/2006 | Francis | |
| 7,066,867 | B2 | | 6/2006 | Krull | |
| 7,077,790 | B1 | | 7/2006 | Krull | |
| 7,077,791 | B2 | | 7/2006 | Krull | |
| 7,090,625 | B2 | | 8/2006 | Chermack | |
| D528,173 | S | | 9/2006 | Flick et al. | |
| D528,611 | S | | 9/2006 | Flick et al. | |
| 7,121,988 | B2 | | 10/2006 | Walkerdine | |
| 7,137,931 | B2 | | 11/2006 | Liu | |
| 7,137,932 | B2 | | 11/2006 | Doudiet | |
| D533,910 | S | | 12/2006 | Dibble et al. | |
| 7,153,243 | B1 | | 12/2006 | Krull | |
| 7,172,536 | B2 | | 2/2007 | Liu | |
| 7,189,190 | B2 | | 3/2007 | Lamar et al. | |
| D540,405 | S | | 4/2007 | Crawford et al. | |
| D540,894 | S | | 4/2007 | Crawford et al. | |
| 7,252,627 | B2 | | 8/2007 | Carter | |
| 7,261,678 | B2 | | 8/2007 | Crawford et al. | |

| | | | | |
|---|---|---|---|---|
| D550,789 | S | 9/2007 | Dibble et al. | |
| 7,306,549 | B2 * | 12/2007 | Francis | 482/100 |
| 7,387,595 | B2 | 6/2008 | Towley, III et al. | |
| 7,413,532 | B1 | 8/2008 | Monsrud et al. | |
| 7,591,770 | B2 * | 9/2009 | Stewart et al. | 482/99 |
| 2002/0025888 | A1 | 2/2002 | Germanton et al. | |
| 2002/0077230 | A1 | 6/2002 | Lull et al. | |
| 2003/0092542 | A1 | 5/2003 | Bartholomew et al. | |
| 2003/0148862 | A1 | 8/2003 | Chen et al. | |
| 2003/0199368 | A1 | 10/2003 | Krull | |
| 2004/0005969 | A1 | 1/2004 | Chen | |
| 2004/0023765 | A1 | 2/2004 | Krull | |
| 2004/0220025 | A1 | 11/2004 | Krull | |
| 2005/0079961 | A1 | 4/2005 | Dalebout et al. | |
| 2005/0085351 | A1 | 4/2005 | Kissel | |
| 2006/0063650 | A1 | 3/2006 | Francis | |
| 2006/0100069 | A1 | 5/2006 | Dibble et al. | |
| 2006/0105889 | A1 | 5/2006 | Webb | |
| 2006/0116249 | A1 | 6/2006 | Dibble et al. | |
| 2006/0135328 | A1 | 6/2006 | Doudiet | |
| 2006/0205571 | A1 | 9/2006 | Krull | |
| 2006/0211550 | A1 | 9/2006 | Crawford et al. | |
| 2006/0217245 | A1 | 9/2006 | Golesh et al. | |
| 2006/0223684 | A1 | 10/2006 | Krull | |
| 2007/0203001 | A1 | 8/2007 | Krull | |
| 2007/0275836 | A1 * | 11/2007 | Parviainen | 482/100 |
| 2008/0039299 | A1 | 2/2008 | Crawford et al. | |
| 2008/0085821 | A1 | 4/2008 | Webb | |

FOREIGN PATENT DOCUMENTS

| | | | |
|---|---|---|---|
| EP | 0 121 902 | A1 | 10/1984 |
| EP | 0 617 986 | A1 | 10/1994 |
| EP | 1 614 450 | A1 | 1/2006 |
| FR | 1 468 902 | | 4/1967 |
| FR | 2 613 237 | A1 | 10/1988 |
| GB | 2 232 089 | A | 12/1990 |
| JP | 10118222 | | 5/1998 |
| SE | 455 573 | | 7/1988 |
| SU | 1258447 | A1 | 9/1986 |
| SU | 1367987 | A1 | 1/1988 |
| SU | 1389789 | A2 | 4/1988 |
| SU | 1643024 | A1 | 4/1991 |
| SU | 1780780 | A1 | 12/1992 |

OTHER PUBLICATIONS

Nautilus Super Smooth Technology, "Equipment Comparison", undated brochure, one page (undated).

Non-Final Office Action and Notice of References Cited, U.S. Appl. No. 11/242,320, filed Oct. 24, 2008, 9 pages.

Amendment and Response to Office Action, U.S. Appl. No. 11/242,320, filed Feb. 24, 2009, 9 pages.

Final Office Action and Notice of References Cited, U.S. Appl. No. 11/242,320, filed May 13, 2009, 9 pages.

Amendment and Response to Final Office Action, U.S. Appl. No. 11/242,320, filed Jul. 13, 2009, 10 pages.

Advisory Action Before the Filing of an Appeal Brief, U.S. Appl. No. 11/242,320, filed Jul. 22, 2009, 8 pages.

Amendment and Response to Final Office Action and Advisory Action, U.S. Appl. No. 11/242,320, filed Aug. 12, 2009, 10 pages.

Office Action, U.S. Appl. No. 11/867,643, mailed Jun. 26, 2008, 6 pages.

Amendment and Response to Election Requirement, U.S. Appl. No. 11/867,643, dated Jul. 28, 2008, 7 pages.

Office Action and PTO-892, U.S. Appl. No. 11/867,643, mailed Sep. 17, 2008, 12 pages.

Amendment and Response to Office Action, U.S. Appl. No. 11/867,643, dated Jan. 21, 2009, 9 pages.

Notice of Allowance and Fee(s) Due, Notice of Allowability, and Detailed Action, U.S. Appl. No. 11/867,643, filed May 6, 2009, 5 pages.

Non-Final Office Action and Notice of References Cited, U.S. Appl. No. 11/242,320, Sep. 28, 2009, 9 pages.

Notice of Allowance and Fee(s) Due, Notice of Allowability, and Detailed Action, U.S. Appl. No. 11/867,643, Oct. 13, 2009, 5 pages.

Amendment and Response to Non-Final Office Action, U.S. Appl. No. 11/242,320, dated Dec. 16, 2009, 8 pages.

Terminal Disclaimer, U.S. Appl. No. 11/867,643, dated Dec. 16, 2009, 1 page.

* cited by examiner

EXERCISE MACHINE HAVING ROTATABLE WEIGHT SELECTION INDEX

CROSS-REFERENCE TO RELATED APPLICATIONS

The present application is a continuation of co-pending U.S. application Ser. No. 11/242,320, filed Oct. 3, 2005, which claims the benefit under 35 U.S.C. § 119(e) to both U.S. provisional patent application No. 60/616,003, filed Oct. 4, 2004, and U.S. provisional patent application No. 60/616,387, filed Oct. 5, 2004, which are all hereby incorporated herein by reference in their entireties.

FIELD OF THE INVENTION

The present invention relates to exercise equipment and methods of making and using such equipment. More particularly, the present invention relates to weight exercise equipment and methods of using and making such equipment.

BACKGROUND OF THE INVENTION

Traditional weight machines are either plate loaded, where the user mounts the desired amount of weight plates on the machine manually, or weight-stack loaded, where the user selects the desired amount of weight from a weight stack using a removable pin. Both have their drawbacks.

While the plate-loaded machines allow smooth operation and a wide variety of load to be applied, even allowing the use of load increments as small as two and a half pound plates, it requires locating the various increments of the proper weight plates in a sometimes busy and disorganized weight room. Also, the plate-loaded machines require the user to load and unload the machine, which presents an injury hazard and wastes energy of the user better reserved for the actual exercise movement performed on the machine.

The weight-stack loaded machines are convenient, but most often only allow relatively large increments of weights (mostly 10 pounds) to be selected using the pin. Some weight-stack loaded machines have supplemental weights to allow for application of smaller increments of weights, but often require the actuation of a second weight selection structure for the supplemental weights. The weight-stack loaded machines typically have tall profiles. Also, the weight-stack loaded machines utilize tubular columns along which the weights displace. This arrangement results in relatively high friction generation and weight movement that is less smooth than plate-loaded machines.

There is a need in the art for a weight exercise machine that offers the convenience and safety of a weight-stack machine and the incremental adjustment capability and smooth operational characteristics of a plate-loaded machine. There is also a need in the art for a method of manufacturing and using such a machine.

SUMMARY OF THE INVENTION

The present invention, in one embodiment, is a weight exercise machine for use by a user. The machine comprises an exercise member, a plurality of weights, and an index. The user exerts an exercise force against the exercise member when using the machine to exercise. The index is rotated to operably couple the exercise member to at least one of the weight plates such that the displacement of the exercise member causes the at least one of the weight plates to displace. The plurality of weight plates includes a first weight plate type and a second weight plate type having configurations and masses that differ.

In one embodiment, the exercise machine further comprises a base frame and a weight arm. The weight arm is moveably coupled to the base frame and operably coupled to the exercise member. The index facilitates the at least one of the weight plates operably coupling to the weight arm. In one embodiment, at least a portion of the index is mounted on the weight arm.

In one embodiment, the index includes an axle and an adjustment wheel for driving the axle. The axle is rotated to couple the exercise member with the at least one of the weight plates. In one embodiment, the index further includes a hook displaced by the axle to engage the at least one of the weight plates in order to couple the exercise member with the at least one of the weight plates. In one embodiment, the axle includes an arcuate surface for engaging a feature on the at least one of the weight plates in order to couple the exercise member with the at least one of the weight plates.

In one embodiment, the exercise member is configured for engagement by the user's feet and/or legs. In one embodiment, the exercise member is configured for engagement by the user's head and/or torso. In one embodiment, the exercise member is configured for engagement by the user's hands and/or arms.

The present invention, in another embodiment, is a weight exercise machine comprising a base frame, a first weight, a weight arm moveably coupled to the base frame, and a first axle rotatable to operably couple the first weight to the weight arm. The first weight is moveably coupled to the base frame and, in one embodiment, is pivotally coupled to the base frame. The weight arm is pivotally coupled to the base frame. The first axle is rotatably coupled to the weight arm.

In one embodiment, rotation of the first axle causes a hook to engage the first weight. In one embodiment, rotation of the first axle causes an arcuate surface to engage a protrusion on the first weight.

In one embodiment, the machine further comprises a second weight having a mass different from the first weight. In one embodiment, the machine further comprises a second axle rotatable to operably couple the second weight to the weight arm.

The present invention, in one embodiment, is a method of exercising with a weight exercise machine. The method comprises rotating an indexing mechanism to operably couple a weight arm to a first weight plate combination, wherein the weight arm is operably coupled to an exercise member. A user exerts a first force against the exercise member to cause the first weight plate combination and weight arm to displace as a unit relative to a base frame, wherein the weight arm is moveably coupled to the base frame. The method further comprises rotating the indexing mechanism a second time to operably couple the weight arm to a second weight plate combination. The user exerts a second force against the exercise member to cause the second weight plate combination and weight arm to displace as a unit relative to the base frame.

While multiple embodiments are disclosed, still other embodiments of the present invention will become apparent to those skilled in the art from the following detailed description, which shows and describes illustrative embodiments of the invention. As will be realized, the invention is capable of modifications in various aspects, all without departing from the spirit and scope of the present invention. Accordingly, the drawings and detailed description are to be regarded as illustrative in nature and not restrictive.

DETAILED DESCRIPTION OF THE INVENTION a. Overview of the Weight Exercise Machine The present invention is a weight exercise machine for use by a person. The machine includes a plurality of weight plates, a weight indexing mechanism, and an exercise member against which the person exerts an exercise force when using the machine to exercise. In one embodiment, the weight indexing mechanism is rotatable to selectively operably couple the exercise member with various weight plate combinations such that displacement of the exercise member causes a selected weight plate combination to displace.

Due to the machine's configuration, the machine generates less friction than conventional weight exercise machines and, as a result, offers very smooth operation. The machine's configuration also allows the selection of incremental weight changes that are substantially smaller than conventional weight exercise machines. Also, the machine's configuration results in a substantially decreased vertical profile as compared to conventional weight exercise machines. For at least these reasons, the weight exercise machine of the present invention is advantageous over the conventional weight exercise machines known in the art.

b. First Embodiment of the Weight Exercise Machine

Figure 1:
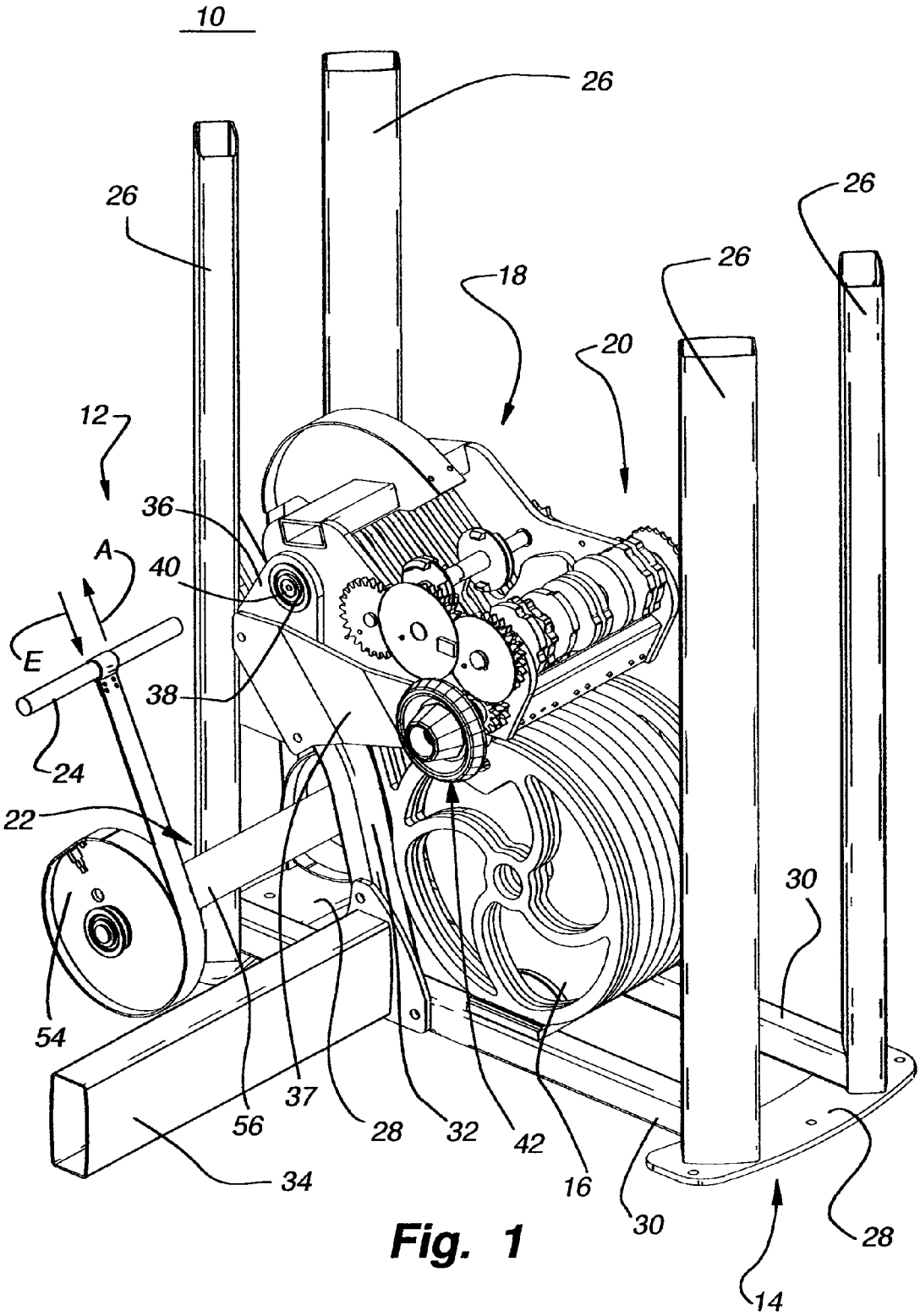
FIG. 1 is an isometric view of the weight exercise machine as viewed from the front/user side of the machine.
Figure 2:
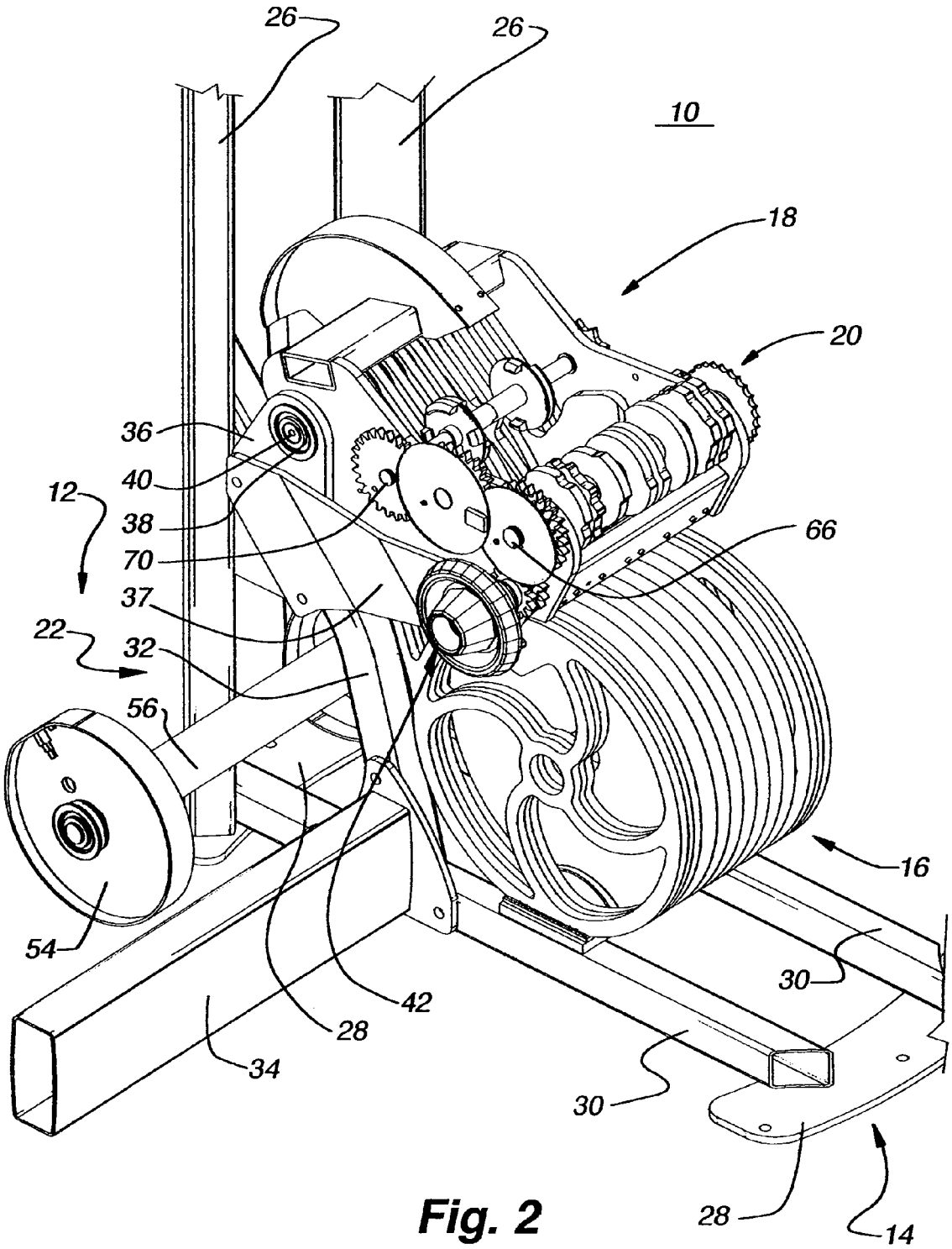
FIG. 2 is the same view depicted in FIG. 1, except, for clarity purposes, the view has been enlarged and the front vertical posts of the base frame have been removed.
Figure 3:
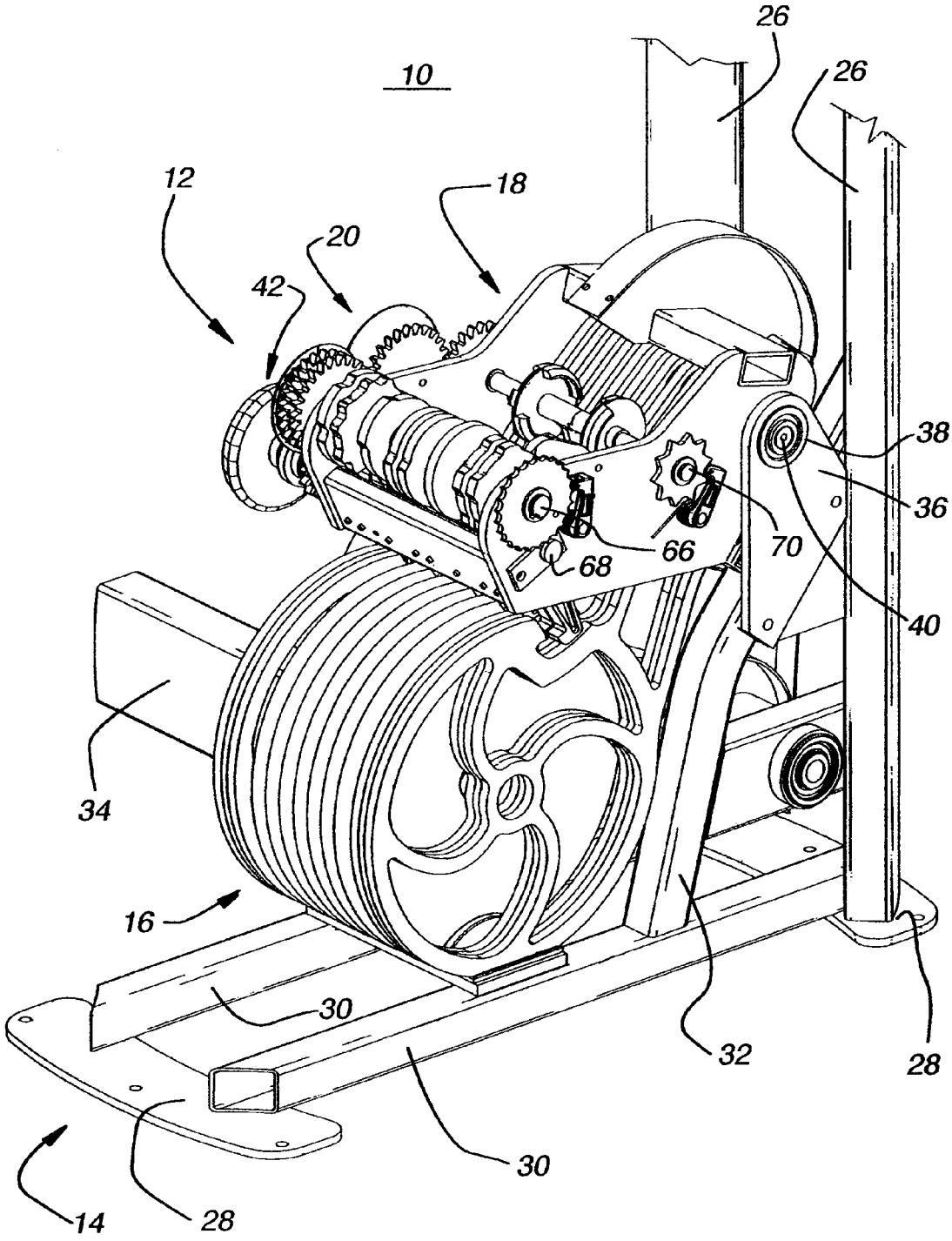
FIG. 3 is an isometric view of the exercise machine as viewed from the front/non-user side of the machine, wherein the front vertical posts of the base frame have been removed for clarity purposes.
Figure 4:
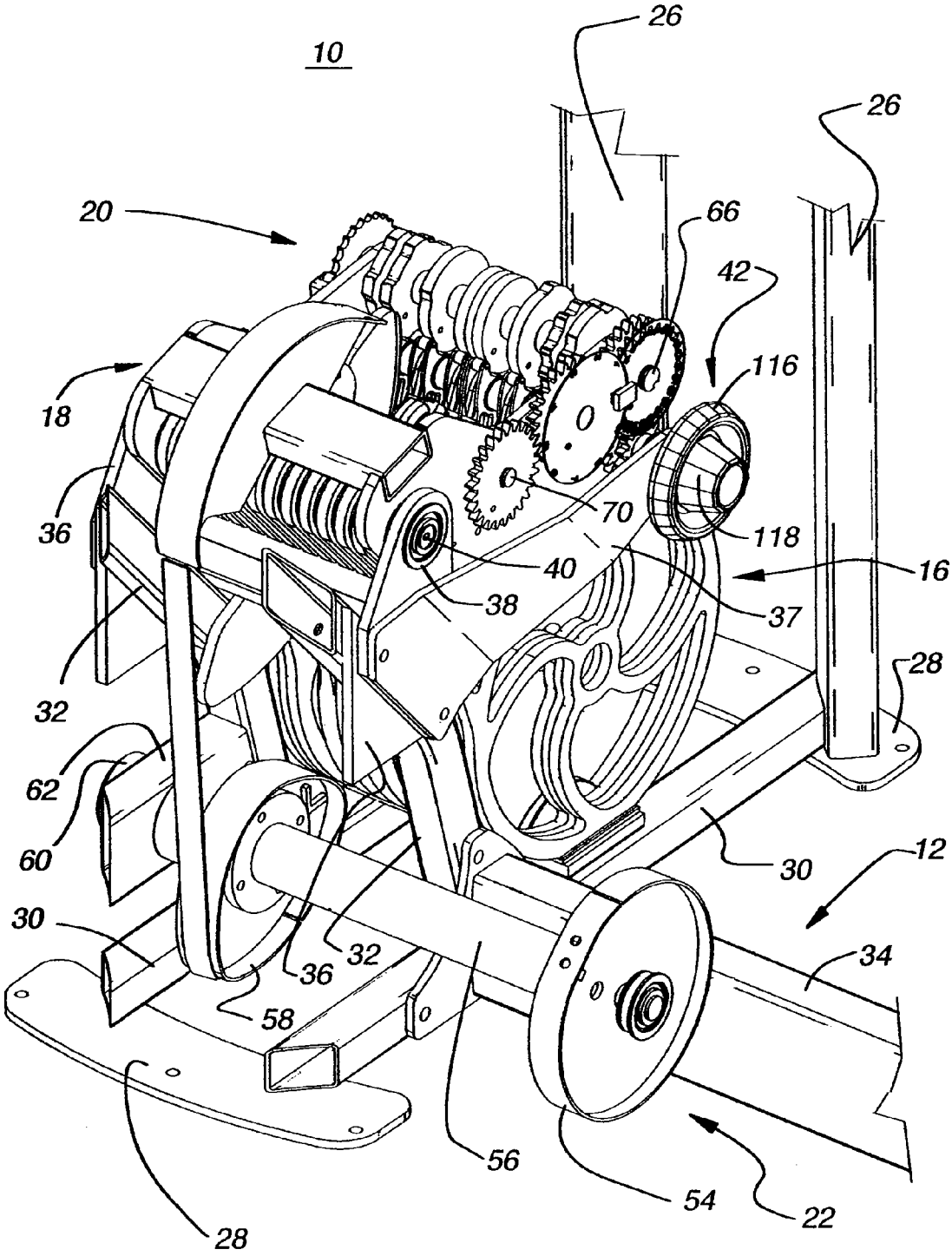
FIG. 4 is an isometric view of the exercise machine as viewed from the rear/user side of the machine, wherein the rear vertical posts of the base frame have been removed for clarity purposes.
Figure 5:
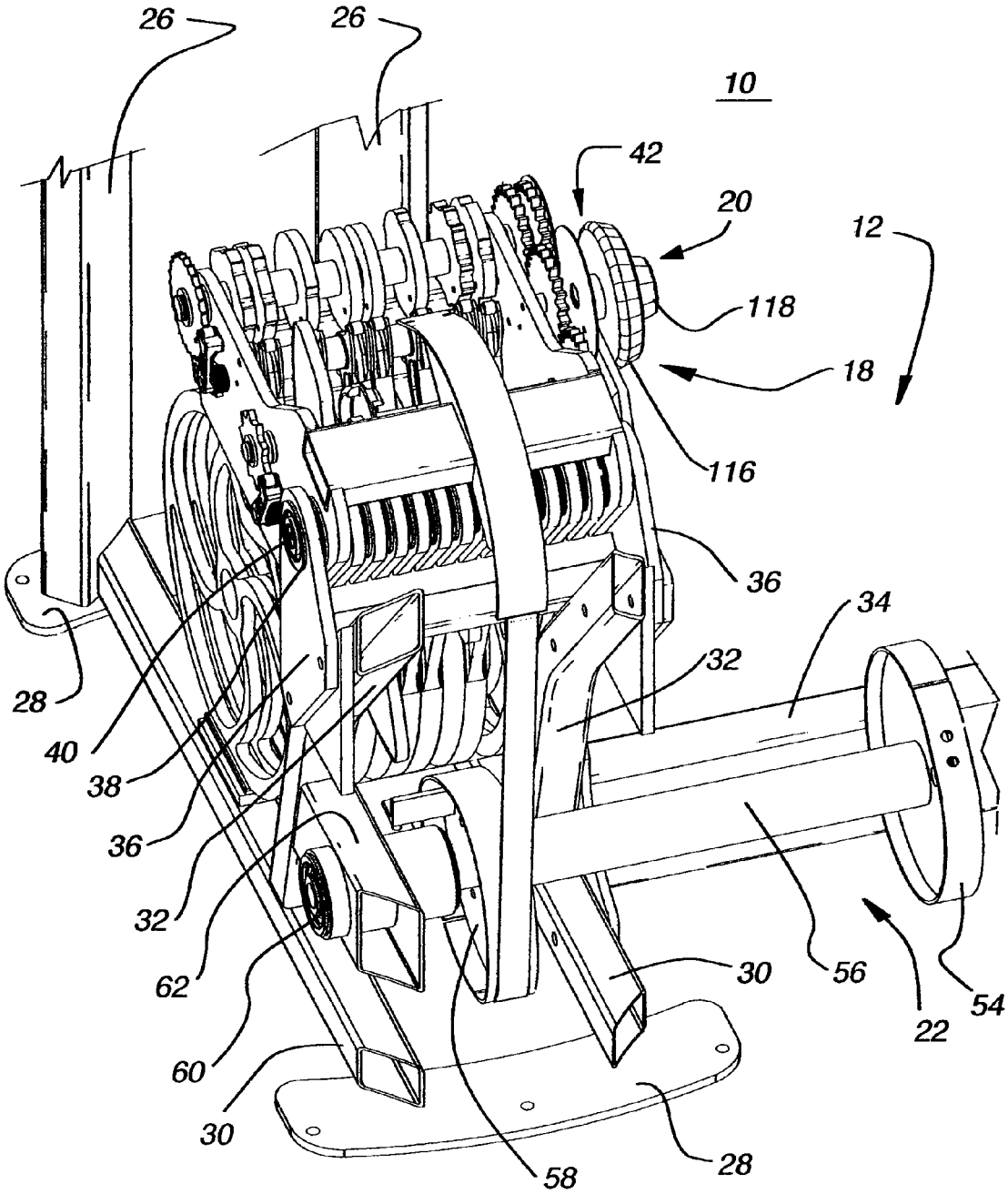
FIG. 5 is an isometric view of the exercise machine as viewed from the rear/non-user side of the machine, wherein the rear vertical posts of the base frame have been removed for clarity purposes.

For an understanding of the overall configuration the first embodiment of the weight exercise machine 10 of the present invention and the relationships between the machine's various elements, reference is made to FIGS. 1-5. FIG. 1 is an isometric view of the weight exercise machine 10 as viewed from the front/user side of the machine 10. FIG. 2 is the same view depicted in FIG. 1, except, for clarity purposes, the view has been enlarged and the front vertical posts of the base frame have been removed. FIG. 3 is an isometric view of the exercise machine 10 as viewed from the front/non-user side of the machine 10, wherein the front vertical posts of the base frame have been removed for clarity purposes. FIG. 4 is an isometric view of the exercise machine 10 as viewed from the rear/user side of the machine 10, wherein the rear vertical posts of the base frame have been removed for clarity purposes. FIG. 5 is an isometric view of the exercise machine 10 as viewed from the rear/non-user side of the machine 10, wherein the rear vertical posts of the base frame have been removed for clarity purposes.

As illustrated in FIG. 1, the machine 10 includes a workstation 12, a base frame 14, weights 16, a weight arm assembly 18, a weight indexing mechanism 20, and a force transfer mechanism 22. The workstation 12 is located on the user side of the machine 10 and includes an exercise member 24 that a user engages and displaces to exercise with the machine 10. For example, where the machine 10 is an embodiment intended to exercise portions of the upper body (e.g., shoulders, chest, back, arms, traps, etc.), the exercise member 24 will be configured for engagement by the user's hands and/or arms. Where the machine 10 is an embodiment intended to exercise portions of the mid and lower torso (e.g., abdominals, lower back, etc.) the exercise member 24 will be configured for engagement by the user's hands, arms, and/or upper torso. Where the machine 10 is an embodiment intended to exercise portions of the lower body (e.g., upper and lower legs, glutes, etc.), the exercise member 24 will be configured for engagement by the user's legs, feet or shoulders. Where the machine 10 is an embodiment intended to exercise the neck, the exercise member 24 will be configured for engagement with the user's head.

As shown in FIGS. 1-5, the base frame 14 supports the moving parts of the machine 10 and includes front and rear vertical posts 26, front and rear foot plates 28, horizontal members 30, diagonal members 32, a work station member 34, pivot support plates 36, and an index wheel support arm 37. The front and rear foot plates 28 extend side-to-side between the bottoms of each pair of front vertical posts 26 and each pair of rear vertical posts 26. The horizontal members 30 extend front-to-back between the lower ends of the vertical posts 26. The diagonal members 32 extend from near the longitudinal middle of each rear vertical post 26 to near the longitudinal middle of the adjacent horizontal member 30. Each pivot support plate 36 extends vertically upward from a diagonal member 32 and includes a bearing/busing 38 for pivotally receiving a axle 40 about which the weight arm assembly 18 and the weights 16 pivot, as will be discussed in greater detail later in this Detailed Description. The index wheel support 37 extends forwardly and generally horizontal from the upper portion of the user side diagonal member 32. An index wheel assembly 42, which will be described in greater detail later in this Detailed Description, is rotatably mounted in the free end of the index wheel support 37.

As depicted in FIGS. 1-5, the workstation member 34 is on the user side of the base frame 14 and extends from the intersection between the diagonal member 32 and the horizontal member 30. As can be understood from FIG. 1, the workstation member 34 serves to couple the machine 10 to a workstation bench or seat (not shown) for supporting the user when displacing the exercise member 24 during the performance of an exercise movement.

Figure 6:
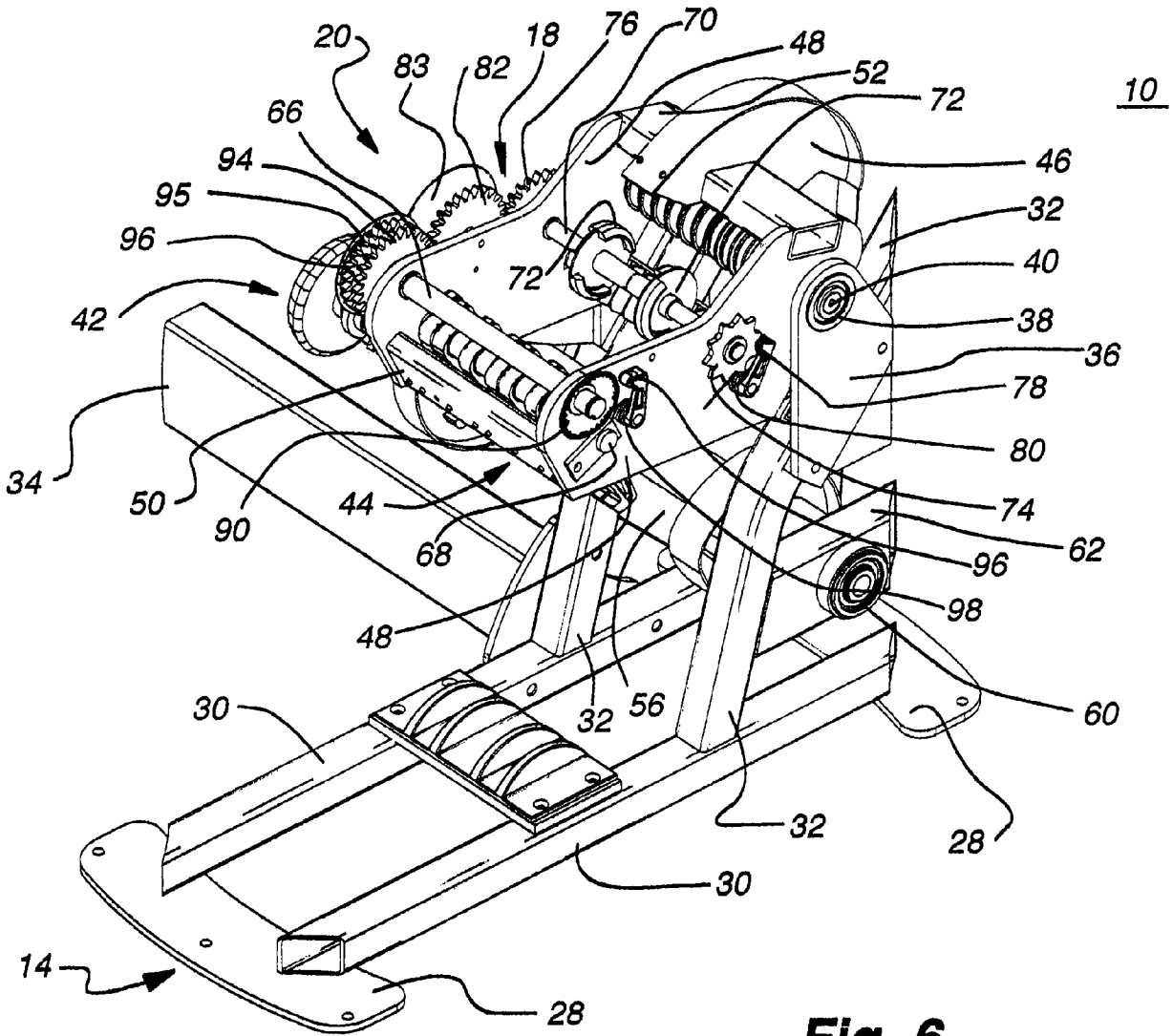
FIG. 6 is an isometric view of the weight exercise machine as viewed from the front/non-user side and, for clarity purposes, only depicting the weight arm assembly, portions of the base frame, and the force transfer mechanism.
Figure 7:
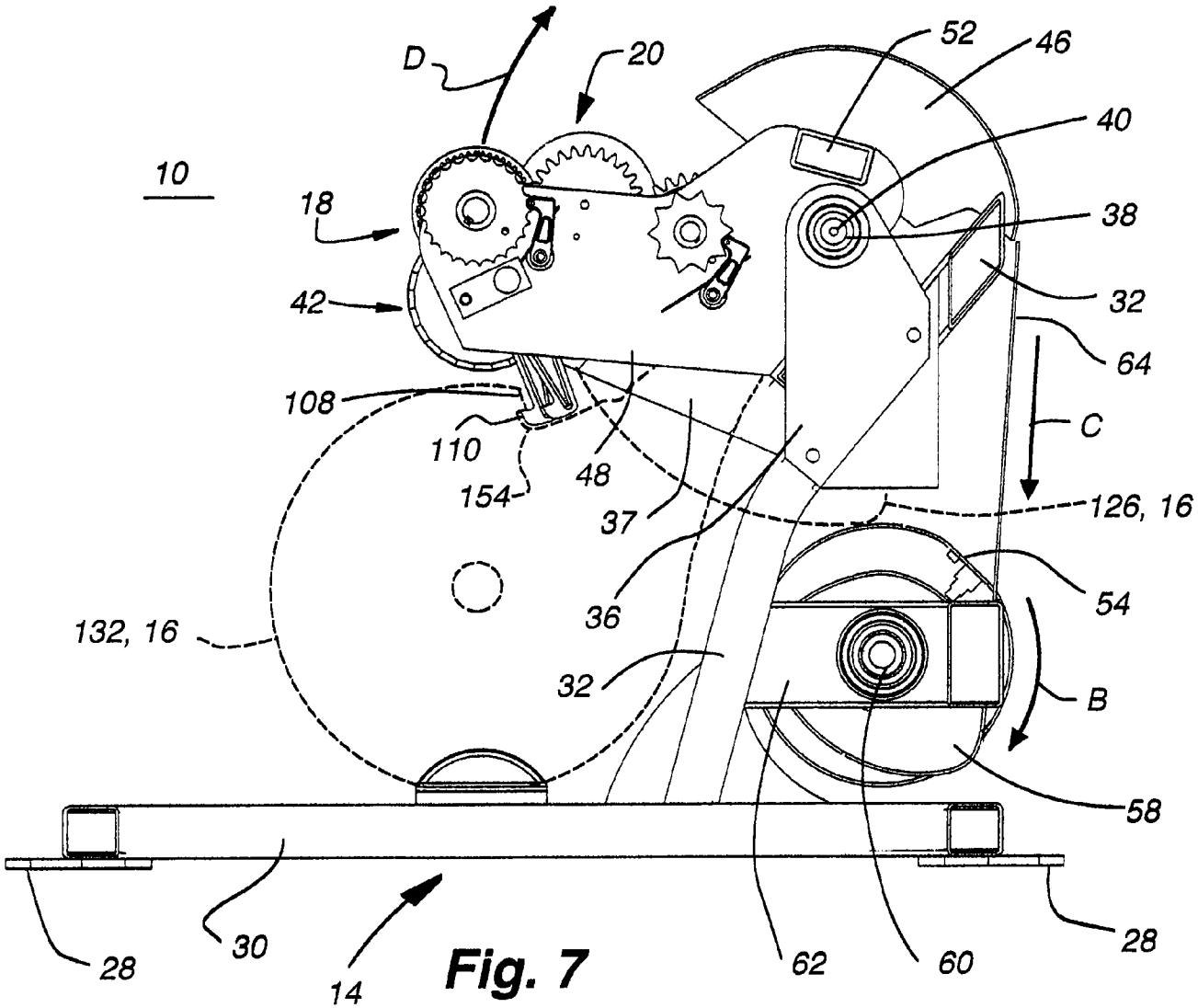
FIG. 7 is a non-user side elevation of the machine depicting the weights (shown in phantom lines) and the same machine elements shown in FIG. 6, wherein the weight arm assembly has not pivoted relative to the base frame.
Figure 8:
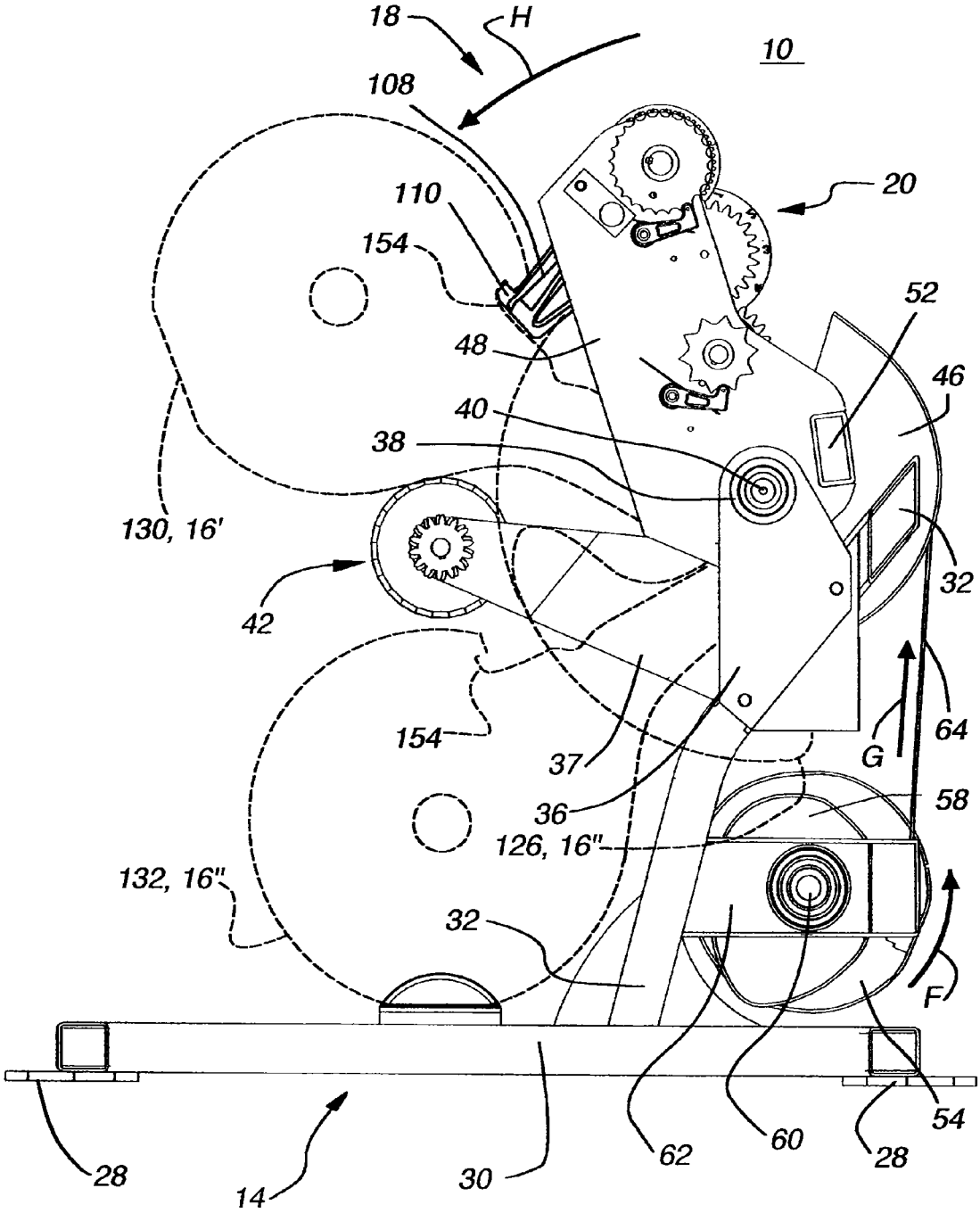
FIG. 8 is the same view illustrated in FIG. 7, except the weight arm assembly and the weights coupled thereto have pivoted relative to the base frame.

For a discussion of the components of the weight arm assembly 18 and its relationship to the base frame 14, reference is made to FIGS. 6-8. FIG. 6 is an isometric view of the weight exercise machine 10 as viewed from the front/non-user side and, for clarity purposes, only depicting the weight arm assembly 18, portions of the base frame 14, and the force transfer mechanism 22. FIG. 7 is a non-user side elevation of the machine 10 depicting the weights 16 (shown in phantom lines) and the same machine elements shown in FIG. 6, wherein the weight arm assembly 18 has not pivoted relative to the base frame 14. FIG. 8 is the same view illustrated in FIG. 7, except the weight arm assembly 18 and the weights 16 coupled thereto have pivoted relative to the base frame 14.

As shown in FIG. 6, the weight arm assembly 18 includes the weight index assembly 20, a frame 44, and a cam 46. The frame 44 includes side plates 48, a front member 50, and a rear member 52. The front and rear members 50, 52 extend side-to-side between the side plates 48. Elements of the weight index assembly 20 extend side-to-side between the side plates 48. The cam 46 is centered side-to-side on, and connected to, the rear member 52.

As indicated in FIGS. 1, 4 and 5, the force transfer mechanism 22 includes an exercise member pulley 54, a shaft 56, a cam 58, and a bearing/bushing 60 mounted in a frame member 62 that horizontally extends between the non-user side diagonal member 32 and the rear vertical post 26. As indicated in FIG. 1, the exercise member 24 is coupled to the exercise member pulley 54. The exercise member pulley 54, shaft 56 and cam 58 are rotatable relative to the base frame 14 via the bearing/bushing 60.

As illustrated in FIGS. 4-6, the rear portion of each side plate 48 of the weight arm assembly 18 is pivotally mounted on the axle 40 that extends between the pivot support plates 36 of the base frame 14. As depicted in FIGS. 7 and 8, the pivotal connection between the base frame 14 and the weight arm assembly 18 allows the weight arm assembly 18 to pivot between a downward position (see FIG. 7) and an upward position (see FIG. 8).

As shown in FIGS. 4, 5, 7 and 8, a chain, rope, cable or belt 64 extends between a point of connection with the cam 46 of the weight arm assembly 18 and a point of connection with the cam 58 of the force transfer mechanism 22. Thus, as can be understood from FIGS. 1, 4, 5, 7 and 8, when the user displaces the exercise member 24 away from the exercise member pulley 54 (as indicated by arrow A in FIG. 1), the force transfer mechanism 22 is caused to rotate such that the cam 58 of the force transfer mechanism 22 rotates clockwise as indicated by arrow B in FIG. 7. The clockwise rotation of the cam 58 of the transfer mechanism 22 causes the belt 64 to wrap about the cam 58, thereby causing the belt 64 to move downward as indicated by arrow C in FIG. 7. The downward motion of the belt 64 pulls on the cam 46 of the weight arm assembly 18, which causes the weight arm assembly 18 to pivot clockwise as indicated by arrow D in FIG. 7 as the weight arm assembly moves from the low position depicted in FIG. 7 to the high position depicted in FIG. 8.

As can be understood from FIGS. 1, 4, 5, 7 and 8, when the user allows the exercise member 24 to displace back towards the exercise member pulley 54 (as indicated by arrow E in FIG. 1), the force transfer mechanism 22 is caused to rotate such that the cam 58 of the force transfer mechanism 22 rotates counterclockwise as indicated by arrow F in FIG. 8. The counterclockwise rotation of the cam 58 of the transfer mechanism 22 causes the belt 64 to unwrap from about the cam 58, thereby causing the belt 64 to move upward as indicated by arrow G in FIG. 8. The upward motion of the belt 64 allows the weight arm assembly 18 to pivot counterclockwise as indicated by arrow H in FIG. 8 as the weight arm assembly moves from the high position depicted in FIG. 8 to the low position depicted in FIG. 7.

Figure 9:
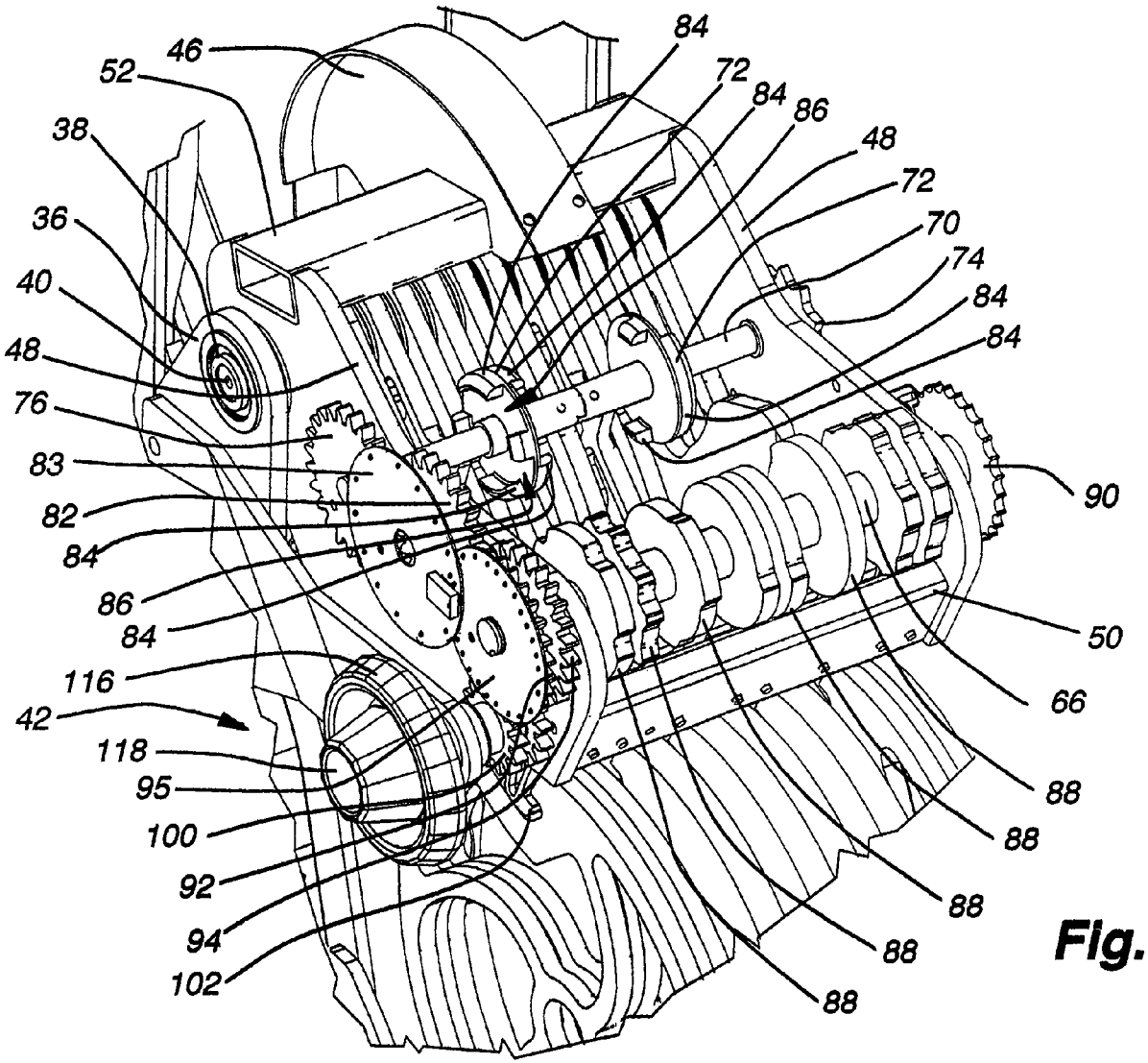
FIG. 9 is an enlarged isometric view of the weight arm assembly and weight-indexing mechanism as viewed from the front/user side of the weight exercise machine of the present invention.
Figure 10:
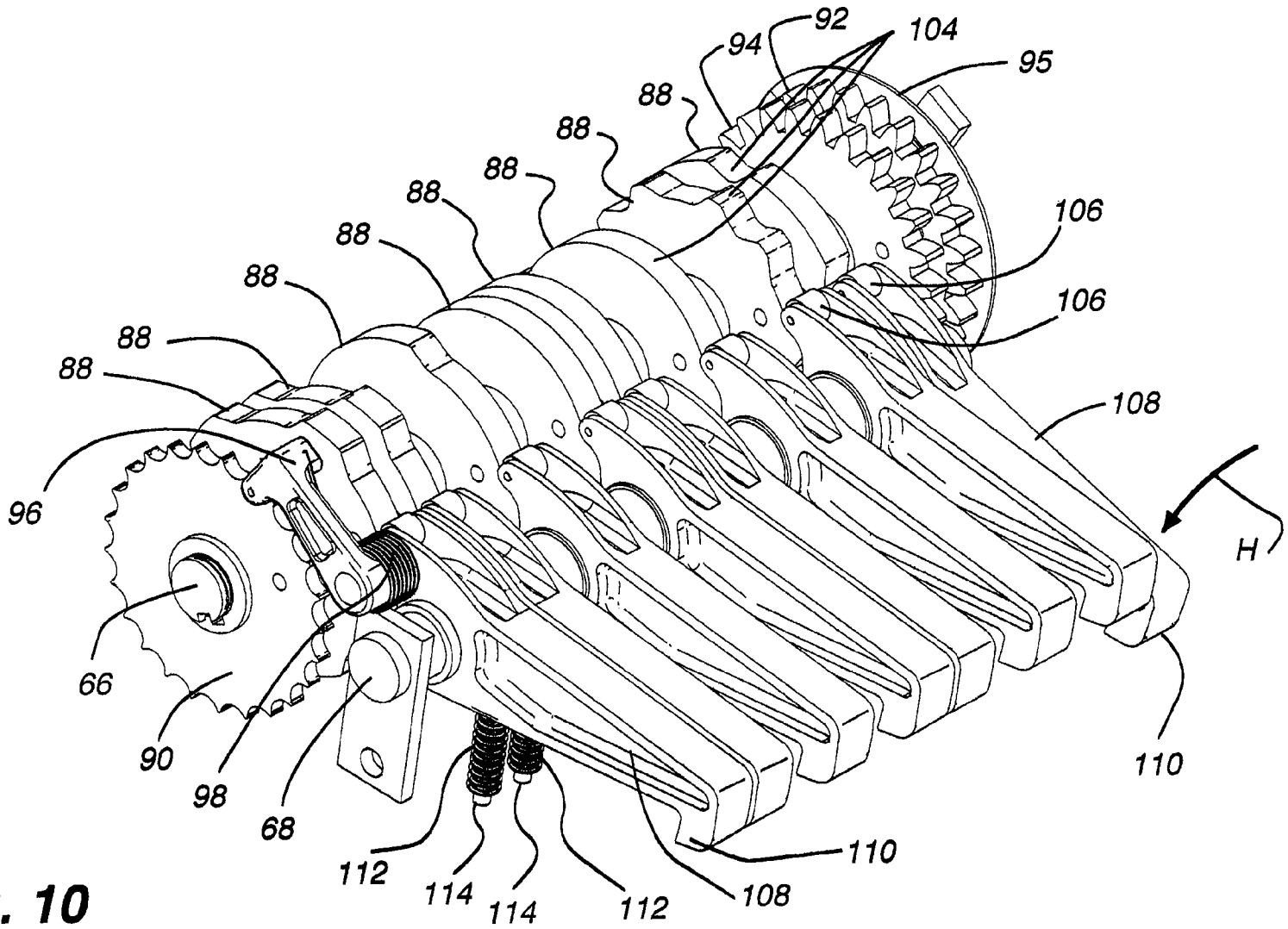
FIG. 10 is an enlarged isometric view of the primary weight engagement axle and the hook axle and their associated elements as viewed from a direction approximately degrees opposite of the viewing perspective in FIG. 9 (i.e., as viewed from the rear/non-user side of the machine).

As shown in FIG. 6, the weight indexing mechanism 20 includes a primary weight engagement axle 66 and its associated elements, a hook axle 68 and its associated elements, and an add-on weight engagement axle 70 and its associated elements. For a detailed discussion of the primary weight engagement axle 66, the hook axle 68, the add-on weight engagement axle 70 and their respective associated elements, reference is made to FIGS. 6, 9 and 10. FIG. 9 is an enlarged isometric view of the weight arm assembly 18 and weight indexing mechanism 22 as viewed from the front/user side of the weight exercise machine 10 of the present invention. FIG. 10 is an enlarged isometric view of the primary weight engagement axle 66 and the hook axle 68 and their associated elements as viewed from a direction approximately 180 degrees opposite of the viewing perspective in FIG. 9 (i.e., as viewed from the rear/non-user side of the machine 10).

As shown in FIGS. 6 and 9, the add-on weight engagement axle 70 extends between, and is rotatably supported by, the side plates 48 of the weight arm assembly 18. The add-on weight engagement axle 70 has mounted thereon a pair of weight engagement discs 72, an index sprocket 74, and a drive gear 76. The index sprocket 74 is located on the non-user side end of the add-on weight engagement axle 70 and interacts with a ratchet or follower arm 78 that is biased into engagement with the teeth of the index sprocket 74 via a spring 80. The ratchet arm 78 and index sprocket 74 interact to facilitate proper alignment of the weight engagement discs 72 with the weights 16 as discussed later in this Detailed Description. Also, the interaction between the ratchet arm 78 and index sprocket 74 provides a sensation to the user to indicate when the weight engagement discs 72 have been properly aligned. The drive gear 76 is located on the user side end of the add-on weight engagement axle 70 and is driven by an intermediate gear 82 rotatably supported off the user side plate 48 of the weight arm assembly 18. An indicator disk 83 shares the same axle as the intermediate gear 82 and is for indicating the amount of add-on weight engaged for lifting via the add-on weight engagement axle 70 and its associated elements.

The weight engagement disks 72 are located on the add-on weight engagement axle 70 between the side plates 48 of the weight arm assembly 18. The planar face of each weight engagement disc 72 is defined near the outer circumferential edge of each planar face by one or more arcuate cam surfaces or arcuate rim segments 84 that project outwardly from the respective planar face and are separated from each other by one or more gaps 86. As will be discussed later in this Detailed Description, the gaps 86 allow a cam follower or roller extending from an add-on weight to pass between the arcuate rim segments 84 to be engaged by an inner arcuate surface of an arcuate rim segment 84 when the weight arm assembly 18 is displaced upwardly (as previously discussed with respect to FIGS. 7 and 8) to cause the engaged add-on weight(s) to displace upwardly.

The ratchet arm 78 and index sprocket 74 interact to facilitate proper alignment of the weight engagement discs 72 with the roller(s) extending from the add-on weight(s) as the user indexes the weight indexing mechanism 20, as discussed later in this Detailed Description. Also, while the user is indexing the weight index mechanism 20, the interaction between the ratchet arm 78 and index sprocket 74 provides a sensation to the user to indicate when the weight engagement discs 72 have been properly aligned.

As shown in FIGS. 9 and 10, the primary weight engagement axle 66 extends between, and is rotatably supported by, the side plates 48 of the weight arm assembly 18. The primary weight engagement axle 66 has mounted thereon a plurality of cams 88, an index sprocket 90, a first drive gear 92, a second drive gear 94, and an indicator disk 95 for indicating the amount of primary weight engaged for lifting via the primary weight engagement axle 66 and its associated elements. The index sprocket 90 is located on the non-user side end of the primary weight engagement axle 66 and interacts with a ratchet or follower arm 96 that is biased into engagement with the teeth of the index sprocket 90 via a spring 98. The ratchet arm 96 and index sprocket 90 interact to facilitate proper alignment of the cam(s) 88 with the weight hook(s) supported off the hook axle 68 to cause the weight hook(s) to engage the primary weight(s), as discussed later in this Detailed Description. Also, the interaction between the ratchet arm 96 and index sprocket 90 provides a sensation to the user to indicate when the cam(s) 88 have been properly aligned.

The first drive gear 92, second drive gear 94 and indicator disk 95 are located on the user side end of the primary weight engagement axle 66, wherein the indicator disk 95 is at the extreme end of the primary weight engagement axle 66 followed by the first drive gear 92 and then the second drive gear 94. The first drive gear 92 is driven by a first drive gear 100 of the index wheel assembly 42 and rotates the primary weight engagement axle 66. The second drive gear 94 is driven by a second drive gear 102 of the index wheel assembly 42 and drives the intermediate gear 82 that drives the drive gear 76 of the add-on weight axle 70, thereby causing the add-on weight axle 70 to rotate.

As shown in FIG. 9, the cams 88 are evenly distributed along the primary weight engagement axle 66 between the side plates 48 of the weight arm assembly 18. As illustrated in FIG. 10, the cam surfaces 104 of the cams 88 vary and are positionally sequenced relative to each other such that, depending at what point along the indicator disk 95 the primary weight engagement axle 66 is rotated, one or more cams 88 will have cam surfaces 104 that abut against a roller or cam follower 106 on a hook 108 that is pivotally mounted on the hook axle 68. When a cam surface 104 abuts against a cam follower 106 of a hook 108, the hook 108 is caused to pivot about the hook axle 68 such that a tip 110 of the hook 108 engages a slot in the associated primary weight plate, as discussed later in this Detailed Description. Such a pivoting of a hook 108 by a cam surface 104 is indicated by arrow H in FIG. 10.

As indicated in FIG. 10, each hook 108 includes a helical spring 112 centered about a pin 114 that extends between the hook 108 and the front member 50 of the weight arm assembly 18. Each helical spring 112 acts between the front member 50 and the respective hook 108 to bias the tip 110 of the respective hook 108 out of engagement with the slot in the associated primary weight plate. When a cam surface 104 engages a cam follower 106 of a hook 108, the hook 108 is forced against the biasing force of the respective spring 112 to bring the hook tip 110 into engagement with the slot in the associated primary weight plate. As will be discussed later in this Detailed Description, the engagement of a hook tip 110 with the slot in the associated primary weight plate causes the primary weight plate to displace upwardly when the weight arm assembly 18 is displaced upwardly (as previously discussed with respect to FIGS. 7 and 8).

As shown in FIG. 9, the index wheel assembly 42 includes an outer wheel known as a primary weight or coarse adjustment wheel 116 and an inner wheel known as an add-on weight or fine adjustment wheel 118. The two wheels 116, 118 are coaxially mounted on coaxial axles that each connect to their respective drive gear 100, 102. Specifically, rotating the primary weight wheel 116 causes the first drive gear 100 of the index wheel assembly 42 to rotate and, as a result, the primary weight axle 66 to rotate. Rotating of the add-on weight wheel 118 causes the second drive gear 102 of the index wheel assembly 42 to rotate and, as a result, the add-on weight axle 70 to rotate. As can be understood from FIG. 8, although the gears 100, 102 of the index wheel assembly 42 engage and drive the first and second gears 92, 94 mounted on the primary weight engagement axle 66, when the weight arm assembly 18 is pivoted up the upward position, the index wheel assembly 42 and its gears 100, 102 do not follow, but instead remain fixed in position on the index wheel support arm 37, which is rigidly and non-moveably attached to the base frame 14.

Figure 11:
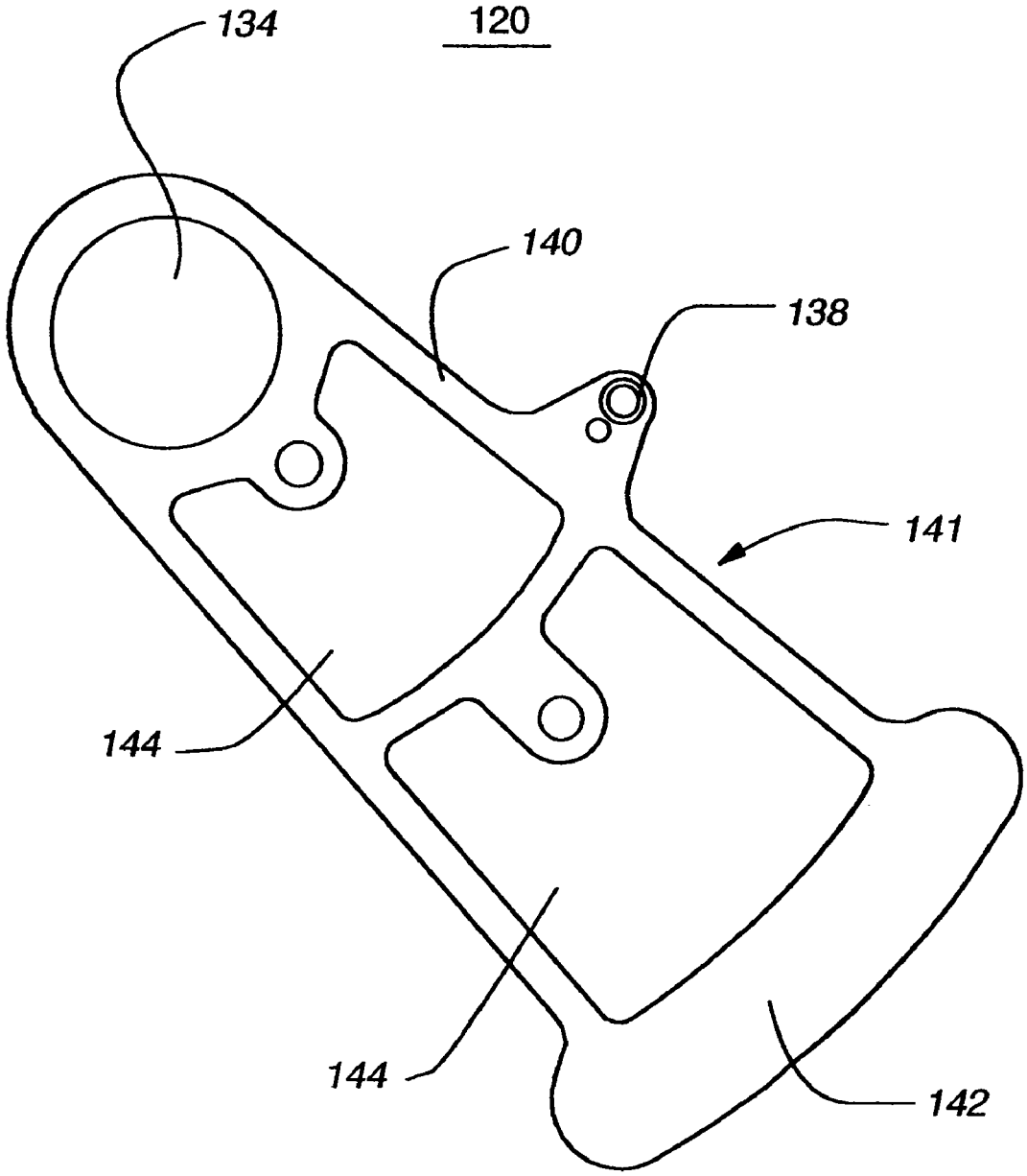
FIG. 11 is a side elevation of one-pound add-on weight.
Figure 12:
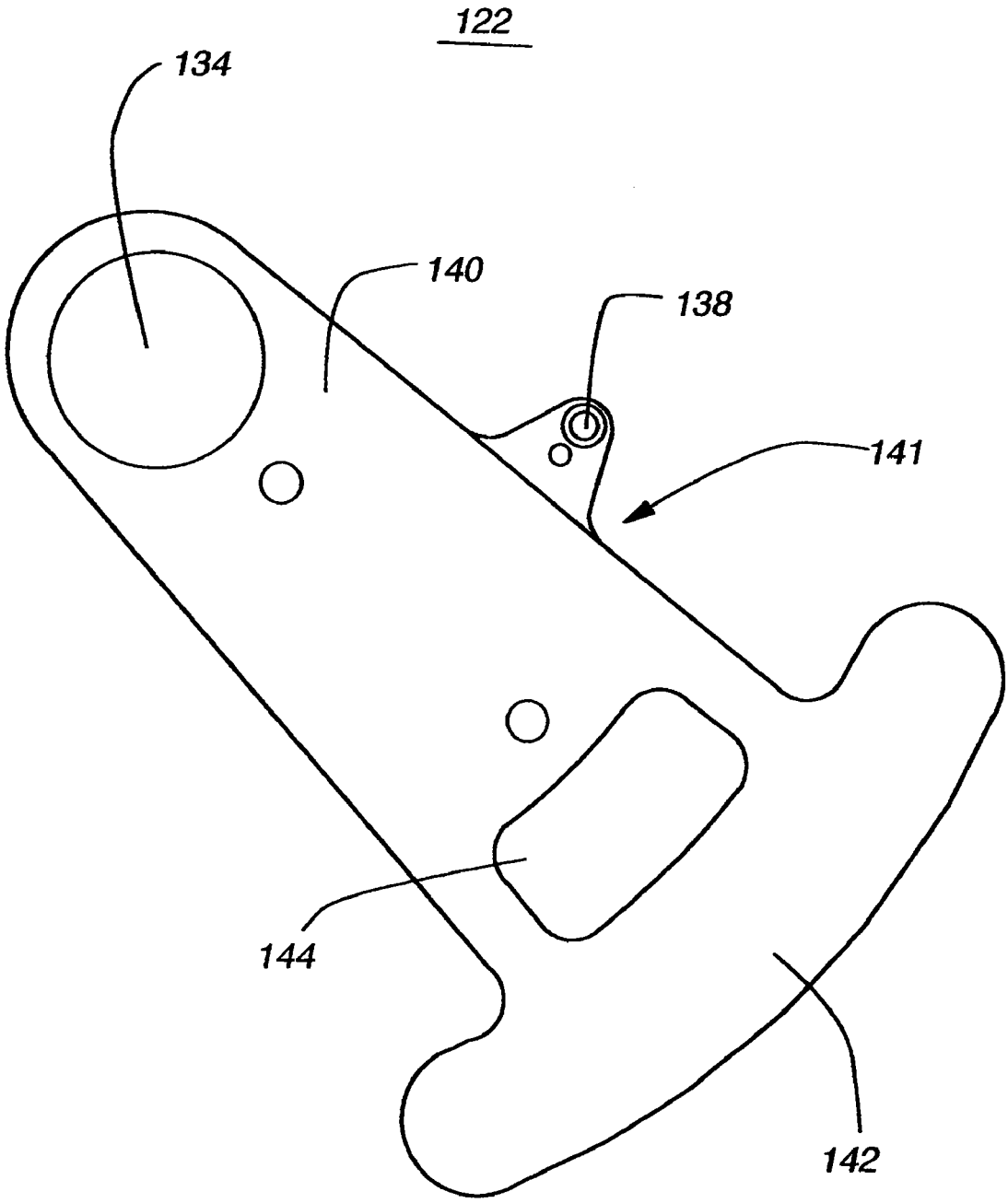
FIG. 12 is a side elevation of a two-pound add-on weight.
Figure 13:
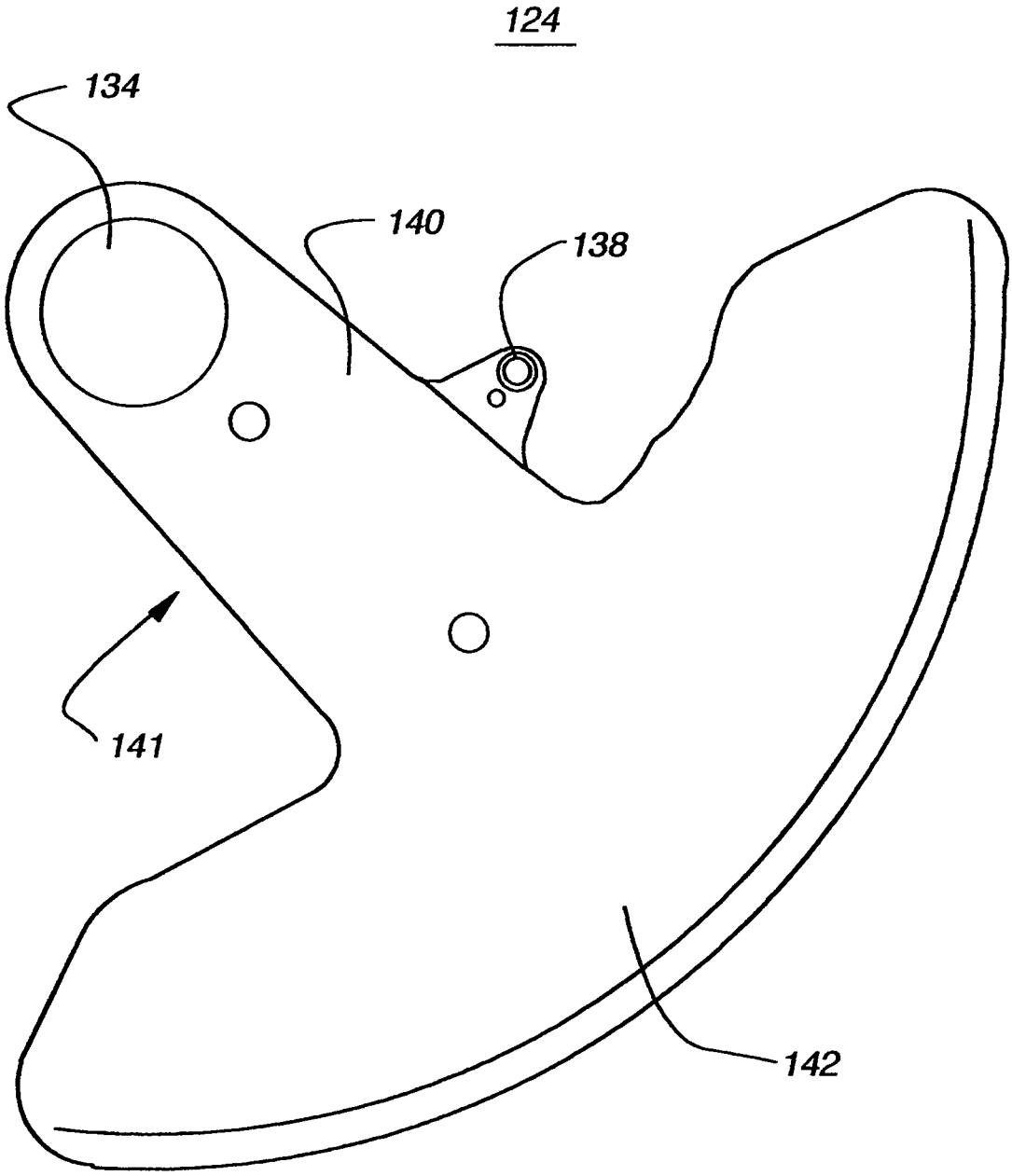
FIG. 13 is a side elevation of a five-pound add-on weight.
Figure 14:
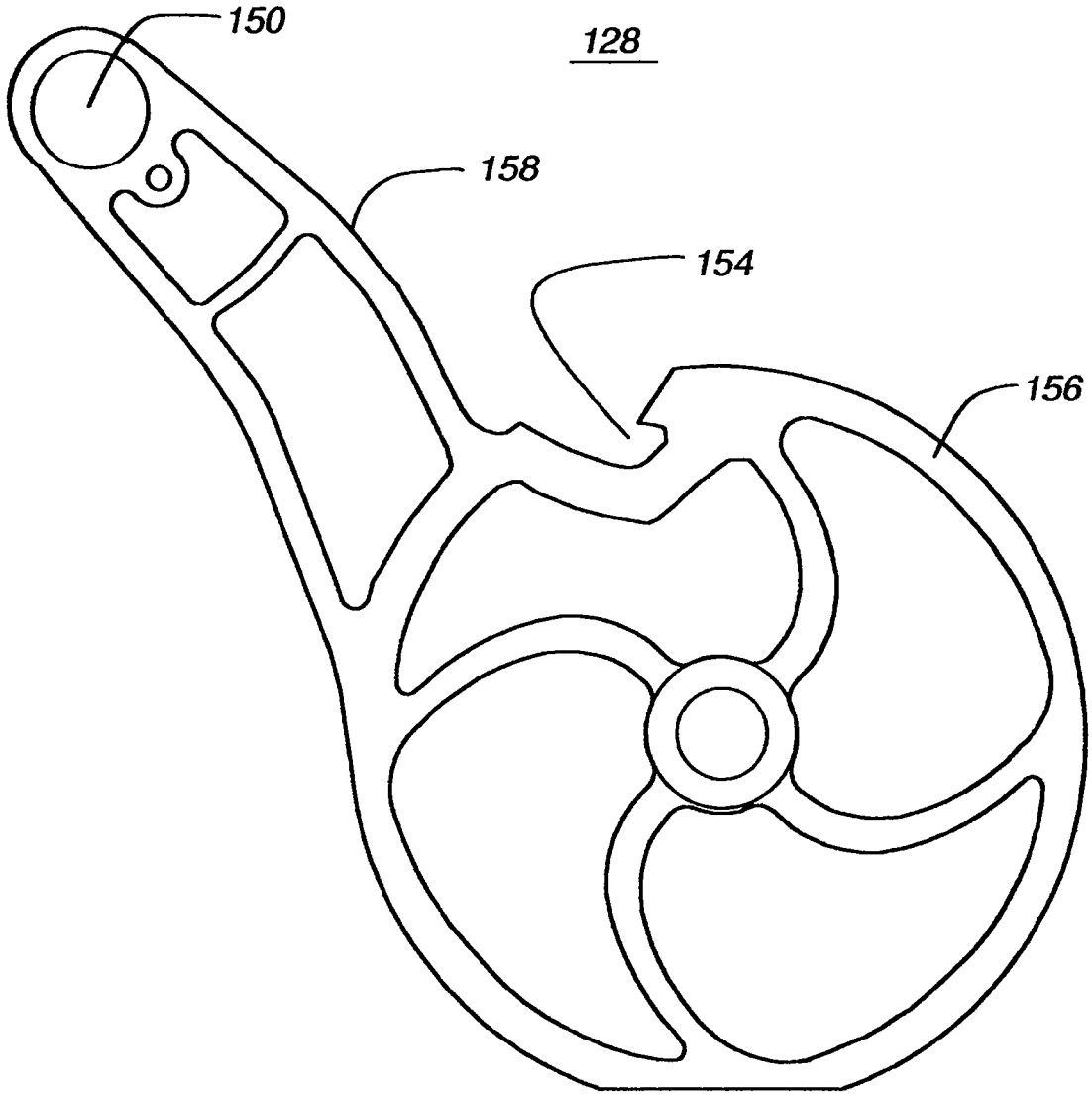
FIG. 14 is a side elevation of a ten-pound primary weight.
Figure 15:
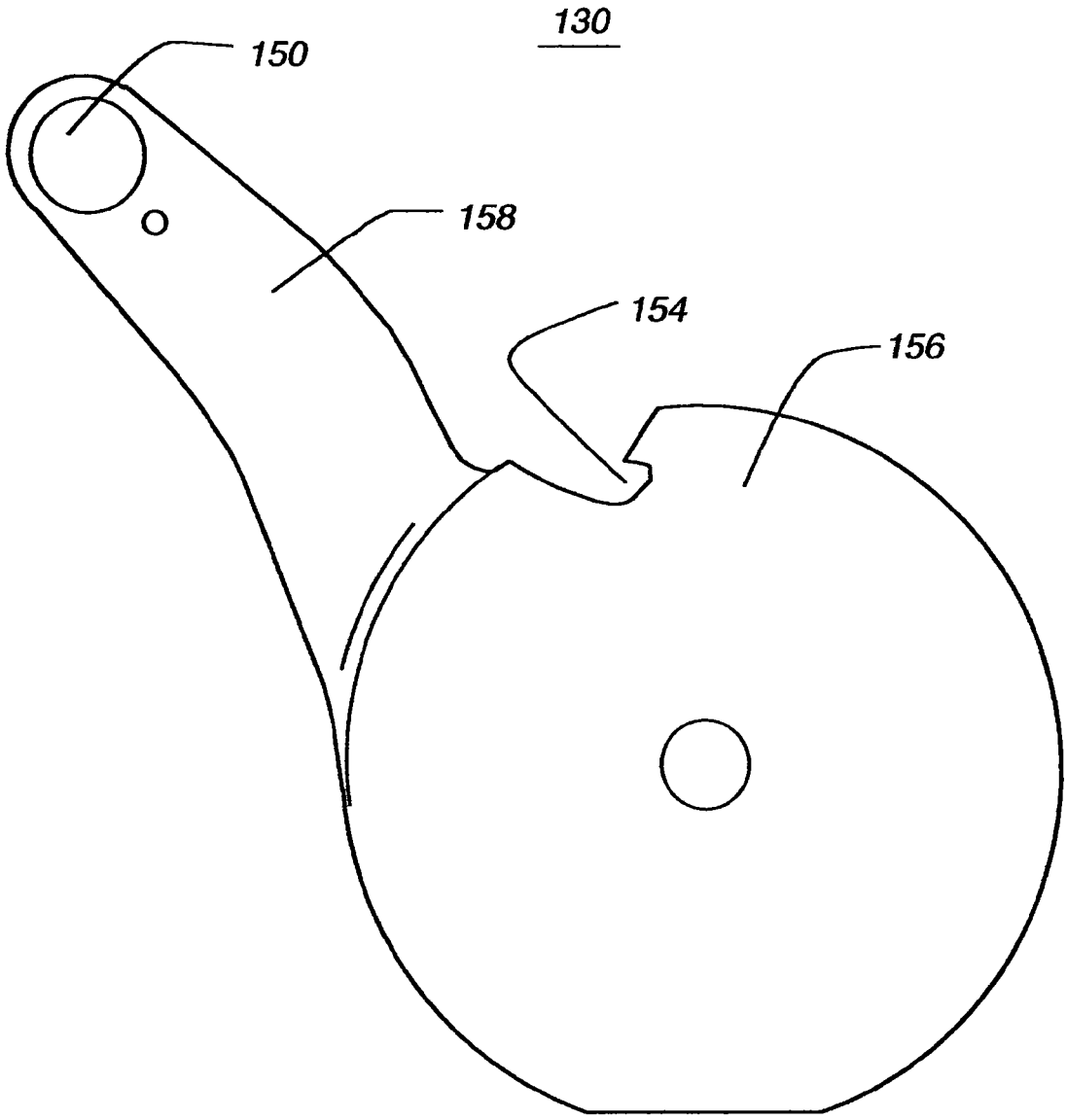
FIG. 15 is a side elevation of a fifty-pound primary weight.
Figure 16:
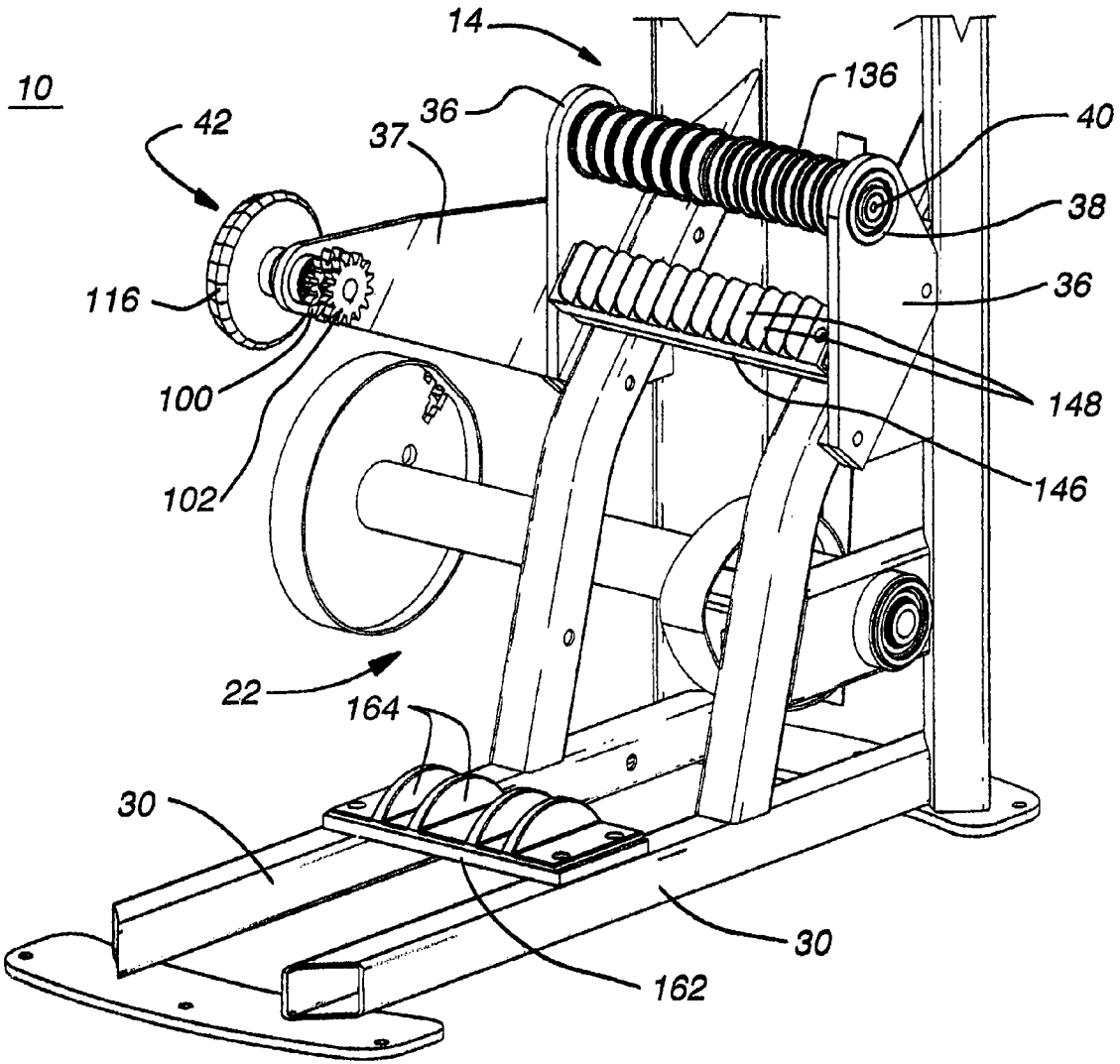
FIG. 16 is an isometric view of the weight exercise machine as viewed from the front/non-user side and wherein the weight arm assembly and weights have been removed for clarity purposes.
Figure 17:
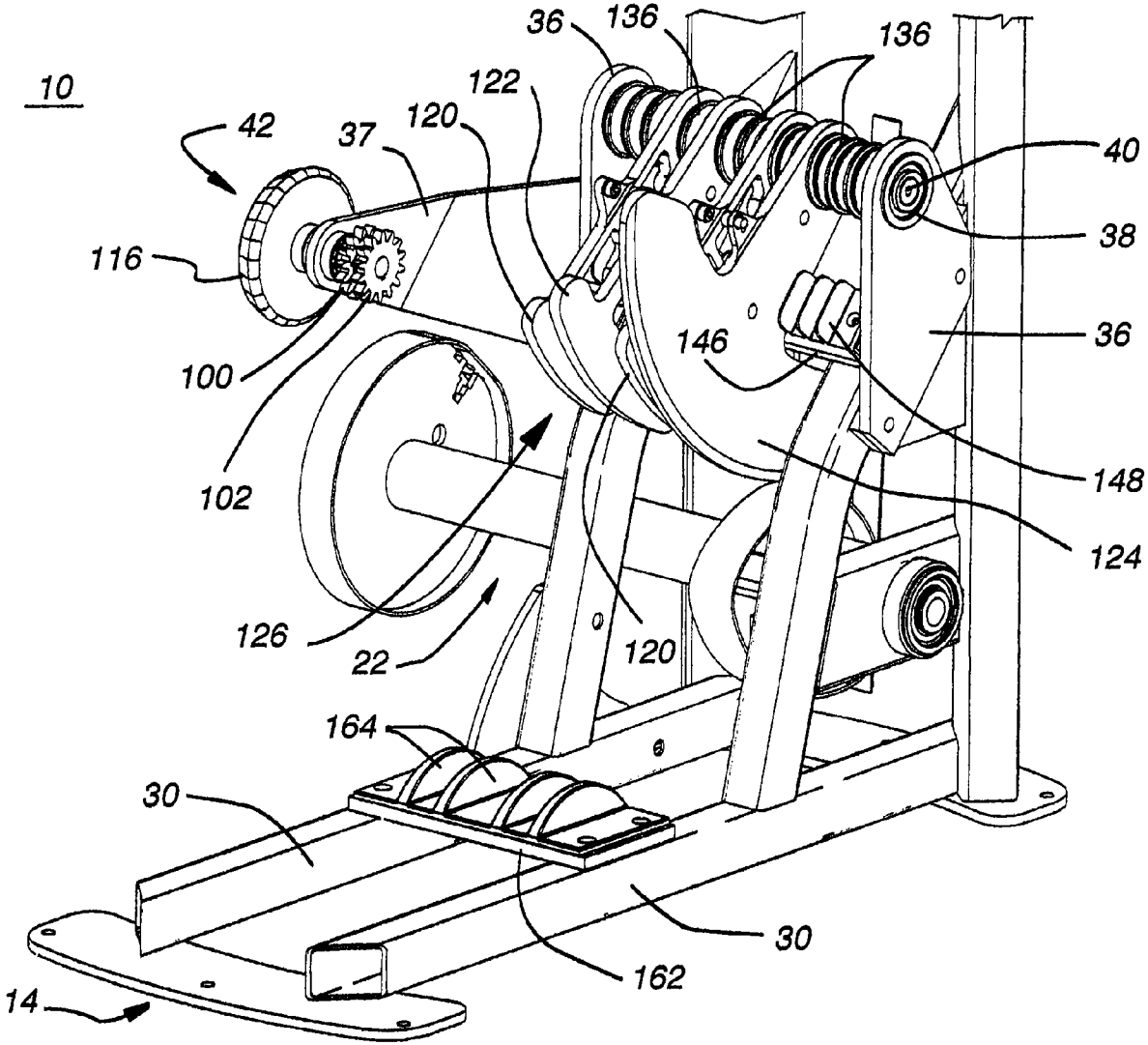
FIG. 17 is the same view depicted in FIG. 16, except the add-on weights are shown pivotally mounted to the base frame.
Figure 18:
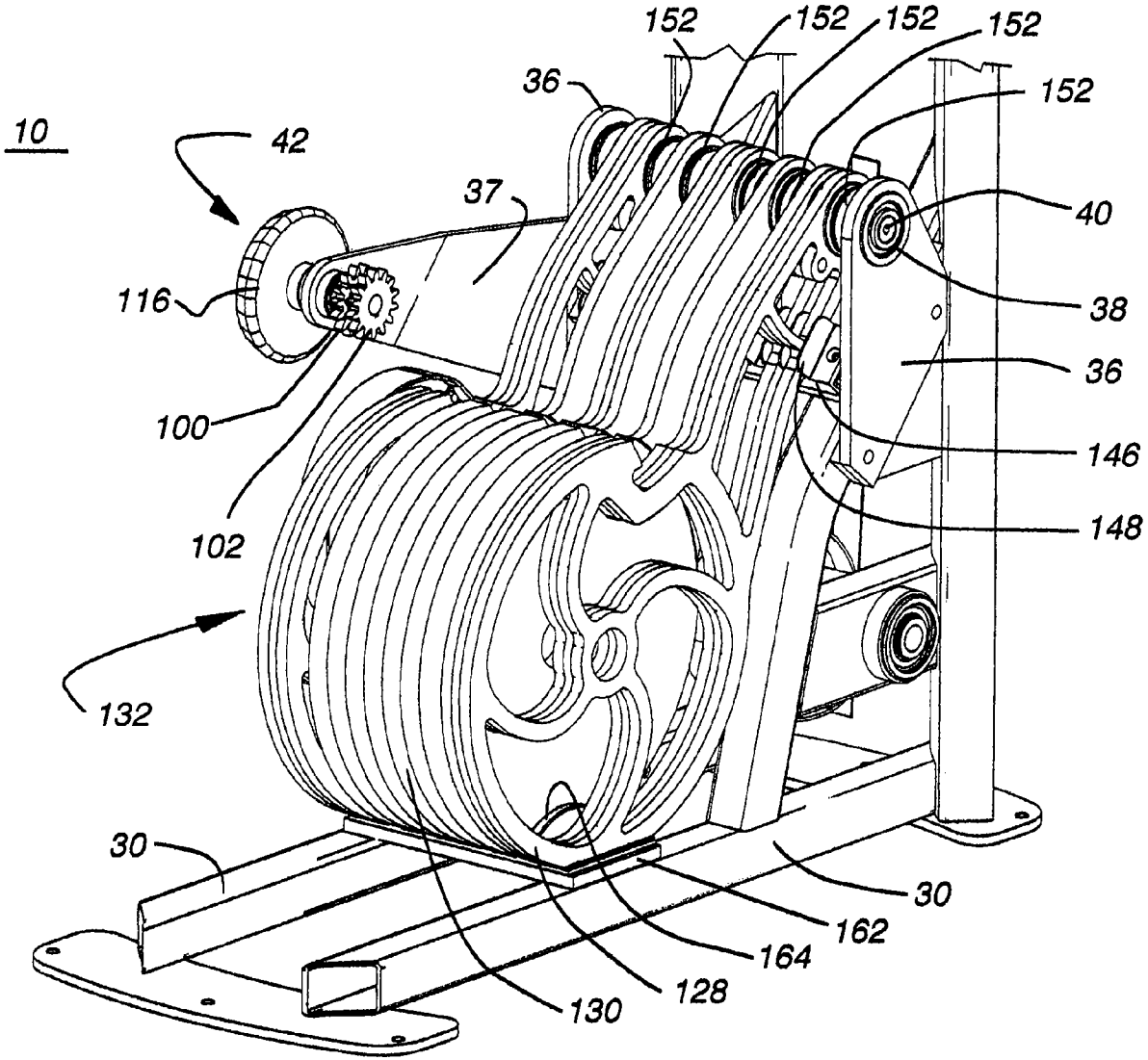
FIG. 18 is the same view depicted in FIG. 16, except the primary weights are shown pivotally mounted to the base frame.
Figure 19:
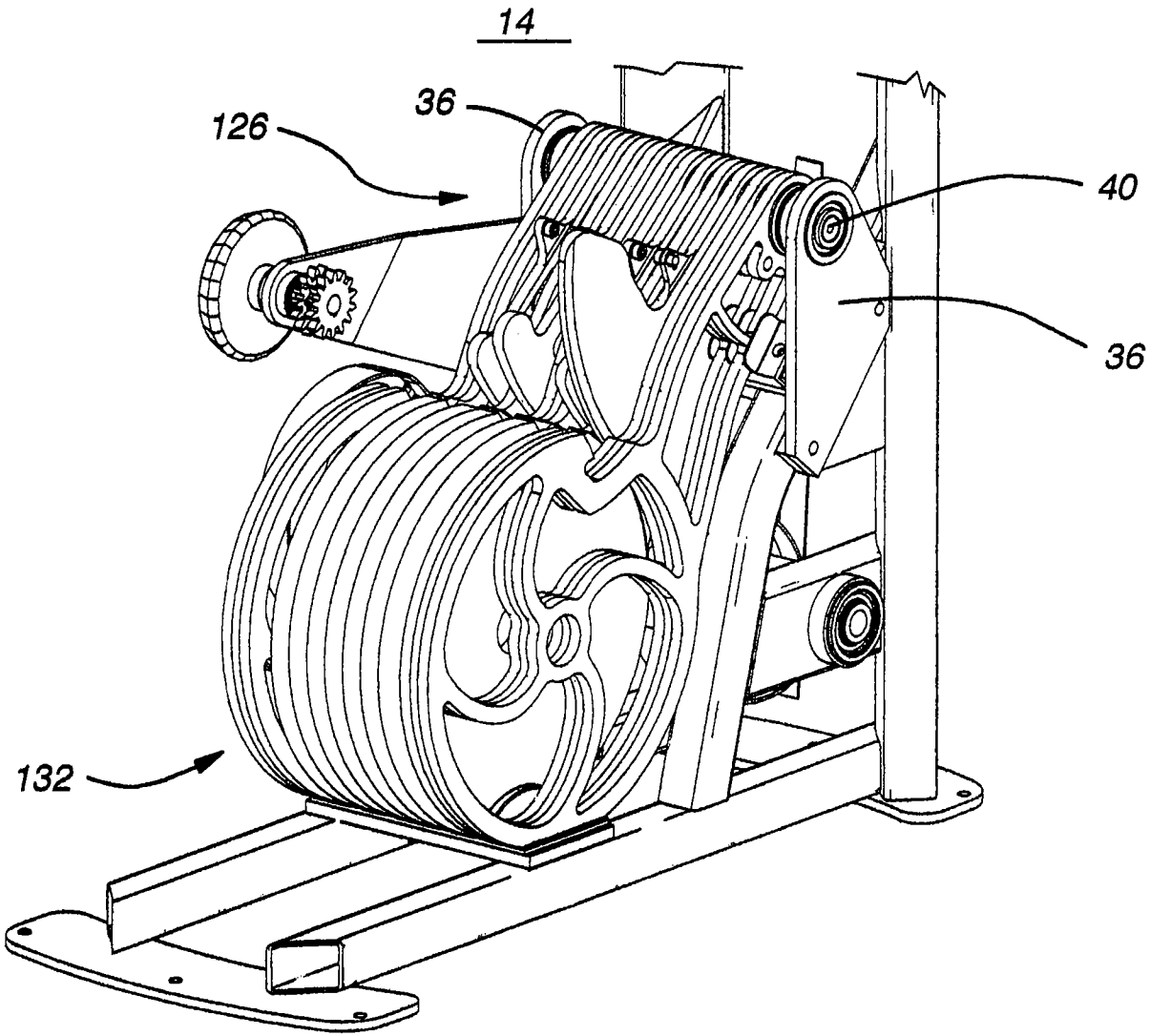
FIG. 19 is the same view depicted in FIG. 16, except both the add-on and primary weights are shown pivotally mounted to the base frame.
Figure 20:
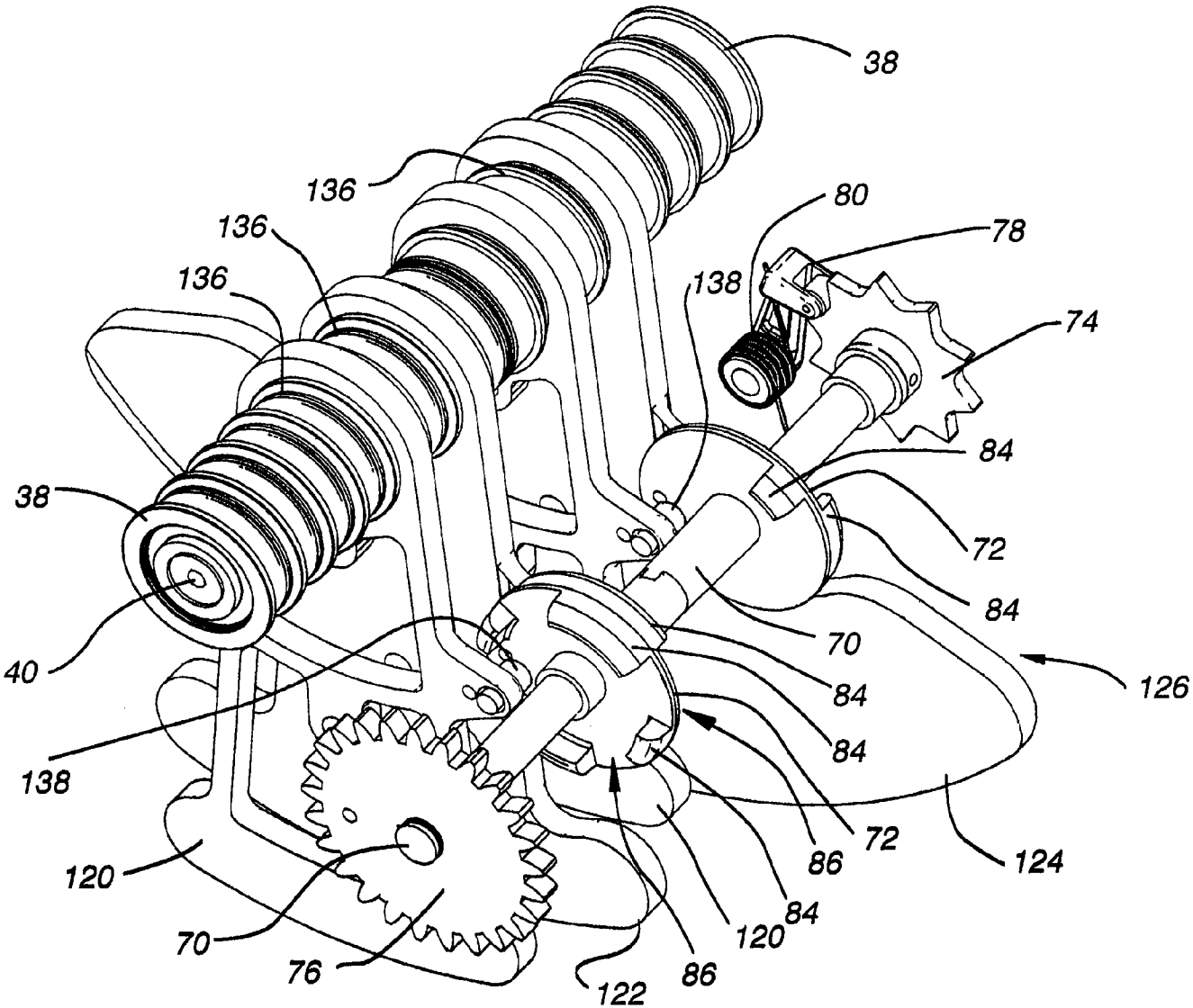
FIG. 20 is an isometric view of the add-on weights being engaged by the discs of the add-on weight engagement axle.
Figure 21:
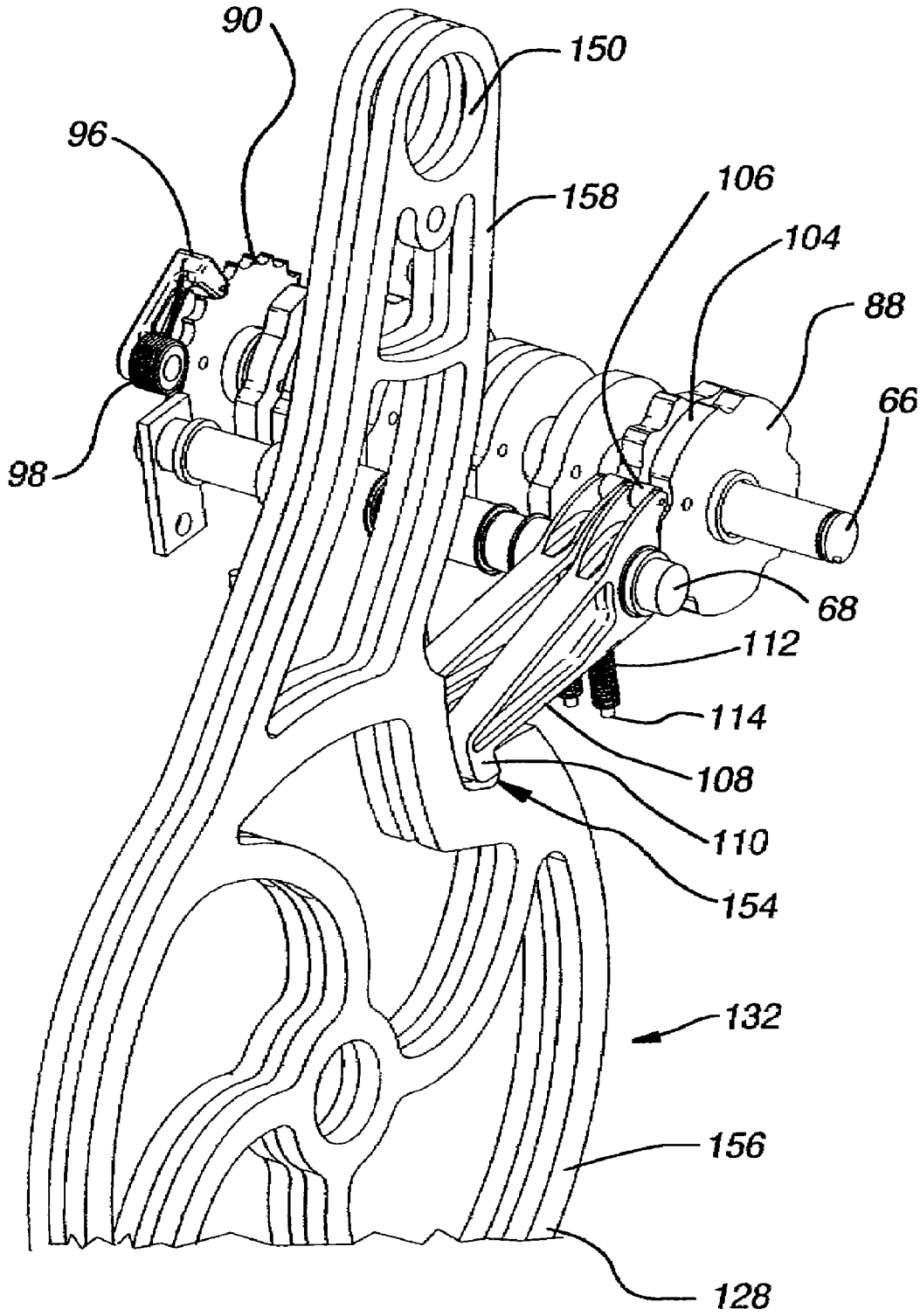
FIG. 21 is an isometric view the primary weights being engaged by the hooks of the hook axle when actuated by a surface of a cam of the primary weight engagement axle.

For an understanding of the configurations of the two types of weights 16, the way they are pivotally coupled to the base frame 14, and the way they are engaged to displace with the weight arm assembly 18, reference is made to FIGS. 11-21. FIGS. 11-13 are side elevations of one-pound 120, two-pound 122 and five-pound 124 add-on weights 126, respectively. FIGS. 14 and 15 are side elevations of ten-pound 128 and fifty-pound 130 primary weights 132, respectively. FIG. 16 is an isometric view of the weight exercise machine 10 as viewed from the front/non-user side and wherein the weight arm assembly 18 and weights 16 have been removed for clarity purposes. FIG. 17 is the same view depicted in FIG. 16, except the add-on weights 126 are shown pivotally mounted to the base frame 14. FIG. 18 is the same view depicted in FIG. 16, except the primary weights 132 are shown pivotally mounted to the base frame 14. FIG. 19 is the same view depicted in FIG. 16, except both the add-on and primary weights 126, 132 are shown pivotally mounted to the base frame 14. FIGS. 20 and 21 are, respectively, isometric views of the add-on weights 126 being engaged by the discs 72 of the add-on weight engagement axle 70 and the primary weights 130 being engaged by the hooks 108 of the hook axle 68 when actuate by the a surface 104 of a cam 88 of the primary weight engagement axle 66.

As shown in FIGS. 11-13, 16, 17 and 20, each add-on weight 120, 122, 124 includes a pivot hole 134 for receiving a bushing/bearing 136 and thereby being pivotally mounted on the axle 40 that extends between the pivot support plates 36 of the base frame 14. Each add-on weight 120, 122, 124 also includes a roller or cam follower 138 that protrudes from a side face 140 of each add-on weight 120, 122, 124 to be engaged by the arcuate rim segment 84 of a weight engagement disc 72, as discussed with respect to FIG. 9 and shown in FIG. 20. It is to be appreciated that the roller or cam follower 138 can have various different configurations, such as a bolt connected with or a boss formed integrally with the add-on weight. Each add-on weight 120, 122, 124 is a plate having generally the same pendulum type configuration with a neck portion 141 and a pendulum portion 142, except the pendulum portion 142 of each add-on weight 120, 122, 124 is smallest on the one-pound add-on weight 120 and largest on the five-pound add-on weight 124. The one-pound add-on weight 120 has two cutout areas 144, and the two-pound add-on weight 122 has a single small cutout area 144. While one, two and five-pound weights 120, 122, 124 are discussed, it should be understood that any size and combination of weights may be employed. For example, in one embodiment, the add-on weights 126 are half-pound, one-pound, two and one-half pound, and five-pound weights.

One of the advantages of the present invention is that a wide variety of plate sizes may be employed in one weight exercise machine 10. Also, the present invention allows plates sizes to be used with the weight exercise machine 10 that are substantially smaller than plate sizes used on weight exercise machines known in the art. As a result, the weight exercise machine 10 of the present invention allows incremental changes in resistive force that are substantially smaller and more greatly adaptable to a user's exercise training regime than the incremental changes in resistive force offered by weight exercise machines known in the art.

As shown in FIG. 16, the base frame 14 includes a cross-member 146 that extends side-to-side between the upper portions of the diagonal members 32. A series of parallel ridges form slots 148, which, as indicated in FIG. 17, receive the add-on weights 126 when not being raised by the weight arm 18.

As shown in FIGS. 14, 15, 18 and 21, each primary weight 128, 130 includes a pivot hole 150 for receiving a bushing/bearing 152 and thereby being pivotally mounted on the axle 40 that extends between the pivot support plates 36 of the base frame 14. Each primary weight 128, 130 also includes a slot 154 that is defined in the outer circumferential edge of a circular plate portion 156 of each primary weight 128, 130 to be engaged by the tip 110 of a hook 108, as discussed with respect to FIG. 10 and depicted in FIG. 21. Each primary weight 128, 130 is a plate having an arm portion 158 radiating away from the outer circumferential edge of the circular plate portion 156. The fifty-pound primary weight 130 is generally the same as the ten-pound primary weight 128, except the fifty-pound primary weight 130 is thicker than the ten-pound primary weight 128, as indicated in FIG. 18, and the ten-pound primary weight 128 has six cut-out areas 160 (two in the arm portion 158 and four in the circular plate portion 156). While one, ten and fifty-pound weights 128, 130 are discussed, it should be understood that any size and combination of weights may be employed. For example, in one embodiment, the primary weights 126 are ten-pound, twenty-five-pound, and fifty-pound weights.

As shown in FIG. 17, the base frame 14 includes a cross-member 162 that extends side-to-side between the middle portions of the horizontal members 30. A series of parallel ridges form slots 164, which, as indicated in FIG. 18, receive the primary weights 132 when not being raised by the weight arm 18. Also, as shown in FIG. 18, the slots 148 formed by the series of ridges on the cross-member 146 receive the primary weights 132 when not being raised by the weight arm 18. When both the add-on and primary weights 126, 132 are not being raised by the weight arm 18, they rest in the slots 148, 164 as indicated in FIG. 19.

For a discussion of the operation of the weight exercise machine 10 of the present invention, reference is made to FIGS. 1-21. A user desiring to exercise on the weight exercise machine 10 of the present invention positions his self in the workstation 12. The user determines that for his first exercise set at the machine 10 the level of resistance will be, for example, 67 pounds. The user dials the primary weight wheel 116 such that it indicates 60 pounds on the primary indicator disc 95. This action, via the gears 92, 100 causes the primary weight engagement axle 66 to rotate and bring the surfaces 104 of the appropriate cams 88 into displacing contact with the cam followers 106 of hooks 108 corresponding to an indexed/selected ten-pound primary weight 128 and an indexed/selected fifty-pound primary weight 130. The displacing contact between the cam surfaces 104 and the cam followers 106 cause the corresponding hooks 108 to pivot about the hook axle 68 such that the tips 110 of the corresponding hooks 108 engage with the slots 154 of the corresponding indexed/selected ten-pound and fifty pound primary weights 128, 130. As a result, the hooks 108 corresponding to the indexed/selected ten and fifty-pound primary weights 128, 130 are coupled to said primary weights 128, 130. Thus, when the weight arm assembly 18 pivots upwardly, as shown in FIGS. 7 and 8, the coupled (i.e., indexed/selected) primary weights 128, 130 pivot upwardly with the weight arm assembly 18 while the remaining non-coupled (i.e., non-indexed/non-selected) primary weights 132 do not pivot upwardly because their slots 154 were not engaged by their corresponding hooks 108.

As the user dials the primary weight wheel 116 to achieve the described engagement, the ratchet arm 96 acts against the index sprocket 90 to assist in proper alignment of the primary weight indexing mechanism and to provide the user with a sensation that indicates when the primary indexing mechanism transitions from one index setting to another.

Upon setting the primary weight indexing mechanism as described, the user dials the add-on weight wheel 118 such that it indicates seven pounds on the add-on weight indicator disc 83. This action, via the gears 102, 94, 82, 76, causes the add-on weight engagement axle 70 to rotate such that the appropriate arcuate rim segments 84 of the discs 72 rotate into position to prevent the cam followers 138 corresponding to an indexed/selected two-pound add-on weight 122 and an indexed/selected five-pound add-on weight 124 from exiting their corresponding discs 72 via a gap 86 defined between the arcuate rim segments 84 of the discs 72. As a result, the discs 72 corresponding to the indexed/selected two and five-pound add-on weights 122, 124 are coupled to said add-on weights 122, 124. Thus, when the weight arm assembly 18 pivots upwardly, as shown in FIGS. 7 and 8, the coupled (i.e., indexed/selected) add-on weights 122, 124 pivot upwardly with the weight arm assembly 18 while the remaining non-coupled (i.e., non-indexed/non-selected) add-on weights 126 do not pivot upwardly because their cam followers 138 pass through the gaps 86 in their corresponding discs 72.

As the user dials the add-on weight wheel 118 to achieve the described engagement, the ratchet arm 78 acts against the index sprocket 74 to assist in proper alignment of the add-on weight indexing mechanism and to provide the user with a sensation that indicates when the add-on indexing mechanism transitions from one index setting to another.

The above-provided example has the primary indexing mechanism being set first and the add-on indexing mechanism being set second. However, it should be understood that the order can be reversed such that the add-on indexing mechanism is set first and the primary indexing mechanism is set second. Also, the indexing mechanisms can be set at the same time if a user uses two hands to manipulate the two index wheels 116, 118.

As can be understood from FIGS. 1, 7 and 8, once the add-on and primary indexing mechanisms are appropriately indexed to provide a weight resistance of 67 pounds, the user performs the positive portion of the first repetition of his first set of the exercise movement by exerting an exercise force against the exercise member 24 to cause the exercise member to displace away from the exercise member pulley 54, which causes the force transfer mechanism 22 to rotate as previously described. The rotation of the force transfer mechanism 22 causes the weight arm assembly 18 to pivot upwardly relative to the base frame 14, as can be understood from FIGS. 7 and 8. As the weight arm assembly 18 pivots upwardly, the coupled (i.e., indexed/selected) weights 16" (shown in phantom lines in FIG. 8) pivot upwardly relative to the base frame 14 with the weight arm assembly 18. However, the non-coupled (i.e., non-indexed/non-selected) weights 16" (shown in phantom lines in FIG. 8) do not pivot upwardly with the weight arm assembly 18. On the negative portion of the first repetition, the user allows the exercise member 24 to displace back towards the exercise member pulley 54, which allows the force transfer mechanism to reverse rotation. The reverse rotation allows the weight arm assembly 18 to return to the downward position, as illustrated in FIG. 7, with the coupled (i.e., indexed/selected) weights 16 (shown in phantom lines in FIG. 7) returning to the downward position to rest with the non-coupled (i.e., non-indexed/non-selected) weights 16.

Once the user has finished the appropriate number of repetitions for the 67 pound set, the user can select/index another combination of weights 16 to provide for an increased or decreased weight resistance for another exercise set on the machine 10.

c. Second Embodiment of the Weight Exercise Machine

Figure 22:
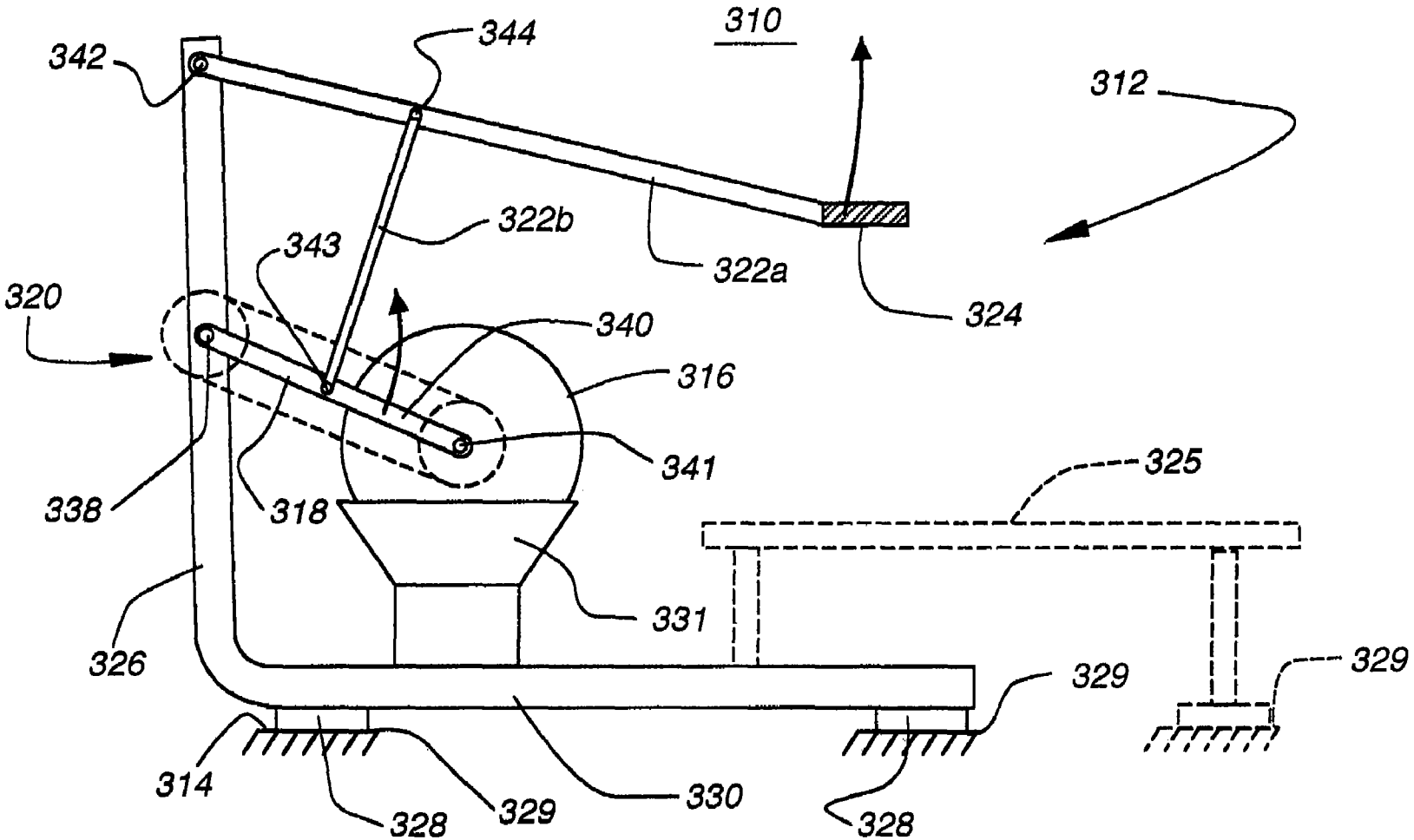
FIG. 22, which is a diagrammatical side elevation of the weight exercise machine.

For a discussion of the second embodiment of the weight exercise machine 310 of the present invention, reference is made to FIG. 22, which is a diagrammatical side elevation of the weight exercise machine 310. As shown in FIG. 22, the weight exercise machine 310 has a workstation 312, a base frame 314, weights 316, a weight arm assembly 318, a weight index mechanism 320, and a force transfer mechanism 322.

The workstation 312 includes an exercise member 324 and a user support platform 325 (e.g., a bench, seat, etc.) for supporting the user when utilizing the machine 310 to exercise. The user engages and displaces the exercise member 324 to exercise with the machine 310. For example, where the machine 310 is an embodiment intended to exercise portions of the upper body (e.g., shoulders, chest, back, arms, traps, etc.), the exercise member 324 will be configured for engagement by the user's hands and/or arms. Where the machine 310 is an embodiment intended to exercise portions of the mid and lower torso (e.g., abdominals, lower back, etc.) the exercise member 324 will be configured for engagement by the user's hands, arms, and/or upper torso. Where the machine 310 is an embodiment intended to exercise portions of the lower body (e.g., upper and lower legs, glutes, etc.), the exercise member 324 will be configured for engagement by the user's legs, feet or shoulders. Where the machine 310 is an embodiment intended to exercise the neck, the exercise member 324 will be configured for engagement with the user's head.

As indicated in FIG. 22, the base frame 314 includes a vertical post 326, front and rear footplates 328, a horizontal member 330, and a weight support tray 331. The bottom end of the vertical post 326 joins the back end of the horizontal member 330. The front and rear foot plates 328 support the horizontal member 330 off of the floor 329. The weight support tray 331 is supported by the horizontal member 330 and receives the weights 316 when not being elevated via the weight arm assembly 318, as discussed later in this Detailed Description.

As illustrated in FIG. 22, the weight arm assembly 318 is pivotally coupled to the vertical post 326 via a pivot point 338 (e.g., axle, shaft, pin, etc.) extending horizontally through the vertical post 326. The weight arm assembly 318 includes a pair of arms 340 and a weight engagement axle or bar 341, which extends between the free ends of the arms 340. The arms 340 extend between the pivot point 338 and the weight engagement bar 341.

In one embodiment, as shown in FIG. 22, the force transfer mechanism 322 includes a pair of lever arms 322*a* and a pair of lift links 322*b*. In one embodiment, the lift links 322*b* are rigid link members, cables, ropes, chain, or etc. The free end of each lever arm 322*a* forms the exercise member 324 and the other end of each lever arm 322*a* is pivotally coupled to the top portion of the vertical post 326 via a pivot point 342 (e.g., axle, shaft, pin, etc.). The lift links 322*b* extend between, and are pivotally coupled to, the mid-portions of the arms 340, 322*a* via pivot points 343, 344 (e.g., axle, shaft, pin, etc.). In other embodiments, the force transfer mechanism is similar to that of the first embodiment of the weight exercise machine 10 described with respect to FIGS. 1-8.

As can be understood from FIG. 22 and as will be discussed more fully later in this Detailed Description, a user may displace one or more of the weights 316 when exercising with the machine 310 by exerting an exercise force upward against the exercise member 324, thereby causing the lever arms 322*a* to displace upwards. Because the lever arms 322*a* are coupled to the weight arm assembly 318, the weight arm assembly 318 displaces upward with any weights 316 that are indexed/selected such that they are coupled to the weight engagement bar 341. The number and type of weights 316 coupled to the engagement bar 341 may be varied via a weight indexing mechanism 320 that is part of the machine 10. As a result, the magnitude of the resistance provided by the weights 316 to the exercise member 324 may be varied via the weight indexing mechanism 320 in a manner similar to that already described with respect to the first embodiment of the weight exercise machine 10 discussed in reference to FIGS. 1-21.

Generally speaking, the weight indexing mechanism 320 of the second embodiment of the weight machine 310 depicted in FIG. 22 and the following figures is similar to that disclosed in U.S. patent application Ser. No. 10/456,977, which was filed Jun. 5, 2003, published as U.S. Publication No. US 2004/0005968A1, and entitled "Adjustable Dumbbell System." Also, the weight indexing mechanism of the second embodiment of the weight machine 310 depicted in FIG. 22 and the following figures is similar to that disclosed in U.S. patent application Ser. No. 10/127,049, which was filed Apr. 18, 2002, published as U.S. Publication No. US 2003/0199368A1, and entitled "Weight Selection Methods and Apparatus." Both the Ser. Nos. 10/456,977 and 10/127,049 applications are hereby incorporated herein by reference in their entirety as though fully set forth herein.

Figure 23:
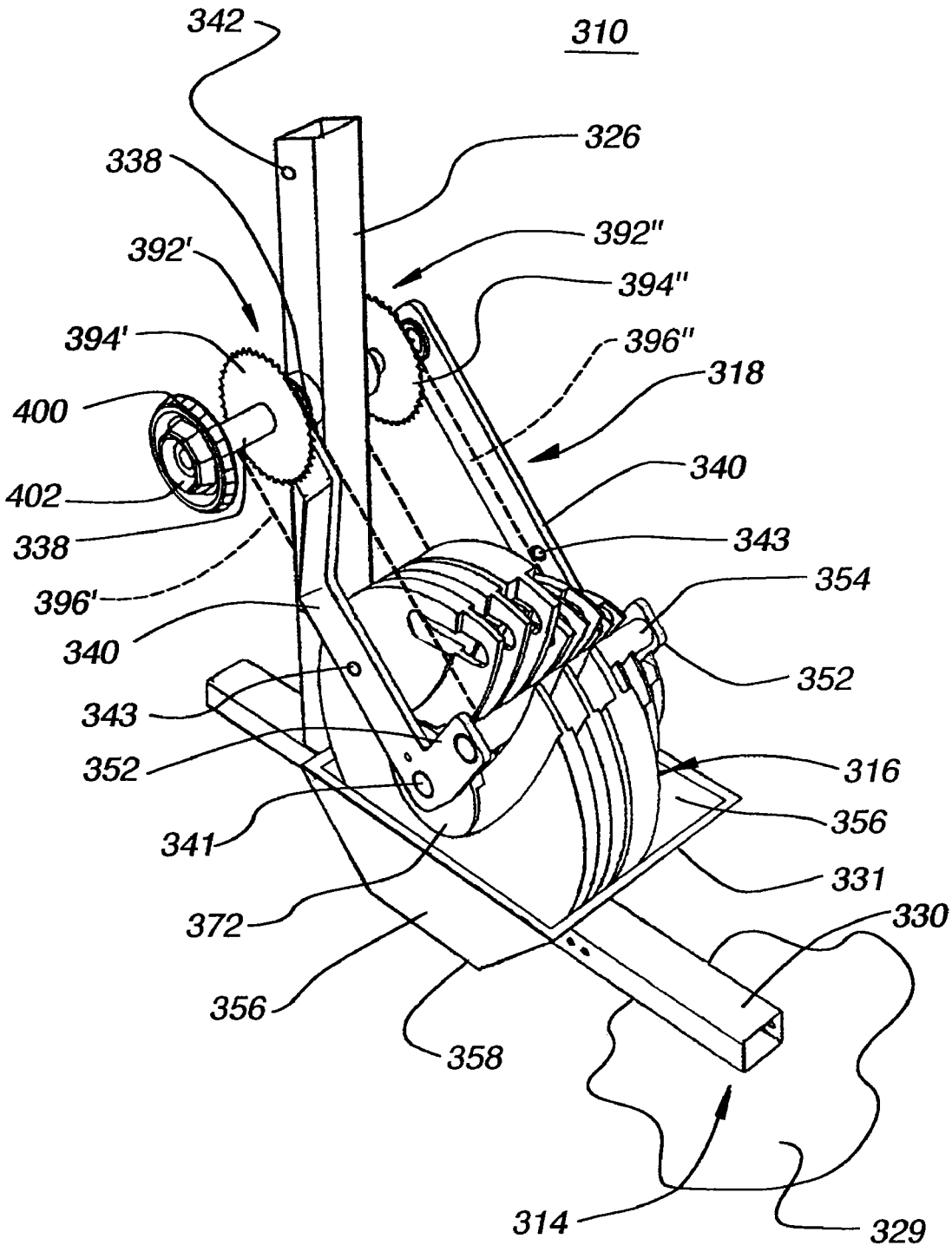
FIG. 23 is an isometric view of the machine illustrated in FIG. 22, except the force transfer mechanism is not shown for clarity purposes.
Figure 24:
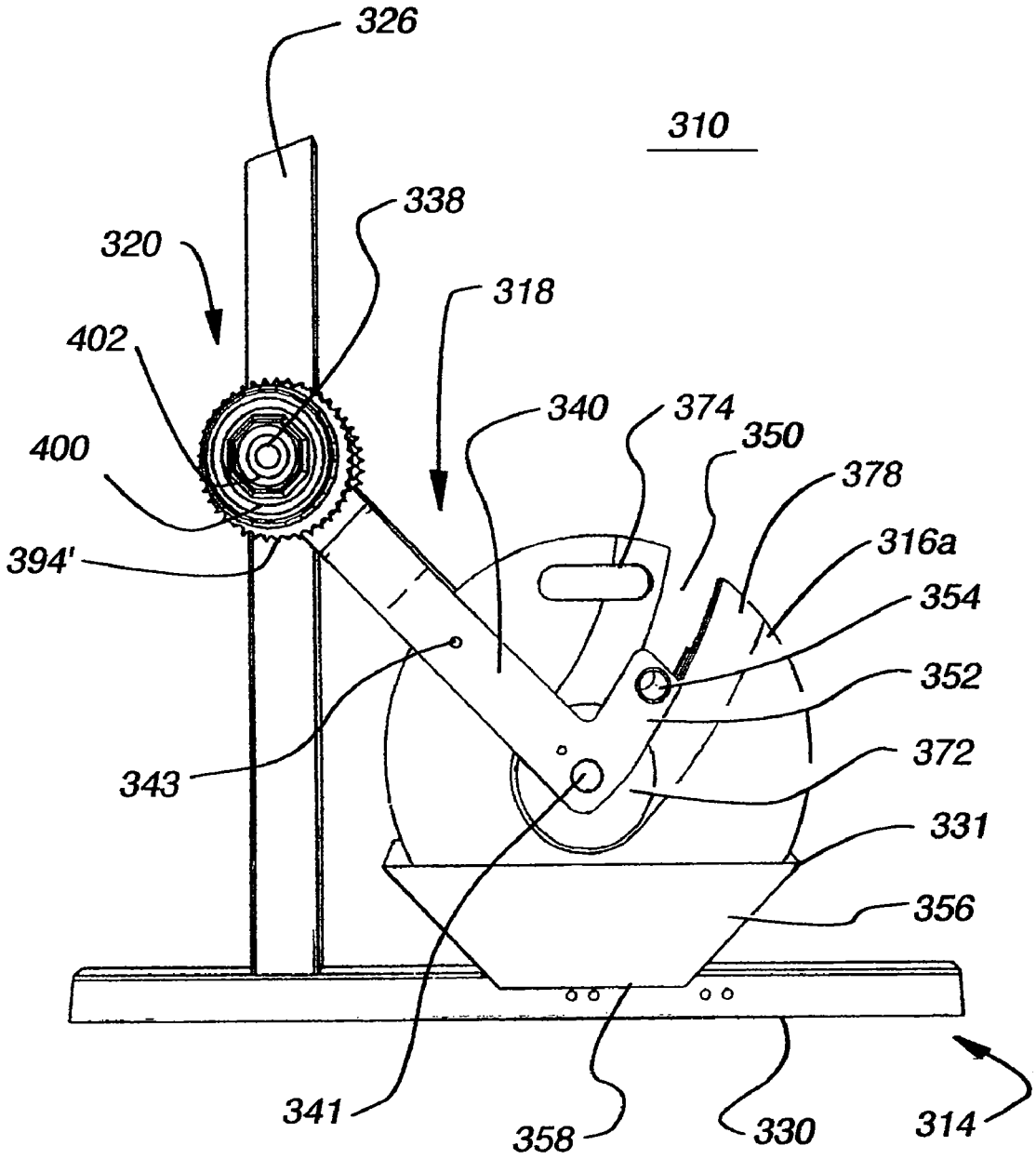
FIG. 24 is a side elevation of the machine as depicted in FIG. 23 and as viewed from the selection wheel side of the machine.
Figure 25:
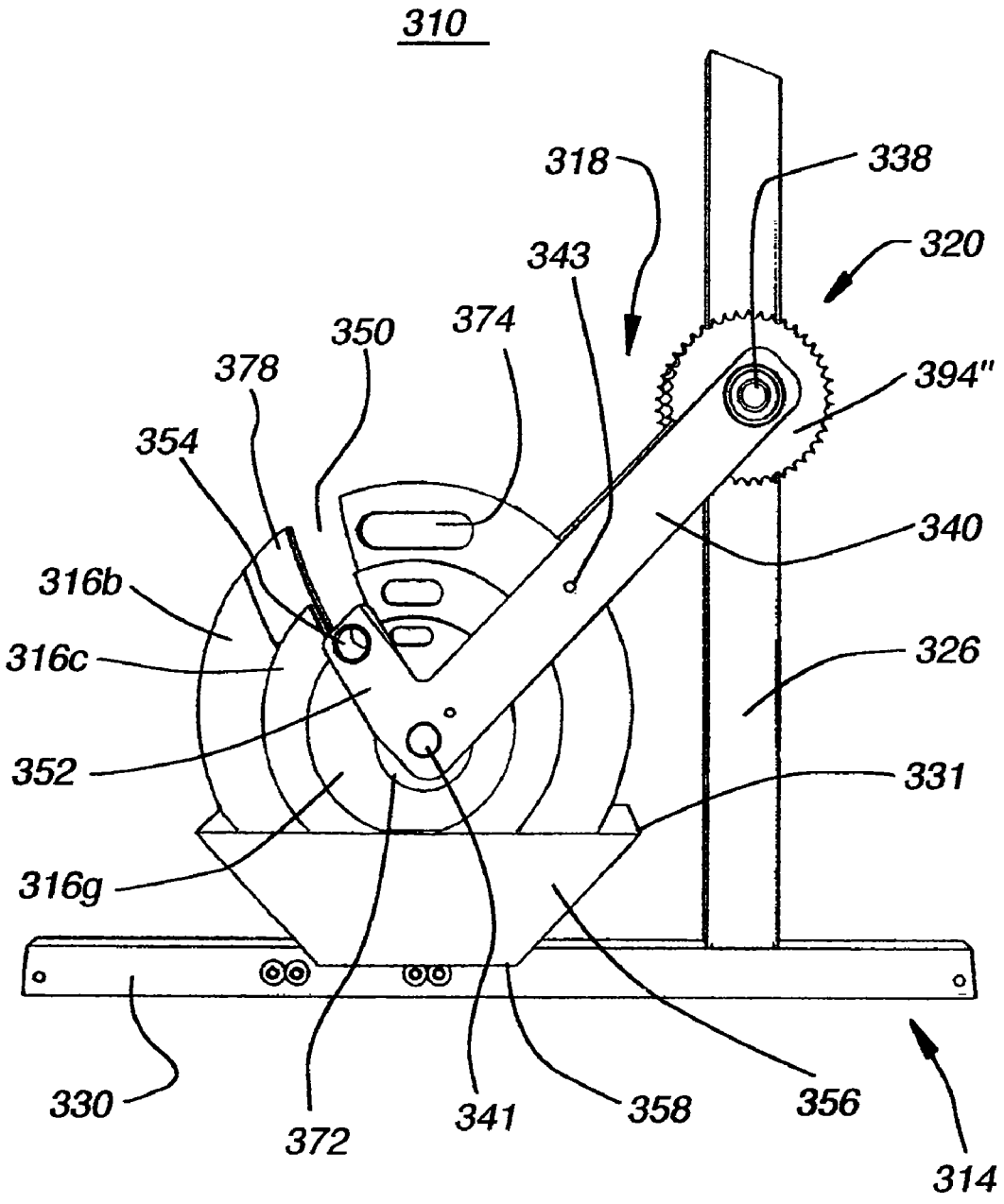
FIG. 25 is a side elevation of the machine as depicted in FIG. 23 and as viewed from the side opposite that of FIG. 24.
Figure 26:
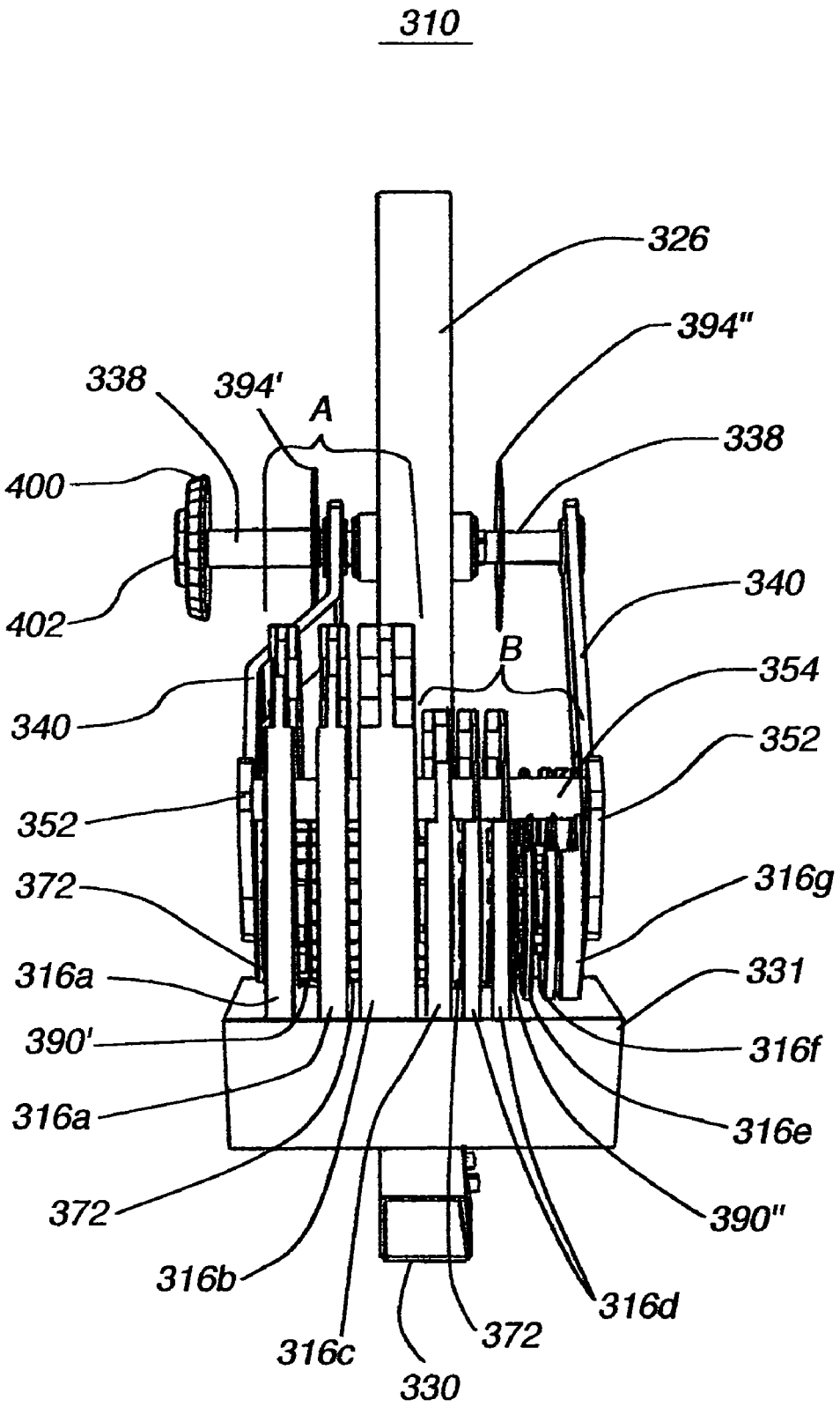
FIG. 26 is a front elevation of the machine as depicted in FIG. 23.
Figure 27:
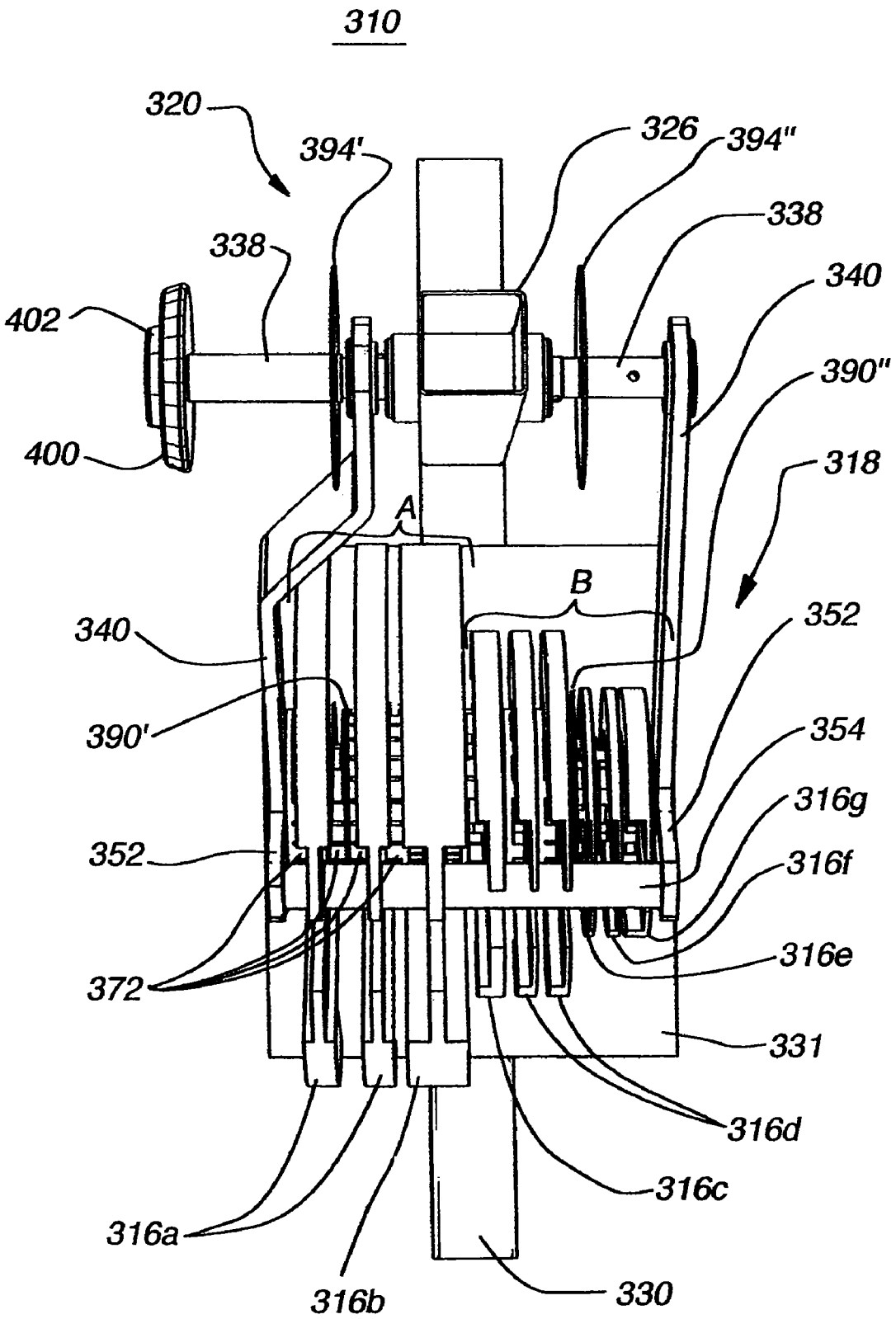
FIG. 27 is a top plan view of the machine as depicted in FIG. 23.
Figure 28:
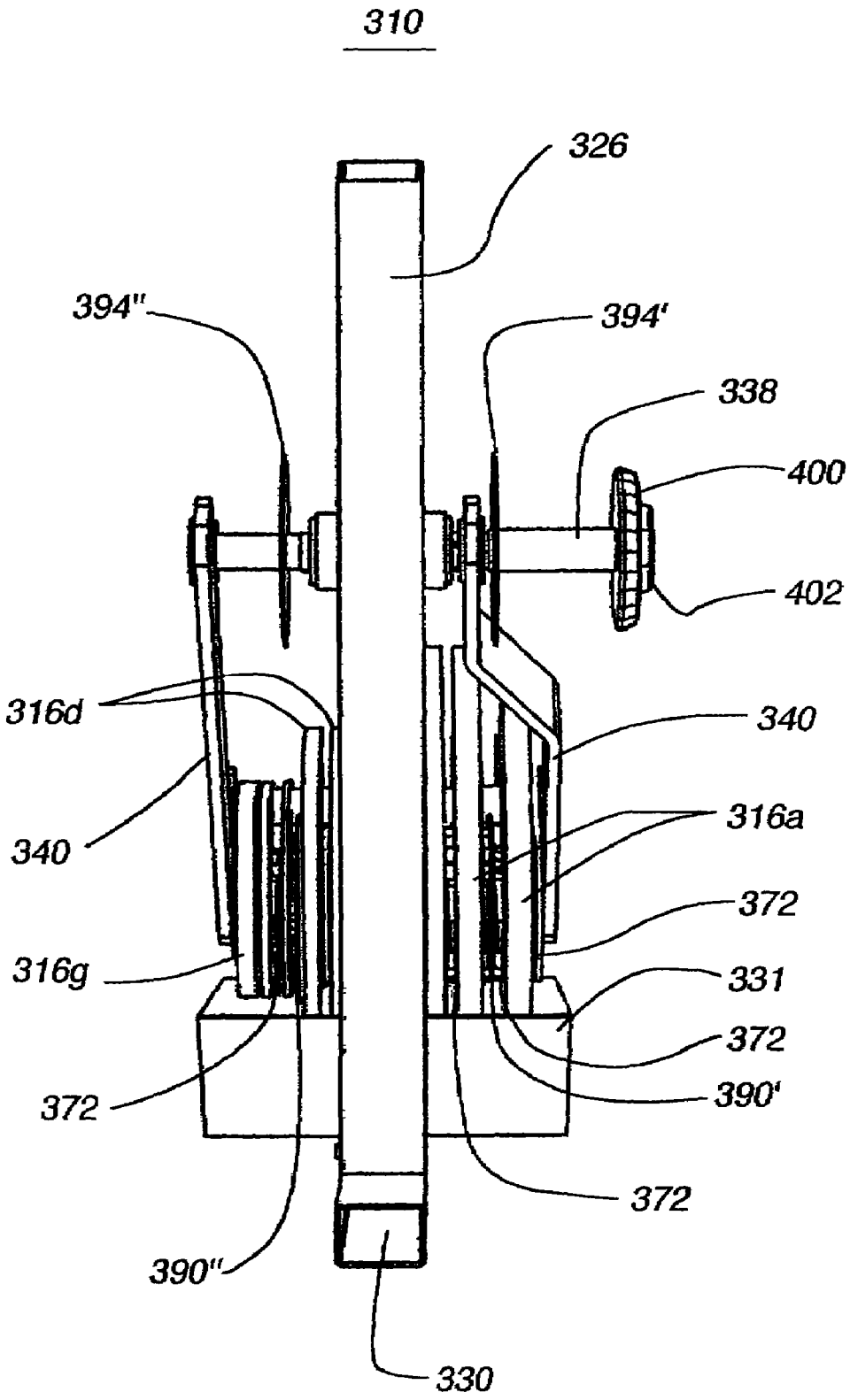
FIG. 28 is a rear elevation of the machine as depicted in FIG. 23.
Figure 29:
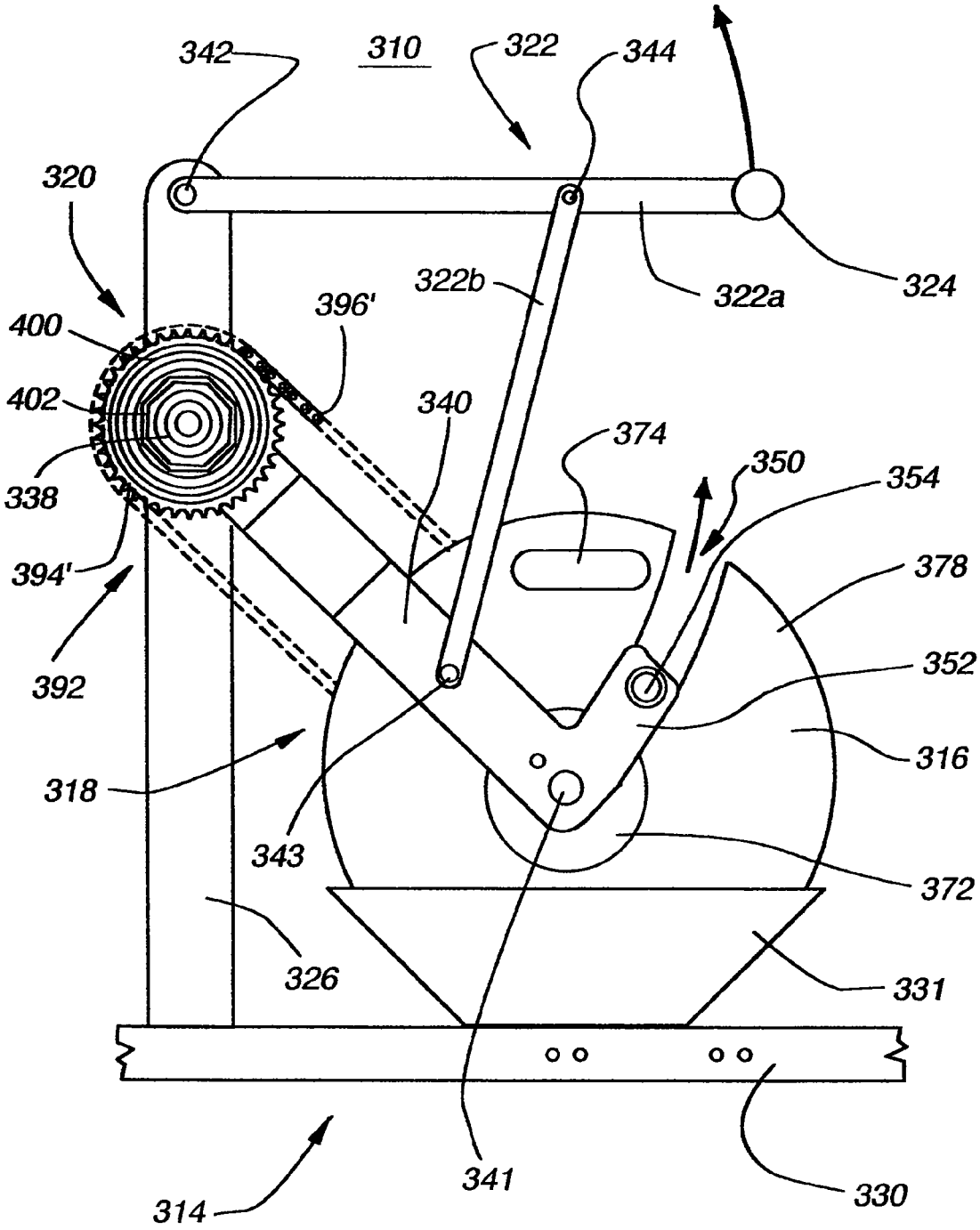
FIG. 29 is side elevation of the machine with the force transfer mechanism shown, wherein the weight arm assembly is in its fully downward position.
Figure 30:
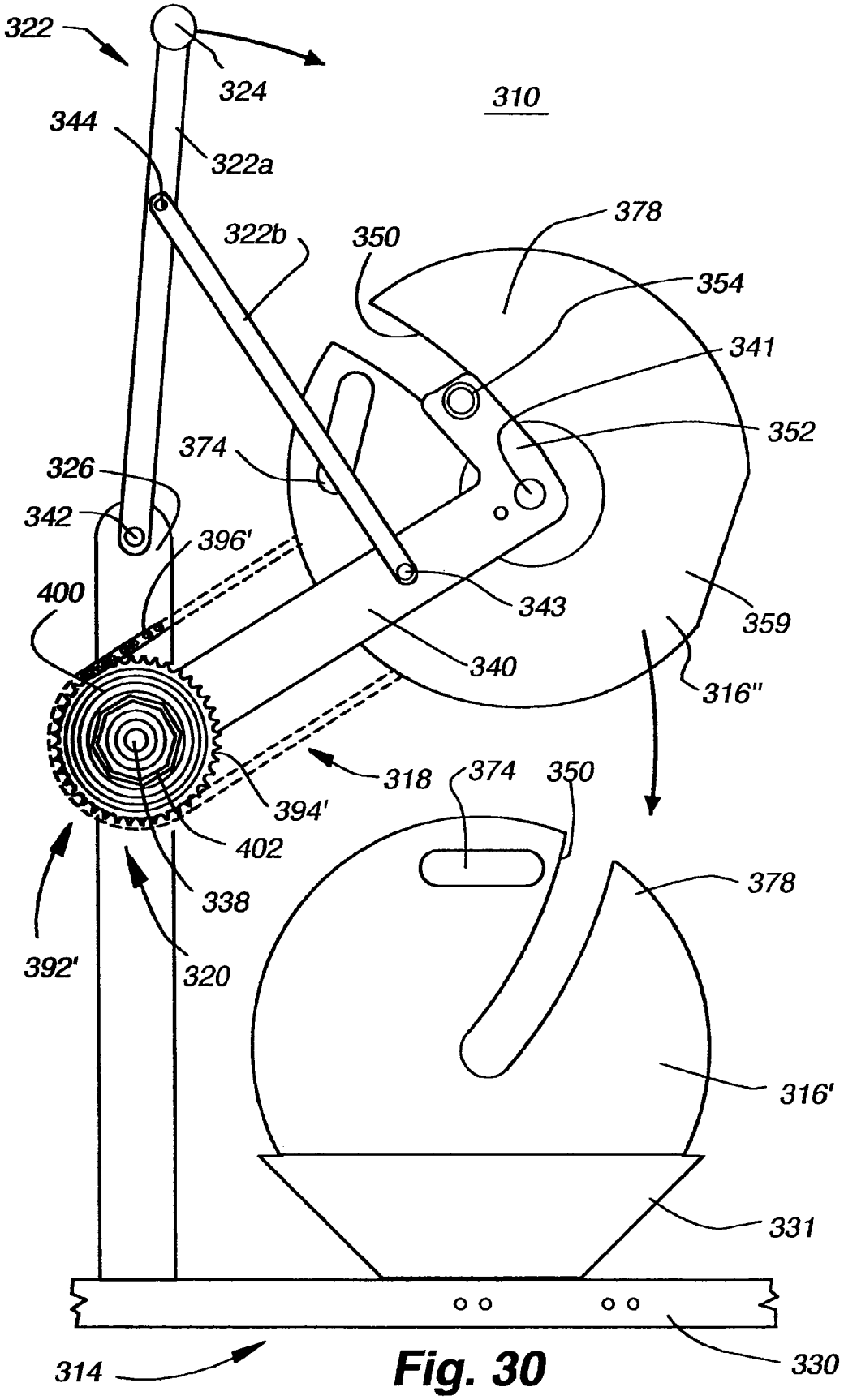
FIG. 30 is side elevation of the machine with the force transfer mechanism shown, wherein the weight arm assembly is in its fully upward position.

For a better understanding of the overall configuration and operation of the weight exercise machine 310, reference is made to FIGS. 23-30. FIG. 23 is an isometric view of the machine 310 illustrated in FIG. 22, except the force transfer mechanism 322 is not shown for clarity purposes. FIG. 24 is a side elevation of the machine 310 as depicted in FIG. 23 and as viewed from the selection wheel side of the machine 310. FIG. 25 is a side elevation of the machine 310 as depicted in FIG. 23 and as viewed from the side opposite that of FIG. 24. FIG. 26 is a front elevation of the machine 310 as depicted in FIG. 23. FIG. 27 is a top plan view of the machine 310 as depicted in FIG. 23. FIG. 28 is a rear elevation of the machine 310 as depicted in FIG. 23. FIG. 29 is side elevation of the machine 310 with the force transfer mechanism 322 shown, wherein the weight arm assembly 318 is in its fully downward position. FIG. 30 is side elevation of the machine 310 with the force transfer mechanism 322 shown, wherein the weight arm assembly 318 is in its fully upward position.

As shown in FIGS. 23-28, the weight exercise machine 310 includes a plurality of weight plates 316 that are selectively and removably mounted on the weight bar 341 extending between the free ends of the two arms 340 of the weight arm assembly 318. The weight selection mechanism 320 allows a variety of weight loads to be selectively attached to the weight bar 341 for lifting by the user. As can be understood from FIGS. 29-30, the weight selection mechanism 320 allows none, all, or some of the weight plates 316 to be attached to the weight bar 341, so that when the weight arms 340 are displaced in the course of a user performing an exercise movement, the weight bar 341 lifts only those selected/indexed weight plates 316 with the weight arms 340.

As indicated in FIG. 26, in one embodiment, the plurality of weight plates 316 will include two fifty-pound plates 316*a*, a single one hundred-pound plate 316*b*, a single twenty five-pound plate 316*c*, two ten-pound plates 316*d*, a single one-pound plate 316*e*, a singe two-pound plate 316*f*, and a single five-pound plate 316*g*. In other embodiments, there will be different plate combinations, plate sizes and numbers of plates.

Figure 31:
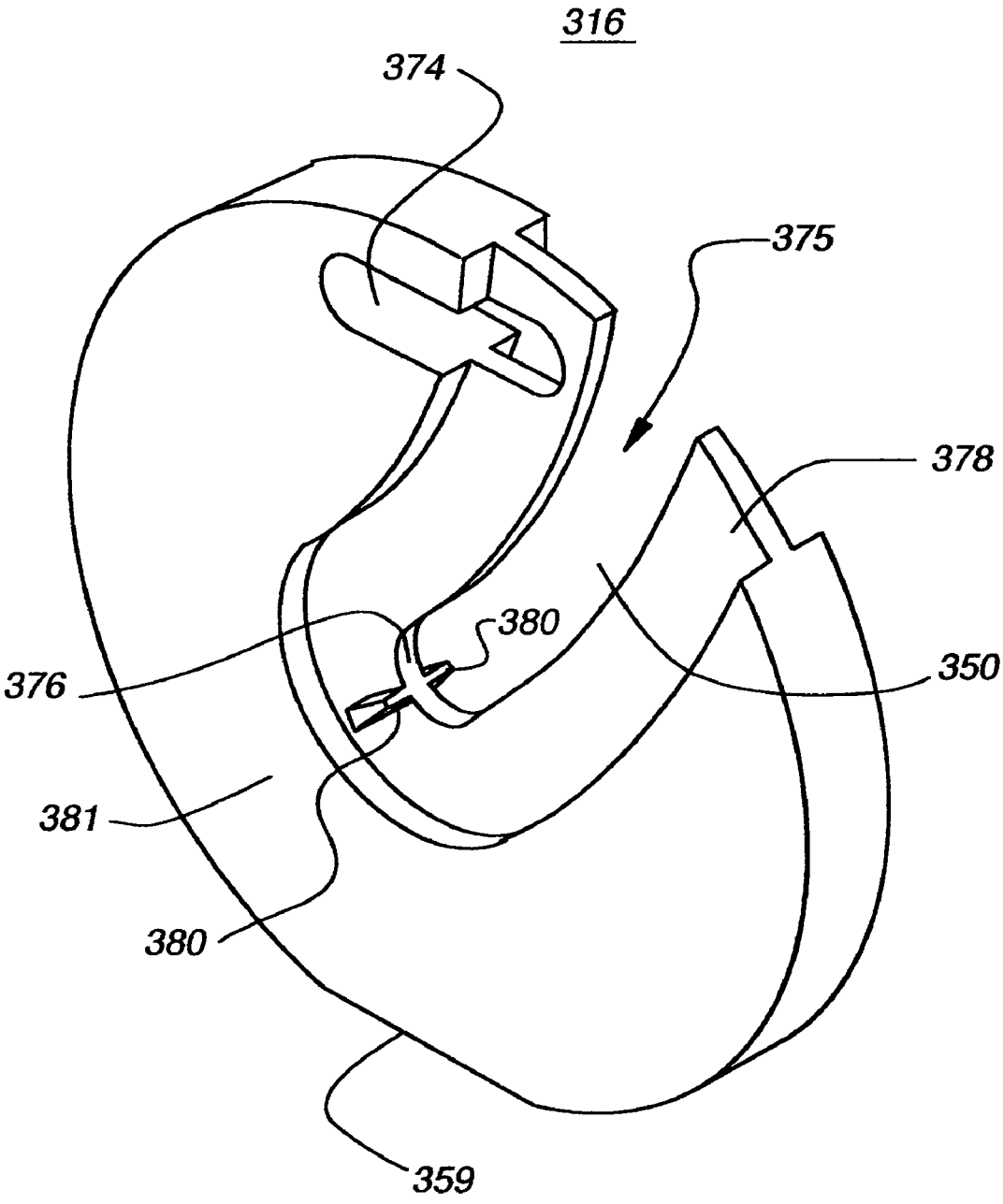
FIG. 31 is an isometric view of a weight plate used with the machine of the present invention.
Figure 32:
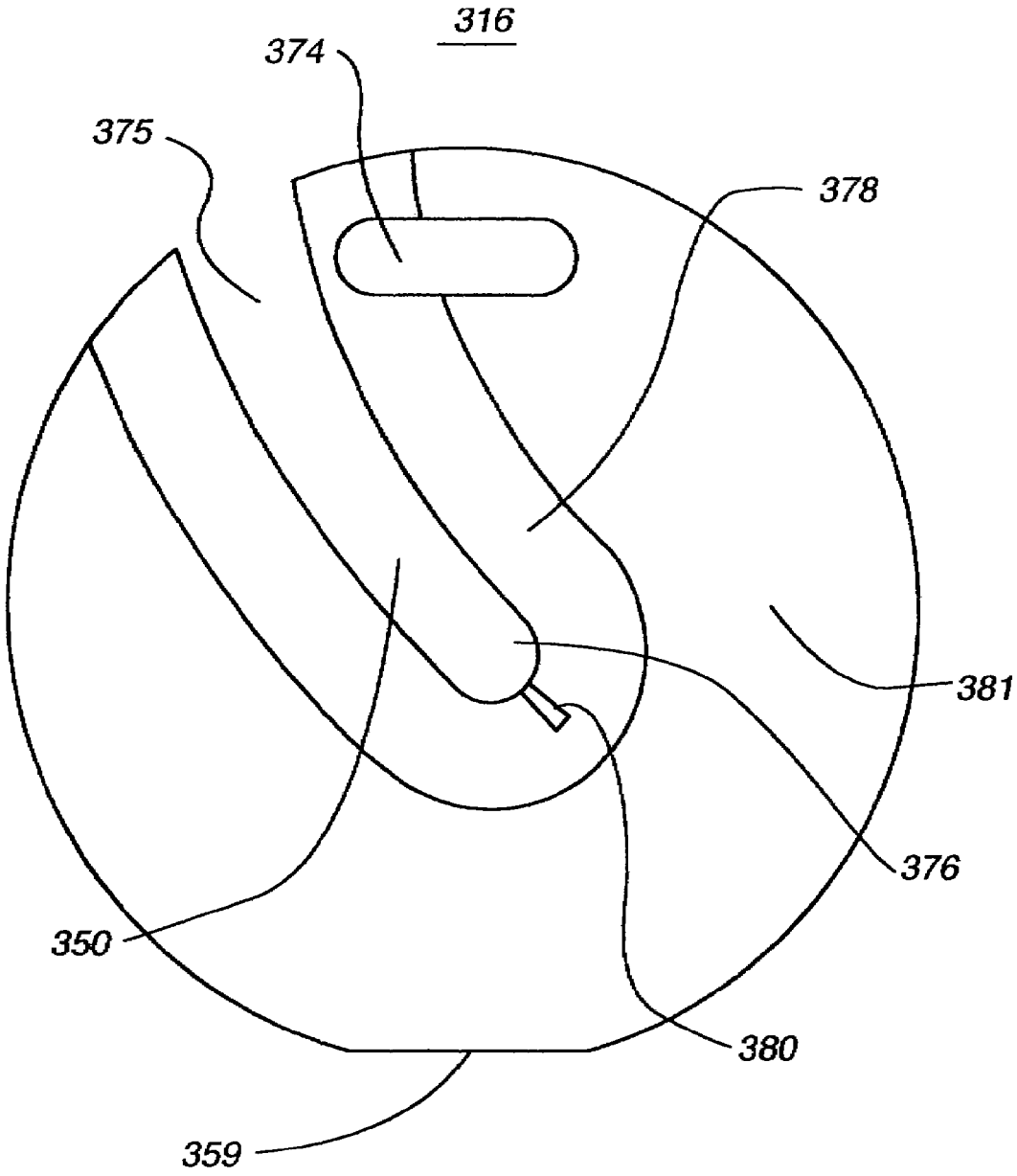
FIG. 32 is a side elevation of a weight plate used with the machine of the present invention.

As illustrated in FIGS. 31 and 32, which are, respectively, an isometric view and a side elevation of a weight plate 316 used with the machine 310 of the present invention, each weight plate 316 has an arcuate slot 350 formed in it from a central location (such as its center) to its peripheral edge. As can be understood from FIGS. 29-30, the arcuate slot 350 allows the weight bar 341 to freely move through its range of motion without engaging a weight plate 316 to which it is not operably attached.

In the embodiment illustrated in FIGS. 23-30, the ends 352 of the weight arms 340 are both curved upwardly with a stabilizing rod 354 positioned therebetween. While not required, the stabilizing rod 354 provides some structural rigidity to the weight arms 340. The slot 350 formed in each weight plate 316 accommodates the free movement of the stabilizing rod 354 within the slot 350 where the weight bar 341 is not attached to the particular weight plate 316.

As indicated in FIGS. 29-30, the tray 331 supports the unselected weight plates 316' in the proper orientation (on edge, without rotating) as the weight arms 340 move up and down with the selected weight plates 316" during use of the machine 310. As shown in FIGS. 23-28, the tray 331 is configured to stably support the weight plates 316 on edge when not being displaced by the weight arm assembly 318. In one embodiment, the tray 331 has a pair of parallel vertical sidewalls 356 and a bottom 358 that has a shape to retain the weight plates 316 in a stable, non-rotating manner. In one embodiment, the bottom 358 is curved or has opposing ramp surfaces (as shown) to engage the periphery of each weight 316. Also, in one embodiment, to maintain each weight 316 in a vertically parallel relationship to its neighbor weights 316 and to the tray sidewalls 356, the tray 331 will include discrete support rods. These rods are spaced apart from each other, run front-to-back within the tray 331, and are parallel to the other supports rods and to the tray sides. The support rods are spaced apart from each other such that a weight 316 can be received in the space defined between each pair of support rods.

In one embodiment, the bottom 358 of the tray 331 is flat. Accordingly, to facilitate the weight plates 316 being stabile when resting within the tray 331, the bottom peripheral edge 359 of each weight plate 316 (i.e., the peripheral edge of each weight plate 316 intended to contact the bottom 358 of the tray 331) is flat for a segment of the periphery of the weight plate 316, as shown in FIGS. 30-32. Thus, each outer peripheral edge is defined by an arcuate segment and a linear or straight segment 359, wherein the arcuate segment comprises the majority of the peripheral length of the weight plate 316 and the linear or straight segment 359 is sufficiently long to provide a straight/linear/flat base for the weight plate 316.

Figure 33:
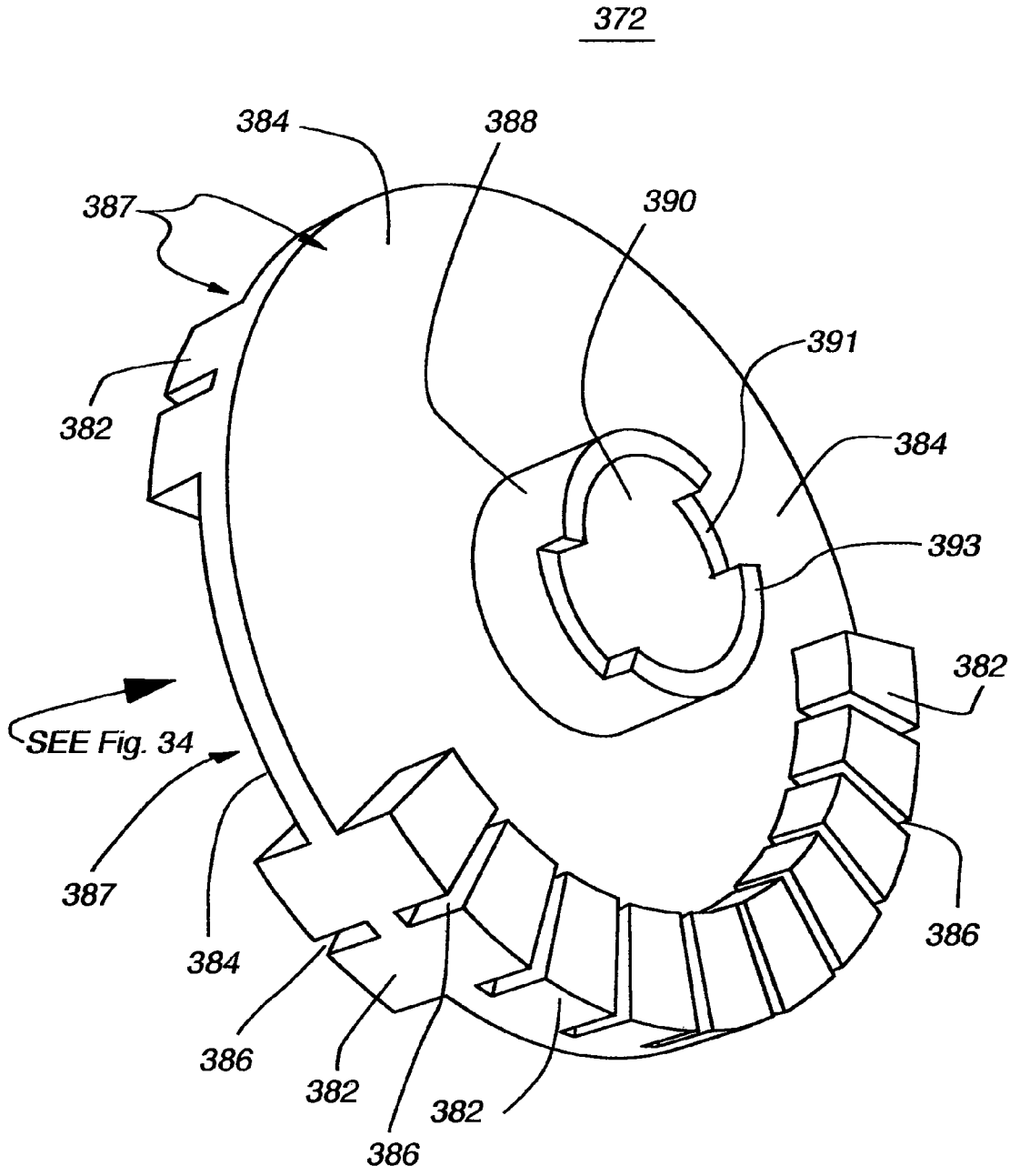
FIG. 33 is an isometric view of a first side of a first weight engagement disk or selection collar.
Figure 34:
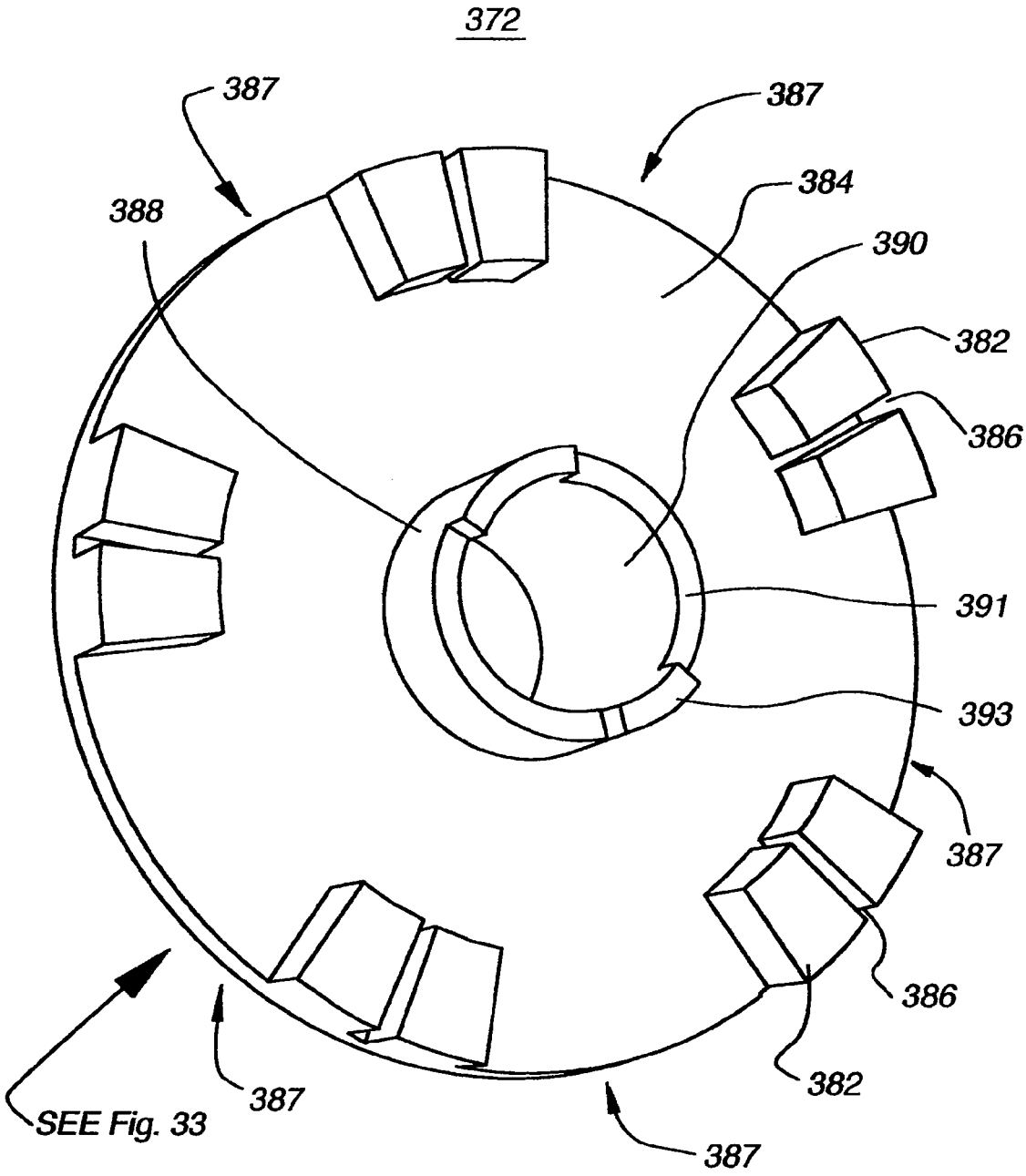
FIG. 34 is an isometric view of a second side of the first weight engagement disk or selection collar.
Figure 35:
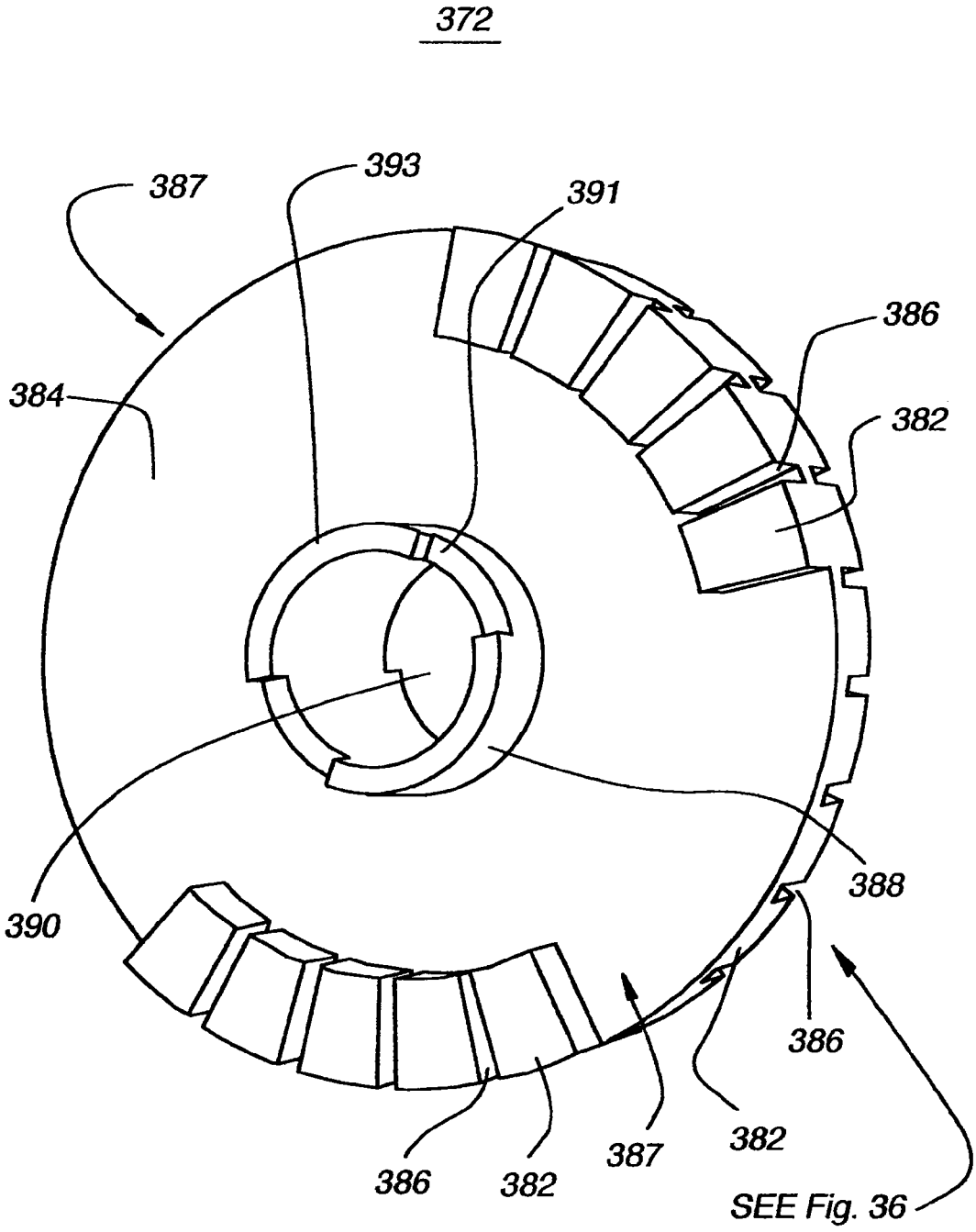
FIG. 35 is an isometric view of a first side of a second weight engagement disc or selection collar.
Figure 36:
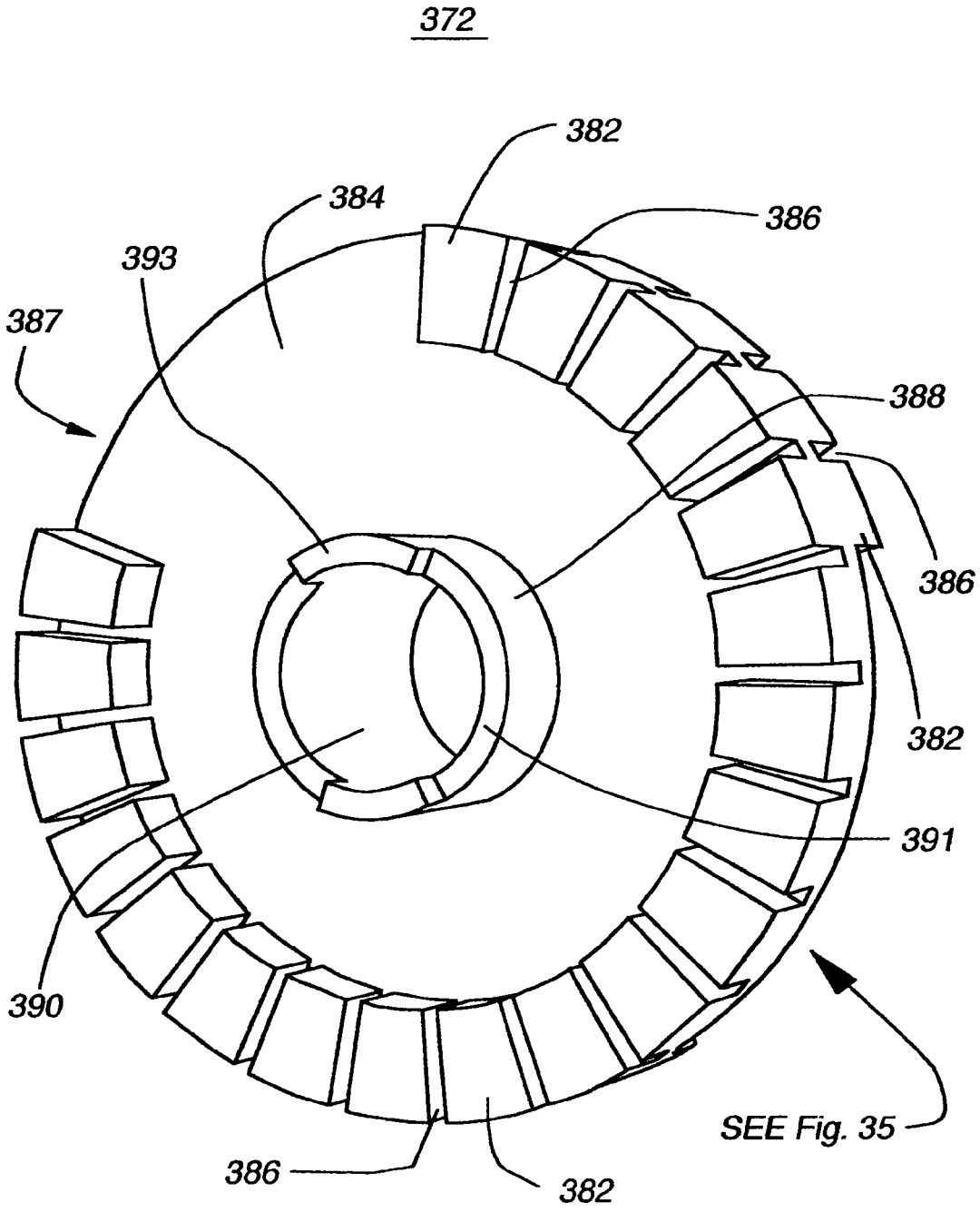
FIG. 36 is an isometric view of the second side of the second weight engagement disc or selection collar.
Figure 37:
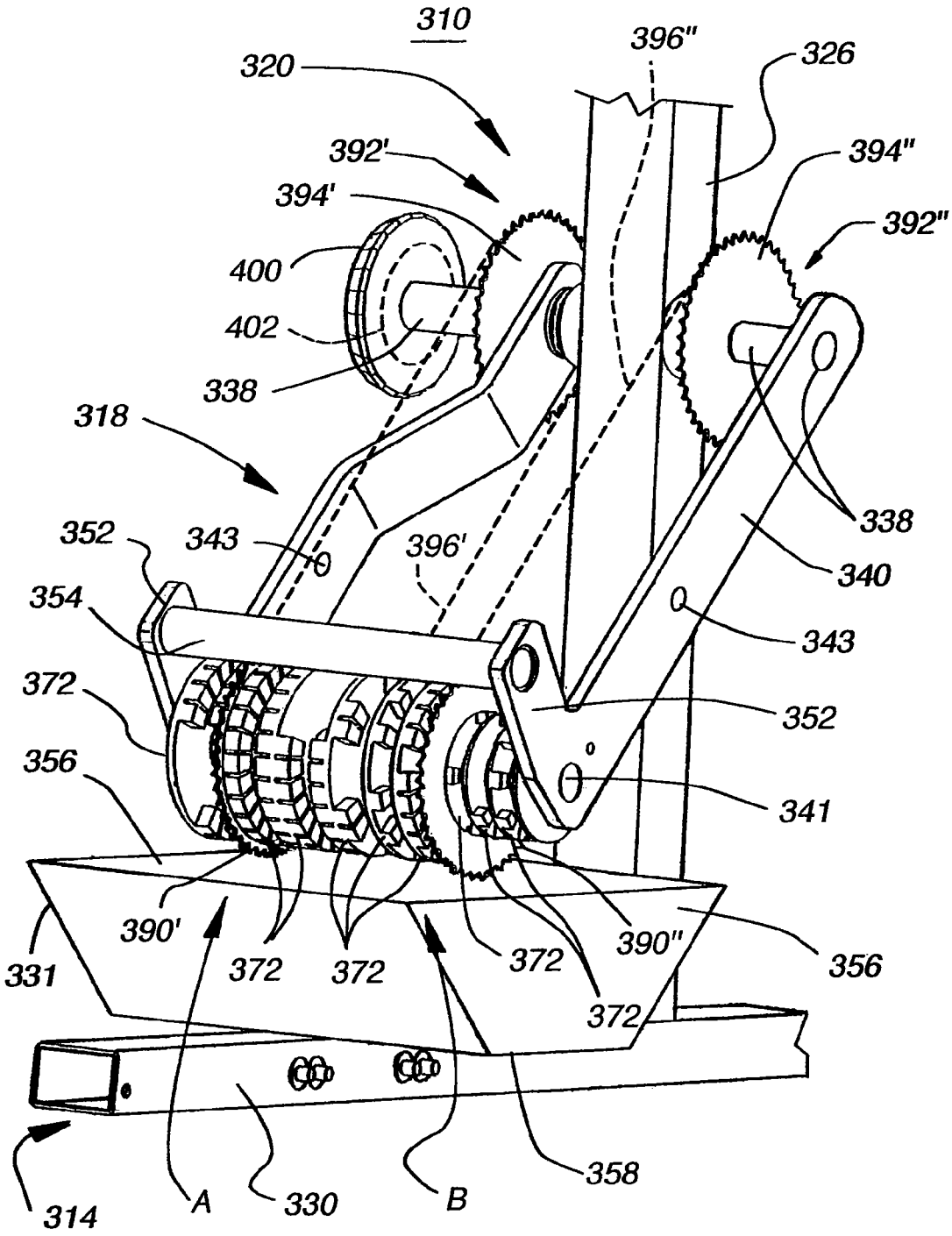
FIG. 37 is an isometric view of the machine, wherein the weight plates and force transfer mechanism are not shown for clarity purposes.

In one embodiment, as previously mentioned in this Detailed Description, the weight plate selection/indexing mechanism 320, which allows a user to select/index a weight plate 316 combination for operable engagement with the weight bar 341, has substantially the same structure and operates in substantially the same way as described in the Ser. Nos. 10/456,977 and 10/127,049 applications incorporated by reference herein. For a discussion regarding an embodiment of the weight index mechanism 320, reference is made to FIGS. 29-37. FIGS. 33 and 34 are isometric views of the two sides of a weight engagement disk or selection collar 372. FIGS. 35 and 36 are isometric views of the two sides of another weight engagement disc or selection collar 372. FIG. 37 is an isometric view of the machine 310, wherein the weight plates 316 and force transfer mechanism 322 are not shown for clarity purposes.

FIGS. 29-30 respectively show the weights plates 316 in the rest position and the lifted position. As illustrated in FIG. 30, the weight bar 341 and stabilizing rod 354 have exited the curved slot 350 in the non-selected weight plates 316'. As shown in FIGS. 23-25 and 29-30, the oval holes 374 at the top of the weight plates 316 are for lifting each weight plate 316 by hand if needed to set in the tray 331.

As indicated in FIGS. 31-32, the curved slot 350 is shown extending from the center axis of the weight plate 316 to an outer periphery end 375 of the slot 350 at the outer periphery of the plate 316. The non-periphery or terminal end 376 of the slot 350 need not be in the center of the weight plate 316. A channel 378 is formed around the slot 350 on either side of the plate 316. The channel 378 defines a thin cross-section of the weight plate 316 adjacent the edges of the slot 350. At the base or terminal end 376 of the slot 350, a tab 380 perpendicularly extends from each planar surface of the channel 378 such that the distance between the tips of the tabs 380 is generally equivalent to the overall thickness of each plate 316 (i.e., the distance between the planar faces 381 of each plate 316). In one embodiment, the tabs 380 are in symmetrical locations on either side of the plate 316 at the base 376 of each slot 350. In one embodiment, a plate 316 will have a single tab 380 that extends from a single groove side of the plate 316. In one embodiment, as shown in FIG. 31, a plate 316 will have a tab or nub 380 that extends from each groove side of the plate 316.

As can be understood from FIGS. 23-37, each selection collar 372 is rotatably mounted on the weight bar 341 and spaced apart from its fellow adjacent collars 372. This collar arrangement allows a weight plate 316 to be received between each pair of collars 372. As the weight arm assembly displaces between the downward position (FIG. 29) and the upward position (FIG. 30), each selection collar 372 passes along the slots 350 of the adjacent weight plate(s). In other words, each slot 350 has a selection collar 372 that passes along the slot's length as the weight arm assembly 318 displaces between the downward and upward positions.

As shown in FIGS. 33-37, one or more protrusions or bosses 382 perpendicularly extend from the planar side surfaces 384 of each disc or collar 372 near the outer circumferential edge of each disc or collar 372. In one embodiment, each boss 382 includes a slot 386 radially extending through the boss 382. Each collar 372 includes annular extensions 388 that perpendicularly extend from the planar side surfaces 384 about a weight bar receiving hole 390 that passes though the center of the collar 372. Each collar 372 is rotationally mounted on the weight bar 341 via the collar's weight bar receiving hole 390. Each annular extension 388 includes a key cutout 391 (see FIGS. 33 and 35) and a key tab 393 (see FIGS. 34 and 36). The key tab 393 of a collar 372 engages with the key cutout 391 of the immediately adjacent collar 372, thereby coupling the plurality of collars 372 in a non-rotational relationship relative to each other. As a result, the plurality of collars 372 are rotatable about the weight bar 341 as an integral unit. As illustrated in FIGS. 26-28, the collars 372 are rotatably mounted on the weight bar 341 and spaced apart to be received between adjacent weight plates 316 supported by the weight tray 331.

As can be understood from FIGS. 23-37, the collars 372 via their respective bosses 382 engage with the tabs 380 of the selected/indexed weight plates 316 in a manner similar to the engagement between the arcuate rim surfaces 84 of the discs 82 and the cam followers 138 of the selected/indexed add-on weights 126 of the first embodiment of the present invention as discussed with respect to FIGS. 9 and 20. When the weight arm assembly 318 is in the downward position (see FIG. 29), the weight index mechanism 320 is actuated to rotate the collars 372 about the weight bar 341 to select/index the combination of weight plates 316 that results in the desired magnitude of weight resistance desired for the weight exercise movement to be performed with the machine 310. Selected/indexed weight plates 316" are coupled to the weight bar 341 when the bosses 382 of the corresponding collars 372 are rotated such that the bosses 382 abut against the tabs 380 of the selected/indexed weight plates 316" when the weight arm assembly 318 is displaced upward from the downward position. In other words, the bosses 382 prevent the tab 380 of a selected/indexed weight plate 316" from passing outside the outer circumference of the collar 372 when the collar 372 is displaced upward when the weight arm assembly 318 is displace upward. As a result, the tabs 380 and their weight plates 316 are moved upward by the upward moving collars 372 when the weight arm assembly 316 is displaced upwards by a user performing an exercise movement with the machine 310. In one embodiment, the tabs 380 of a selected/index weight plate 316" mate with the slots 386 of the corresponding collars 372 to provide a more positive engagement between the tabs 380 and collars 372.

As can be understood from FIGS. 23-37, the tabs 380 of the non-selected/non-indexed weight plates 316' do not engage with the bosses 382 of the corresponding collars 372 because the tabs 380 align with a portion of the collar 372 that does not have bosses 382 along the outer circumferential edge of the collar 372. As a result, when the collars 372 displace upwards via the upward displacing weight bar 341, the tabs 380 of the non-selected/non-indexed collar 372 pass outside the outer circumference of the collars 372. Specifically, gaps or spaces 387 defined by the lack of bosses 382 along segments of the outer circumference of the collars 372 provide paths for the tabs 380 of the non-selected/non-indexed weight plates 316'. As a result, the non-selected/non-index weight plates 316 remain in the tray 331 as the weight arm assembly 318 is displaced upwardly by a user performing an exercise movement with the machine 310.

As previously mentioned, each weight channel 378 receives a selection collar 372 mounted around the weight bar 341. As indicated in FIGS. 29 and 30, when a weight plate 316 is not selected, the weight channel 378 allows space for the collar 372 to pass freely out of and into the channel 378 as the collar 372 passes between adjacent weight plates 316 while the weight bar 341 and stabilizing rod 354 pass out of and into the slots 350 of the weight plate 316. In one embodiment, each slot 350 of a weight plate 316 will generally widen as the slot 350 extends from its base 376 to its outer periphery end 375, thereby facilitating the free passage of the weight bar 341 and/or stabilizing rod 350. Similarly, in one embodiment, the channel 378 will have a widening dimension from its inner or base end to its outer end at the periphery of the weight plate 316, thereby facilitating the free passage of the selector collar 372 out of and into the channel 378 of the weight plate 316.

As previously mentioned, FIGS. 33-36 show both sides of two individual collars 372 having different arrangements of bosses 382 around the periphery of the collar or disk 372. The bosses 382 are positioned peripherally in selected positions so that when the collar 372 is rotated to a position intended to select/index the tab 380 of the corresponding selected/indexed weight plate 316, at least one boss 382 engages the tab 380 on the weight plate 316 to operably engage the weight plate 316 with the weight bar 341. The boss 382 engages the tab 380 and lifts the weight plate 316 with the weight bar 341 when a boss 382 is positioned under a tab 380 by the user. For non-selected/non-indexed weight plates 316, no bosses 382 engage the tab 380 of the non-selected/non-indexed weight plates 316 because the corresponding collars 372 are rotated to an unengaged position where no boss 382 is brought into engaging alignment with the tab 380 of the non-selected/non-indexed weight plates 316. As a result, the non-selected/non-engaged weights 316 do not move with the weight bar 341.

Where a weight plates 316 is equipped with tabs 380 extending from both planar sides of the weight plate 316, collars 372 on either side of the weight plate 316 may engage said weight plate 316 via its tabs 380. Where a collar 372 has bosses 382 on either side of the collar periphery, said collar 372 may engage weight plates 316 on both sides or either side of the collar 372. The bosses 382 are positioned around the periphery in a "clocked" manner to selectively engage or not engage the tabs 380 of the corresponding weight plates 316 as needed to provide the weight resistance selected by the user via the weight index mechanism 320 for the exercise to be performed on the machine 310. One embodiment of the boss/collar configuration is described in more detail in the applications incorporated by reference herein, as noted above.

As can be understood from FIG. 37, the weight plates 316 are typically positioned between each collar 372. The collars 372 rotate with respect to the weight rod 341. In one embodiment, where two groups or collections of weights 316 are provided on the weight bar 341, a pair of selection/index gears 390 is rotatably mounted on the weight bar 341. In another embodiment, where only one group or collection of weights 316 is provided on the weight bar 341, only one selection/index gear 390 is rotatably mounted on the weight rod 341.

Where two weight groups and two selection/index gears 390 are provided, the left side collars A are interlocked to rotate as one unit (using the structure noted above) with the left selection/index gear 390', and the right side collars B are interlocked to rotate as one unit (using the structure noted above) with the right selection/index gear 390". Rotation of the left selection/index gear 390' causes the left side collar group A to rotate about the weight bar 341. Similarly, rotation of the right selection/index gear 390" causes the right side collar group B to rotate about the weight bar 341.

As previously mentioned, the weight plates 316 are positioned between the weight collars 372 with the weight collars 372 positioned in the channels 378 between adjacent weight plates 316. As illustrated in FIGS. 23-30, in one embodiment, the collars 372 form the extreme end of each weight/collar group such that the end collars 372 do not have a weight plate 316 adjacent to the collar's outside planar surface.

Where the machine 310 has two collar groups A, B, a first set of weights 316 corresponding to a first collar group A can be selected independently of a second set of weights 316 corresponding to a second collar group B. Such a dual collar group configuration is convenient, for example, where the first collar group A (i.e. the left side in FIG. 37) is configured to allow adjustment from 50 to 200 pounds by 50 pound increments, and the second collar group B (i.e. the right side in FIG. 37) is configured to allow adjustment from one pound to 53 pounds in two pound increments, not taking into account the weight of the weight bar.

In other embodiments, depending on the length of the weight bar 341 and the incremental weight adjustment capability desired, the machine 310 will have more than two collar/weight groups. For example, where there are three collar/weight groups, three weight selection increments can be provided. Where there are four collar/weight groups, four weight selection increments can be provided.

As indicated in FIG. 37, in embodiments having two collar/weight groups, the machine 310 will include a left side gear drive 392' and a right side gear drive 392". The left side gear drive 392', which includes a left upper drive gear 394', is coupled to the left selection/index gear 390' via a left belt or chain 396' or other force transfer mechanism element(s) (e.g., a gear train or worm gear structure). The right side gear drive 392", which includes an right upper drive gear 394", is coupled to the right selection/index gear 390" via a right belt or chain 396" or other force transfer mechanism element(s) (e.g., a gear train or worm gear structure). Coaxial shafts 338 form the pivot 338 about which the weight arm assembly 320 pivots relative to the vertical post 326 of the base frame 314. The outer coaxial shaft 338 rotatably couples an primary or coarse index/selection wheel 400 to the left upper drive gear 394', and the inner coaxial shafts 338 rotatably couples an add-on or fine index/selection wheel 402 to the right upper drive gear 394".

Bearings allow the coaxial shafts/axles 338 to rotate with respect to the vertical post 326 to which the coaxial shafts 338 are attached. While the weight arms 340 are shown as pivoting around the same axis as the inner and outer axles 338 for the selection wheels 400, 402, it is contemplated that with the appropriate configuration for the selection wheel and drive gear assemblies, the pivot axis of the weight arms 340 do not have correspond to the coaxial shafts 338 of the selection wheel and upper drive gear assemblies.

Rotationally displacing an index/selection wheel 400, 402 causes the associated upper drive gear 394', 394" to rotationally displace. The rotational displacement of the upper drive gear 394', 394" is transferred to the corresponding index/selection gear 390', 390" via the belt or chain 396' 396". Displacement of the corresponding index/selection gear 390', 390" causes the corresponding collar group A, B to rotate about the weight bar 341. As a result, the bosses 382 move into and out of engagement with the tabs 380 on the weight plates 316, thereby indexing/selecting a weight combination from the corresponding weight group.

The outer index/selection wheel 400 and inner index/selection wheel 402 are marked with indices to tell the user what weight resistance combination is selected. Detents are placed in the selection structure to help the user "feel" when a weight resistance combination is selected. The collars groups A, B are not rotatably connected together on the weight bar 341. As a result, each collar group A, B can be set separately via its respective selection wheels 400, 402 for a different weight resistance to add up to the total weight resistance lifted by the weight bar 341 when displaced by a user performing an exercise movement on the machine 310.

As previously mentioned, the tab 380 on a weight 316 may be engaged directly by a boss 380 or may pass through a gap or space 387 formed between adjacent bosses 382. If the tab 380 is received in a slot 386 of a boss 382, this may allow for a more secure engagement of the weight plate 316 through the arc of displacement of the free end of the weight arm assembly 318.

The curvature and width of the slot 350 formed in each weight plate 316 is designed and dimensioned by the radius of curvature defined by distance along the weight arms 340 between the pivot point 338 and the weight bar 341, as can be understood from FIGS. 23 and 24. The position of the stabilizing rod 354 is arranged to fall within the arc defined by the motion of the weight bar 341 as the bar 341 is pivoted through space about the pivot point 338.

As with the first embodiment of the weight machine 10 illustrated in FIGS. 1-21, the second embodiment of the weight machine illustrated in FIGS. 22-37 can be utilized with a variety of different weight exercise stations/machines including without limitation: seated and standing calf machines; high, medium and low back row machines; lat pull-down machines; trap shrug machines; shoulder press and side lateral shoulder machines; incline and flat bench machines; vertical chest and fly machines; preacher curl and other bicep machines; triceps extension machines; dip machines; cable cross-over machines; rear delt machines; leg press, leg curl, and leg extension machines; smith machines; etc.

It is contemplated that there may be more than one weight load per machine, such as a multi-station machine allowing for a plurality of different exercises. It is also contemplated that the weight index mechanism 320 may be operably incorporated into the exercise member 324 or weight arms 340 differently than disclosed above. For example, the selection wheels 400, 402 can be operably attached to the end of the exercise member 324.

For a discussion of the operation of the weight exercise machine 310 of the present invention, reference is made to FIGS. 22-37. A user desiring to exercise on the weight exercise machine 310 of the present invention positions his self in the workstation 312. The user determines that for his first exercise set at the machine 310 the level of resistance will be, for example, 157 pounds, not including the weight of the weight bar. The user dials the primary weight wheel 400 such that it indicates 150 pounds on a first indicator disc. This action, via the gears 390', 394' and the chain 396' causes the first collar group A to rotate about the weight axle 341 such that the bosses 382 of the collars 372 associated with a fifty-pound weight plate 316*a* and a one hundred-pound weight plate 316*b* engage the tabs 380 of said plates. A combination of weight plates 316 providing a weight resistance of 150 pounds is now coupled to the weight bar 341 via the first collar group A. It is to be appreciated that the weight bar can add weight to the selected resistance. For example, in one embodiment of the weight exercise machine, the weight bar weighs 10 pounds. As such, selected weight indications on the primary weight wheel and the add-on weight wheel can be configured to account for the weight of the weight bar 341 when selecting a desired resistance.

The user dials the add-on weight wheel 402 such that it indicates seven pounds on a second indicator disc. This action, via the gears 390", 394" and the chain 396" causes the second collar group B to rotate about the weight axle 341 such that the bosses 382 of the collars 372 associated with a five-pound weight plate 316*g* and a two-pound weight plate 316*f* engage the tabs 380 of said plates. A combination of weight plates 316 providing a weight resistance of seven pounds is now coupled to the weight bar 341 via the second collar group B. A total of 157 pounds of weight plates 316 are now coupled to the weight bar 341. Thus, when the weight arm assembly 318 pivots upwardly, as shown in FIGS. 29 and 30, the coupled (i.e., indexed/selected) weights 316" associated with collar groups A, B pivot upwardly with the weight arm assembly 318. However, the remaining non-coupled (i.e., non-indexed/non-selected) weights 316' continue to rest in the tray 331 and do not pivot upwardly because their tabs 380 were not engaged by the bosses 382 of their corresponding collars 372. More specifically, because the tabs 380 of the non-coupled weights 316' are not aligned with bosses 382, the tabs 380 can pass through the gaps or spaces 387 between the bosses 382. Thus, the tabs 380 pass outside the outer periphery of the collars 372 as the collars 372 leave the tabs 380 with the upward displacing weight bar 341.

It should be understood that the selection wheels 400, 402 can be set in any order. The selection wheels 400, 402 can even be set at the same time if a user uses two hands to manipulate the two wheels 400, 402.

As can be understood from FIGS. 29 and 30, once the weight selection wheels 400, 402 are appropriately set to provide a weight resistance of 157 pounds, the user performs the positive portion of the first repetition of his first set of the exercise movement by exerting an exercise force against the exercise member 324 to cause the exercise member to displace upward, which causes the force transfer mechanism 22 to displace the weight bar assembly 318 upward relative to the base frame 314, as can be understood from FIGS. 29 and 30. As the weight arm assembly 318 pivots upwardly, the coupled (i.e., indexed/selected) weights 316" (see FIG. 30) pivot upwardly relative to the base frame 314 with the weight arm assembly 318. However, the non-coupled (i.e., non-indexed/non-selected) weights 316' (see FIG. 30) do not pivot upwardly with the weight arm assembly 318, but instead remain in the tray 331. On the negative portion of the first repetition, the user allows the exercise member 324 to displace downward, which allows the force transfer mechanism lower the weight arm assembly 318 to return to the downward position, as illustrated in FIG. 29. As a result, the coupled (i.e., indexed/selected) weights 316" (see FIG. 30) return to the downward position to rest with the non-coupled (i.e., non-indexed/non-selected) weights 316', as depicted in FIG. 29.

Once the user has finished the appropriate number of repetitions for the 157 pound set, the user can select/index another combination of weights 316 to provide for an increased or decreased weight resistance for another exercise set on the machine 310.

As previously mentioned, the weight exercise machine can be configured with different plate combinations, plate sizes and numbers of plates. For example, the plurality of weight plates 316 in one form of the weight exercise machine includes two fifty-pound plates 316*a*, a single one hundred-pound plate 316*b*, a single twenty-pound plate 316*c*, two ten-pound plates 316*d*, a single 1.25 pound plate 316*e*, a singe 2.5 pound plate 316*f*, and a single five-pound plate 316*g*. In addition, the machine can include 310 two independently selectable collar groups A, B, configured differently than the collar groups described above. For example, the first collar group A can include the two fifty-pound plates 316*a*, the single one hundred-pound plate 316*b*, the single twenty-pound plate 316*c*, and the two ten-pound plates 316*d*, while the second collar group B can include the single 1.25 pound plate 316*e*, the singe 2.5 pound plate 316*f*, and the single five-pound plate 316*g*. As previously mentioned, the weight of the weigh bar can also be taken into account with regard to the selectability of resistance. For example, with a machine having a weight bar that weighs 10 pounds, the first collar group A can be configured to allow adjustment from 10 to 250 pounds by 10 pound increments, and the second collar group B can be configured to allow adjustment from 1.25 pounds to 8.75 pounds in 1.25 pound increments.

d. Third Embodiment of the Weight Exercise Machine

Figure 40:
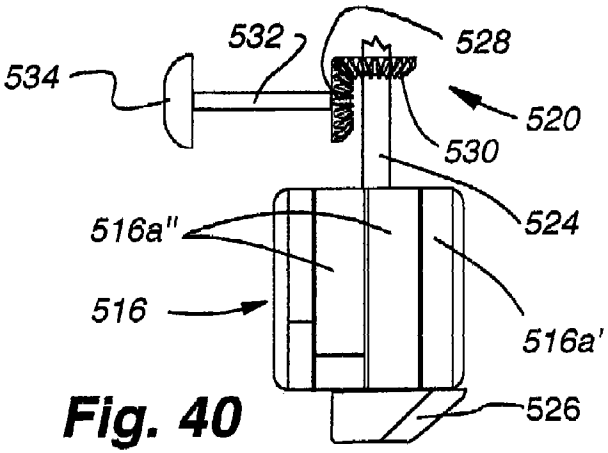
FIG. 40 is a front elevation of the weights and weight indexing mechanism wherein the indexing mechanism is aligned with the selected/indexed weight prior to displacement relative to the non-indexed/non-selected weights.
Figure 41:
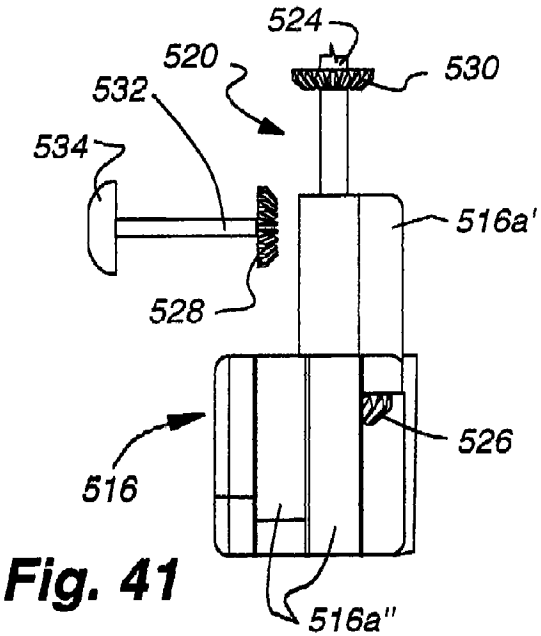
FIG. 41 is the same view depicted in FIG. 40, except the index/selected weight has been displaced relative from the non-indexed/non-selected weights by a user displacing an exercise member.
Figure 39:
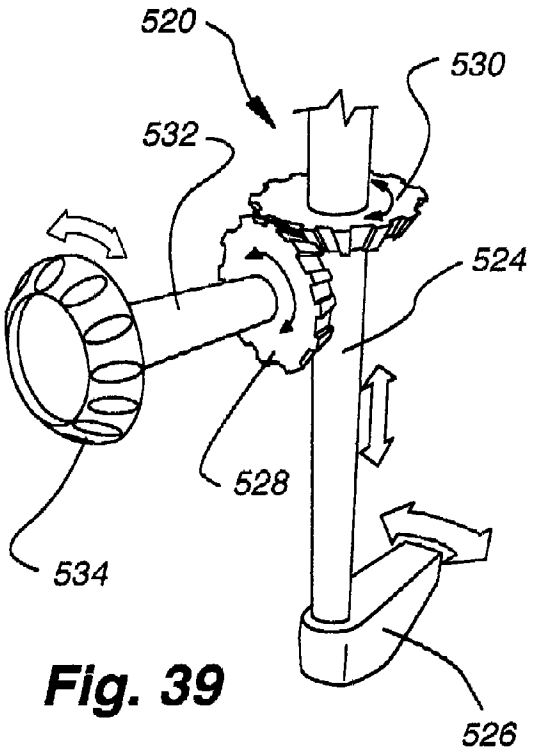
FIG. 39 is an isometric view of the index mechanism wherein the weights are not shown for clarity purposes.
Figure 38:
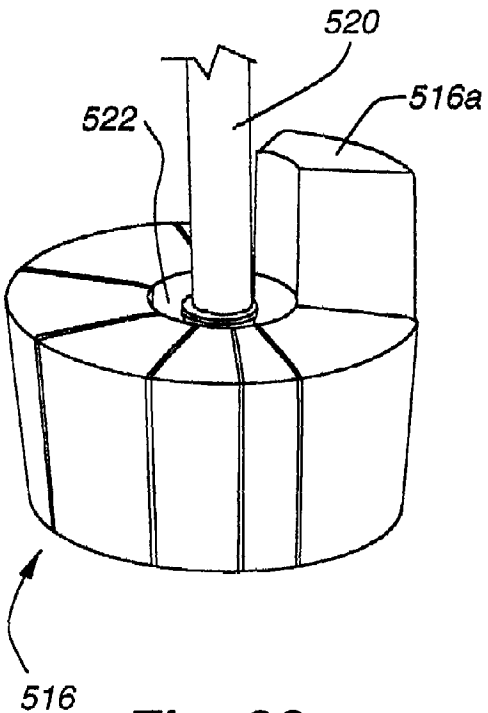
FIG. 38 is an isometric view of weights and weight index mechanism of the weight exercise machine.

For a discussion of the third embodiment of the weight exercise machine of the present invention, reference is made to FIGS. 38-41. FIG. 38 is an isometric view of weights 516 and weight index mechanism 520 of the weight exercise machine. FIG. 39 is an isometric view of the index mechanism 520 wherein the weights 516 are not shown for clarity purposes. FIG. 40 is a front elevation of the weights 516 and weight indexing mechanism 520 wherein the indexing mechanism 520 is aligned with the selected/indexed weight 516*a*' prior to displacement relative to the non-indexed/non-selected weights 516*a*". FIG. 41 is the same view depicted in FIG. 40, except the index/selected weight 516*a*' has been displaced relative from the non-indexed/non-selected weights 516*a*" by a user displacing an exercise member.

As shown in FIG. 38, each weight 516*a* is a pie-slice segment 516*a* of a cylindrical mass having a center hole 522. As indicated in FIG. 39, the weight index mechanism 520 includes a lift shaft 524, a lift member 526, first and second gears 528, 530, an index shaft 532, and an index wheel 534. The lift member 526 is coupled to the bottom end of the lift shaft 524, and the second gear 30 is coaxially mounted on an upper portion of the lift shaft 524. The index wheel 534 is mounted on one end of the index shaft 532, and the first gear 528 is mounted on the other end of the index shaft 532. The first and second gears 528, 530 engage each other.

As indicated by the arrows in FIG. 39, the lift shaft 524 is vertically displaceable and rotatable about its longitudinal axis. As can be understood from FIG. 40, a user selects a weight resistance by rotating the index wheel 534, which causes the lift shaft 524 to rotate and bring the lift member 526 into engaging alignment with the bottom surface of the appropriate indexed/selected weight 516*a*'. As with the first two embodiments of the present invention (as depicted in FIGS. 1-37), the lift shaft 524 is coupled to a force transfer mechanism that transfers the lifting force exerted by a user on an exercise member to the lift shaft 524. Therefore, as can be understood from FIG. 41, when the user applies an exercise force to the exercise member when performing an exercise movement on the machine, the lift shaft 524 displaces vertically, taking the indexed/selected weight 516*a*' upward.

e. Fourth Embodiment of the Weight Exercise Machine

Figure 43:
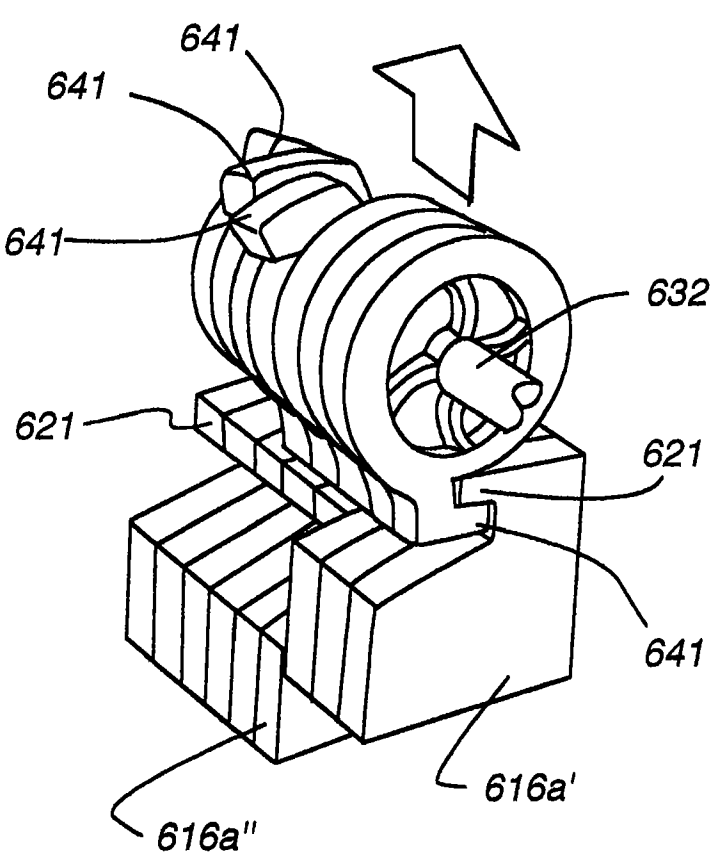
FIG. 43 is an isometric view of the indexed/selected weights being displaced relative from the non-indexed/non-selected weights by a user displacing an exercise member.
Figure 42:
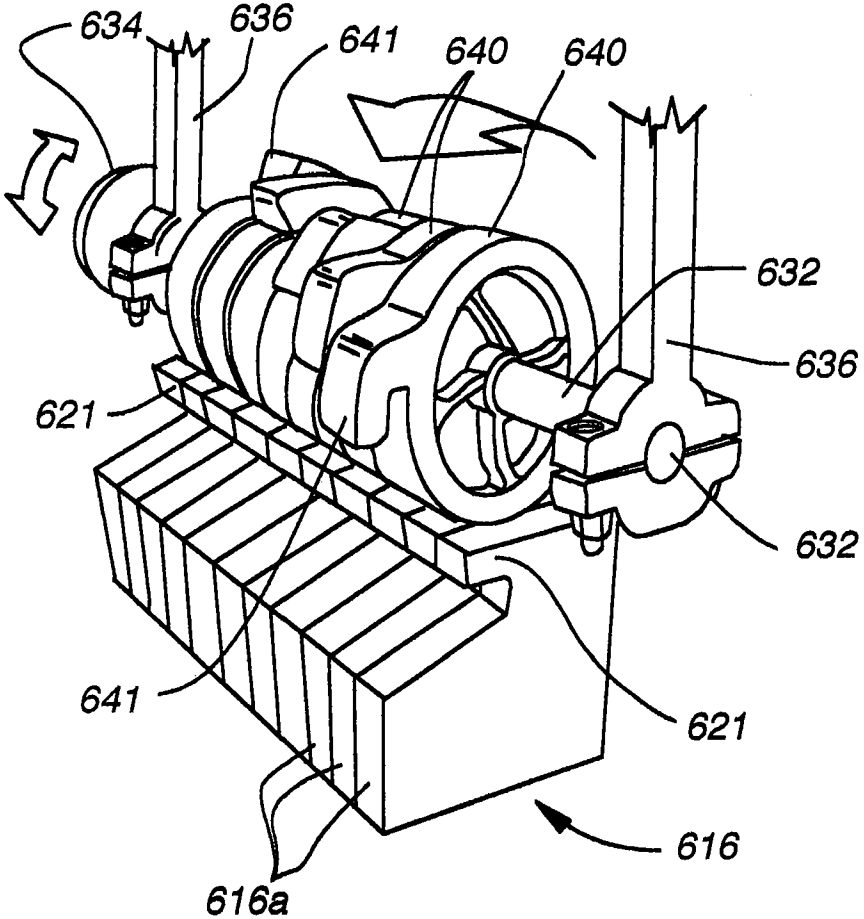
FIG. 42 is an isometric view of weights and weight index mechanism of the weight exercise machine.

For a discussion of the fourth embodiment of the weight exercise machine of the present invention, reference is made to FIGS. 42 and 43. FIG. 42 is an isometric view of weights 616 and weight index mechanism 620 of the weight exercise machine. FIG. 43 is an isometric view of the indexed/selected weights 616*a*' being displaced relative from the non-indexed/non-selected weights 616*a*" by a user displacing an exercise member.

As indicated in FIG. 42, the weight machine includes a plurality of weights 616 and an index mechanism 620. The weights 616 are arranged side-by-side and each includes a hook, groove, slot, or other engagement feature 621. The index mechanism 620 includes an index shaft 632, an index wheel 634, shaft arms 636, and engagement wheels 640. The shaft arms 636 support the index shaft 632 at opposite ends of the index shaft 632. The index wheel 634 is mounted on one end of the index shaft 632 to rotatably displace a shaft within the index shaft 632. Each engagement wheel 640 includes a hook or other engagement feature 641 configured to engage the engagement feature 621 on the corresponding weight 616*a*.

To select a weight resistance for an exercise to be performed on the machine, the user rotates the index wheel 634 to the appropriate weight setting. Rotation of the index wheel 634 causes the shaft within the index shaft 632 to rotate. In a manner similar to those previously described in this Detailed Description and in the incorporated applications, the coaxial shafts (i.e., the index shaft 632 and the shaft within the index shaft 632) are configured to allow the selective engagement of the engagement wheels 640 that correspond to the selected weight resistance. Accordingly, as depicted in FIGS. 42 and 43 by the arrows, the selectively engaged engagement wheels 640 are caused to rotate down such that their respective engagement features 641 engage with the engagement features 621 of the corresponding weights 616*a*.

As with the first two embodiments of the present invention (as depicted in FIGS. 1-37), the shaft arms 636 are coupled to a force transfer mechanism that transfers the lifting force exerted by a user on an exercise member to the index shaft 632. Therefore, as can be understood from FIG. 43, when the user applies an exercise force to the exercise member when performing an exercise movement on the machine, the index shaft 632 displaces vertically, taking the indexed/selected weight 616*a*' upward.

f. Fifth Embodiment of the Weight Exercise Machine

Figure 45:
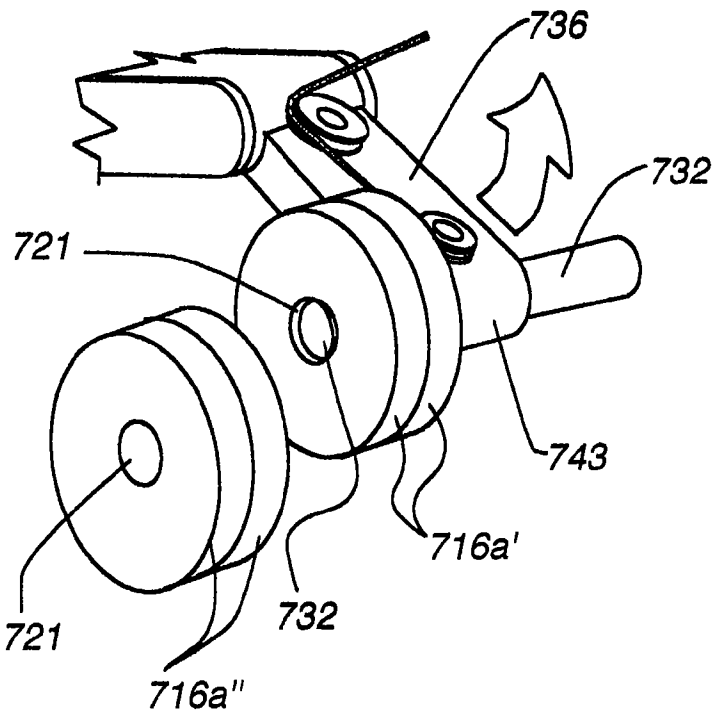
FIG. 45 is an isometric view of the indexed/selected weights being displaced relative from the non-indexed/non-selected weights by a user displacing an exercise member.
Figure 44:
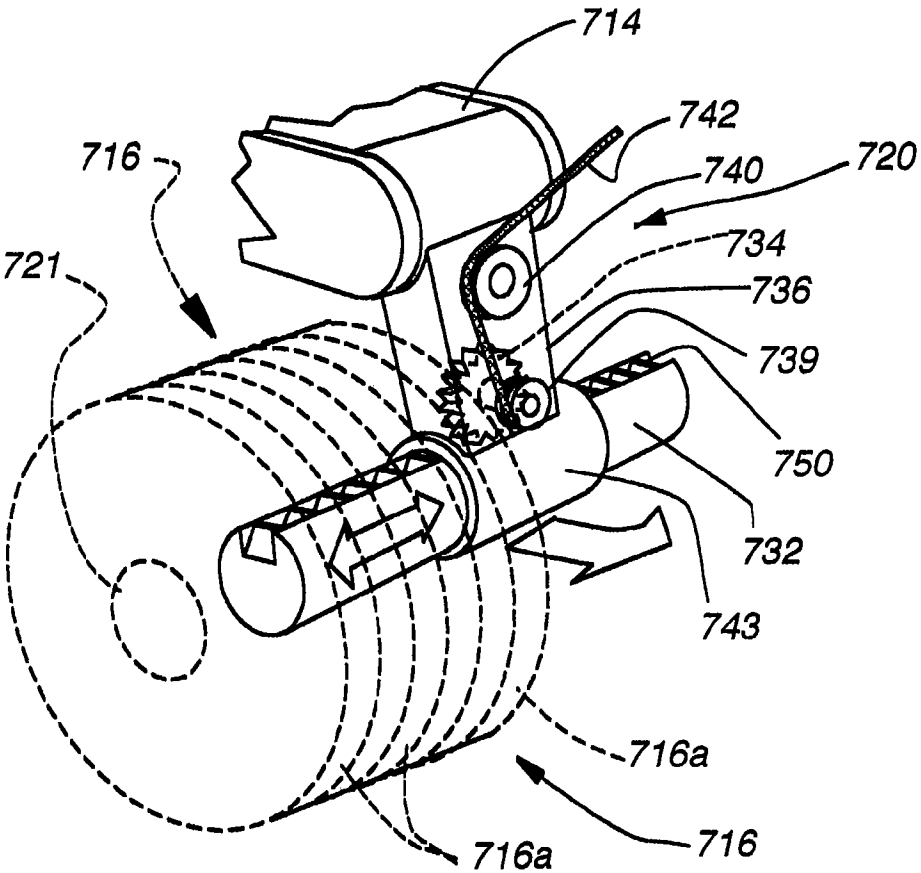
FIG. 44 is an isometric view of weights and weight index mechanism of the weight exercise machine.

For a discussion of the fifth embodiment of the weight exercise machine of the present invention, reference is made to FIGS. 44 and 45. FIG. 44 is an isometric view of weights 716 and weight index mechanism 720 of the weight exercise machine. FIG. 45 is an isometric view of the indexed/selected weights 716*a*' being displaced relative from the non-indexed/non-selected weights 716*a*" by a user displacing an exercise member.

As indicated in FIG. 44, the weight machine includes a plurality of weights 716 and an index mechanism 720. The weights 716 are arranged side-by-side and each includes a center hole 721. The index mechanism 720 includes an index shaft 732, an index gear 734, a shaft arm 736, first and second pulleys 739, 740, and a cable 742. The index shaft 732 is laterally telescopically displaceable within a sleeve 743 in one end of the shaft arm 736. The other end of the shaft arm is pivotally coupled to a base frame 714 of the machine. A first end of the cable 742 is coupled to an index wheel or other selection mechanism that allows a user to select the weight resistance to be used for the exercise movement to be performed on the machine. The cable 742 extends over the first pulley 739 to engage the second pulley 740, which is coupled to the index gear 734. The index gear 734 meshes with a gear rack 750 extending along the length of the index shaft 732 to telescopically drive the index shaft 732 into and out of the sleeve 743.

As shown in FIG. 44, the index bar 732 is extendable into the aligned holes 721 of the weights 716 to a greater or lesser extent, depending on the magnitude of weight resistance desired by the user. As with the first two embodiments of the present invention (as depicted in FIGS. 1-37), the shaft arm 736 is coupled to a force transfer mechanism that transfers the lifting force exerted by a user on an exercise member to the index shaft 732. Therefore, as can be understood from FIG. 45, when the user applies an exercise force to the exercise member when performing an exercise movement on the machine, the index shaft 732 displaces vertically, taking the indexed/selected weight 716*a*' upward.

g. Sixth Embodiment of the Weight Exercise Machine

Figure 47:
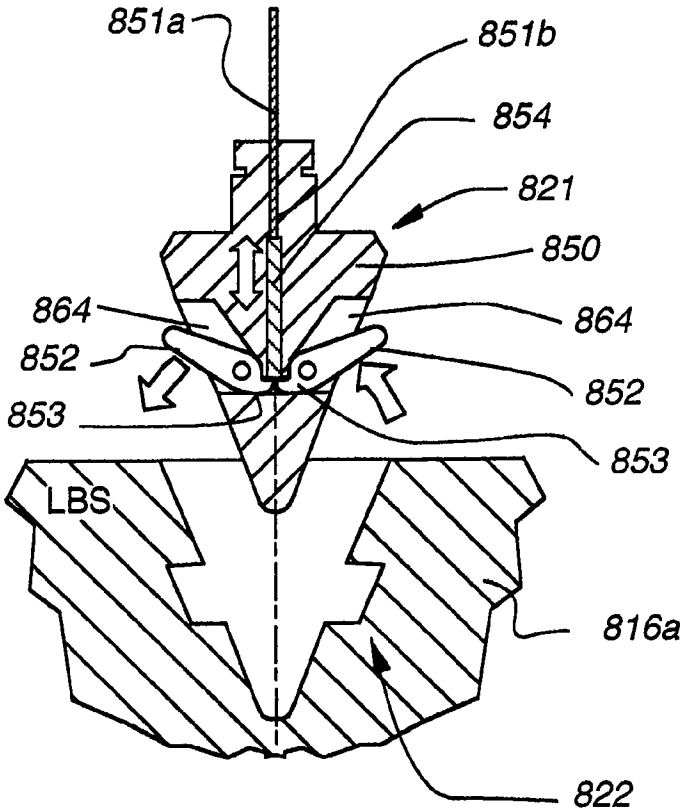
FIG. 47 is a cross-sectional elevation of an engagement mechanism of the index mechanism and an engagement feature of a weight.
Figure 46:
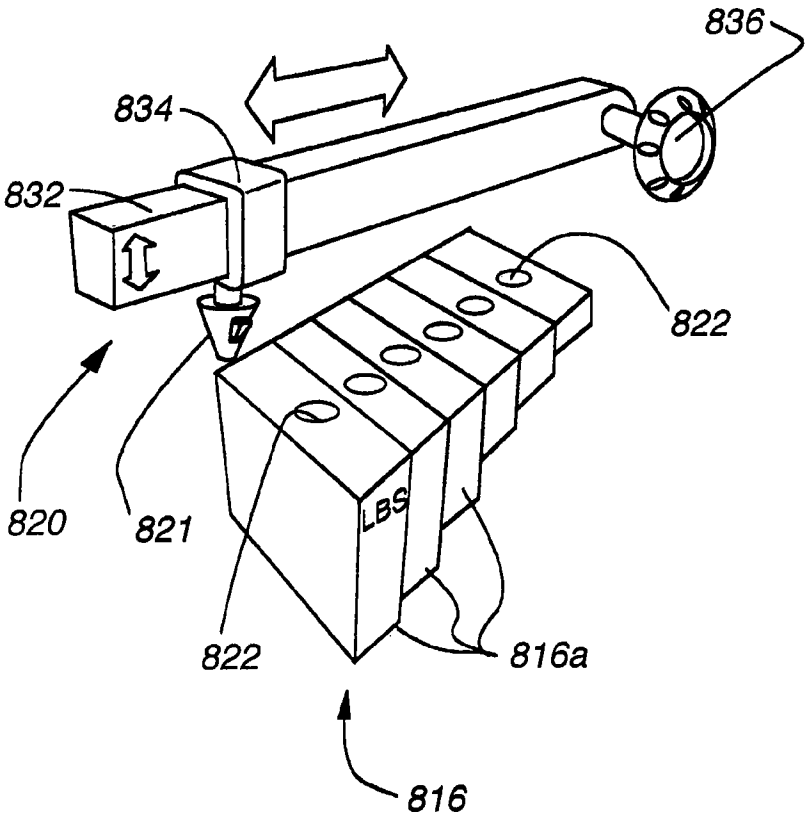
FIG. 46 is an isometric view of weights and weight index mechanism of the weight exercise machine.

For a discussion of the sixth embodiment of the weight exercise machine of the present invention, reference is made to FIGS. 46 and 47. FIG. 46 is an isometric view of weights 816 and weight index mechanism 820 of the weight exercise machine. FIG. 47 is a cross-sectional elevation of an engagement mechanism 821 of the index mechanism 820 and an engagement feature 822 of a weight 816*a*.

As indicated in FIG. 46, the weight machine includes a plurality of weights 816 and an index mechanism 820. The weights 816 are arranged side-by-side and each includes an engagement feature 822. The index mechanism 820 includes an index arm 832, an index sleeve 834, and an index wheel 836. The index sleeve 834 suspends the engagement mechanism 821 and is displaceable along the index sleeve 834. A user rotates the index wheel 836 to displace the index sleeve 834 along the weights 816 to align the engagement mechanism 821 with the engagement feature 822 of the weight 816*a* offering the desired weight resistance for the exercise movement to be performed on the machine. Once brought into alignment with the appropriate engagement feature 822, the engagement mechanism 821 is lowered to engage the engagement feature 822. Specifically, as shown in FIG. 47, the engagement mechanism 821 enters the engagement feature or hole 822 and engages the engagement feature 822.

As shown in FIG. 47, the engagement mechanism 821, in one embodiment, has a conical shaped body 850 that points tip downward. Two members (e.g., cables or rods) 851*a*, 851*b* extend between the top portion of the body 850 and the sleeve 834. One member 851*a* is used to support the body 850 and the other member 851*b* is used to actuate latches 852 that are pivotally coupled to the body 850. In one embodiment, the members 851*a*, 851*b* are coaxial. In another embodiment, the members 851*a*, 851*b* are run side-by-side between the body 850 and the sleeve 834.

As illustrated in FIG. 47, the latches 852 include tabs 853 that are engaged by a bar or pin 854 slidably displaceable within the body 850. The pin 854 is coupled to the member 851*b*, which pulls the pin 854 upward within the body 850 to allow clearance for the latches 852 to pivot relative to the body 850. As a result, the engagement mechanism 821 can fit into the engagement feature or hole 822. Once within the engagement feature 822, the latches 852 engage the recesses 860 within the engagement feature 822, which prevents the engagement mechanism 821 from withdrawing from the engagement feature 822.

As with the first two embodiments of the present invention (as depicted in FIGS. 1-37), the index arm 832 is coupled to a force transfer mechanism that transfers the lifting force exerted by a user on an exercise member to the index arm 832. Therefore, as can be understood from FIG. 46, when the user applies an exercise force to the exercise member when performing an exercise movement on the machine, the index arm 832 displaces vertically, taking the indexed/selected weight 816*a* upward.

As can be understood from FIG. 47, to allow the engagement mechanism 821 to disengage from the engagement feature 822, the selected weight 816*a* is returned to its place among the other weights 816*a* and the engagement mechanism 821 is driven into the engagement feature 822 to remove any tension from the latches 852. The pin 854 is then driven down to abut against the tabs 853 and to cause the latches 852 to pivot upward into recesses 864 in the body 850. By pivoting in the recesses 864, the latches 852 become generally flush with the body's conical sides. The engagement mechanism 821 can now be withdrawn from the engagement feature 822 of the weight 816*a*.

h. Seventh Embodiment of the Weight Exercise Machine

Figure 48:
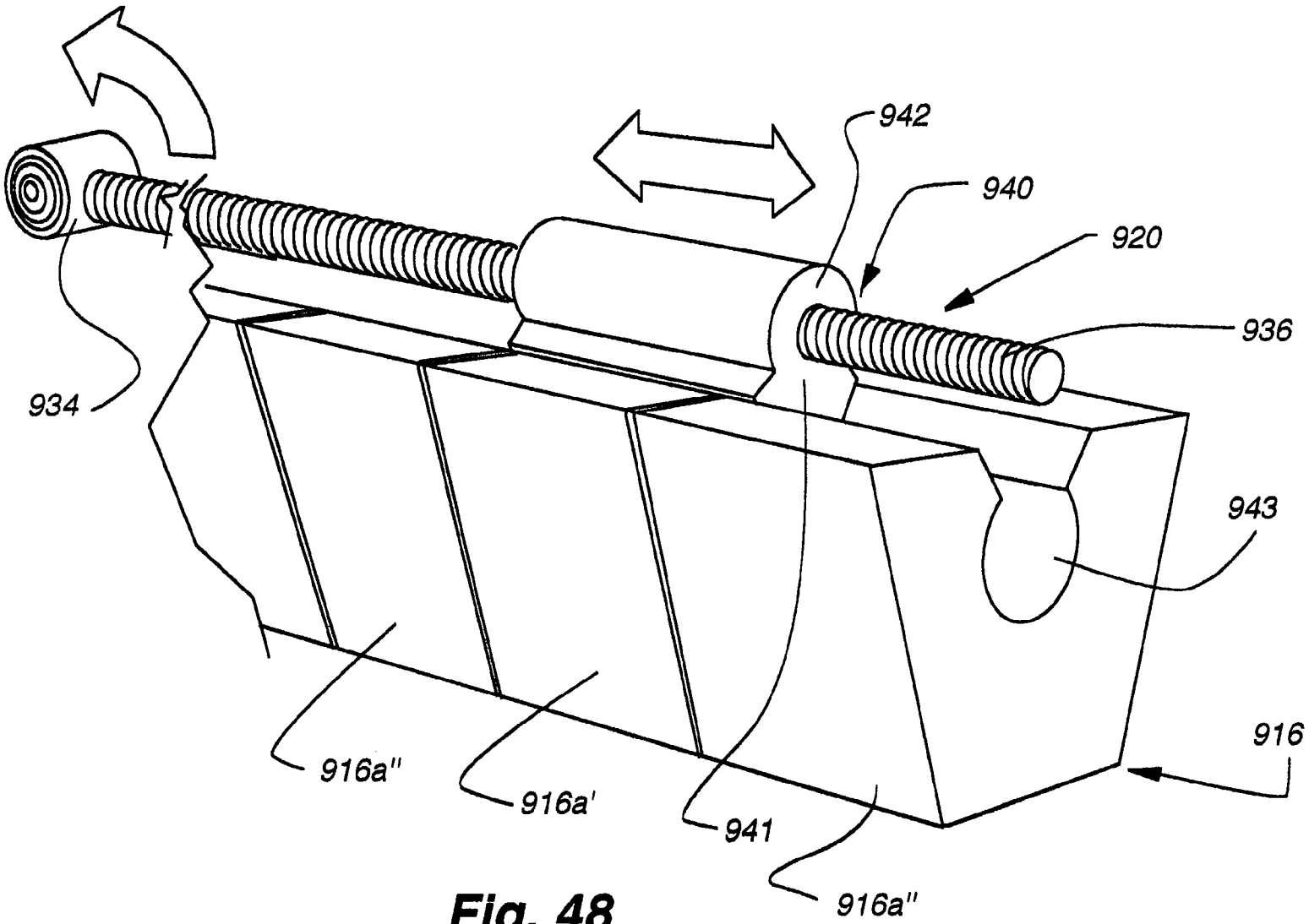
FIG. 48 is an isometric view of weights and weight index mechanism of the weight exercise machine.

For a discussion of the seventh embodiment of the weight exercise machine of the present invention, reference is made to FIG. 48, which is an isometric view of weights 916 and weight index mechanism 920 of the weight exercise machine. As shown in FIG. 48, the weight index mechanism 920 includes an index wheel 934, a threaded rod 936, and a carrier 940. The carrier 940 includes an engagement feature 941 and a threaded sleeve 942 that receives the threaded rod 936.

The weights 916 are positioned side-by-side. Each weight 916*a* includes an engagement feature (e.g., slot) 943 that aligns with the slots 943 of the immediately adjacent weights 916*a*. The engagement feature 941 of the carrier 940 passes through the aligned slots 943 of the weights 916*a* as the carrier 940 displaces along the threaded rod 936. A user rotates the index wheel 934 to cause the threaded rod 936 to rotate, thereby causing the carrier 940 to displace along the rod 936 to the weight 916*a* that corresponds to the weight resistance desired by the user for the exercise movement being performed on the machine.

As with the first two embodiments of the present invention (as depicted in FIGS. 1-37), the threaded rod 936 is coupled to a force transfer mechanism that transfers the lifting force exerted by a user on an exercise member to the rod 936. Therefore, as can be understood from FIG. 48, when the user applies an exercise force to the exercise member when performing an exercise movement on the machine, the rod 936 displaces vertically, taking the indexed/selected weight 916*a*' upward relative to the non-indexed/non-selected weights 916*a*".

i. Eighth Embodiment of the Weight Exercise Machine

Figure 49:
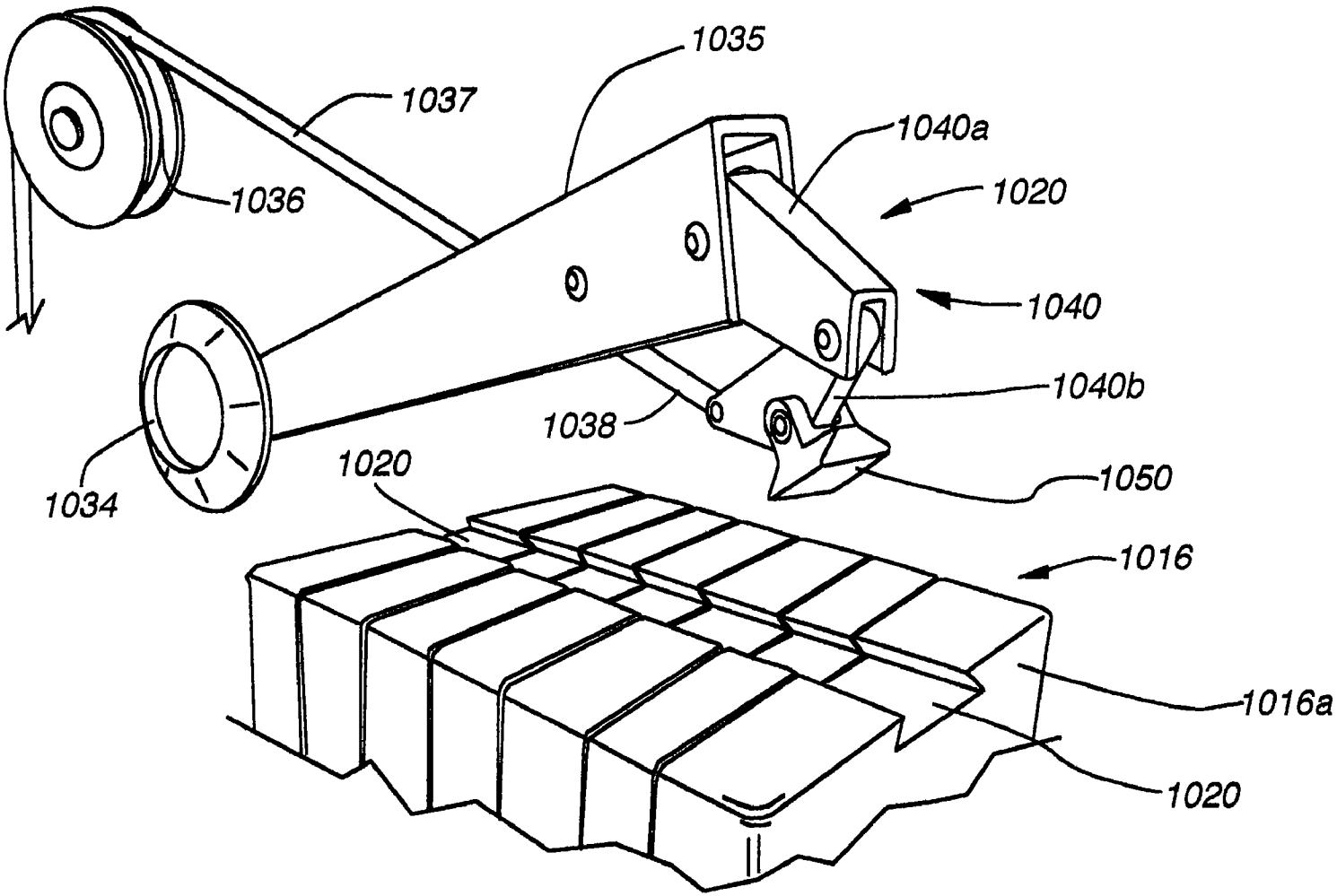
FIG. 49 is an isometric view of weights and weight index mechanism of the weight exercise machine.

For a discussion of the eighth embodiment of the weight exercise machine of the present invention, reference is made to FIG. 49, which is an isometric view of weights 1016 and weight index mechanism 1020 of the weight exercise machine. As shown in FIG. 49, the weight index mechanism 1020 includes an index wheel 1034, an index arm 1035, a pulley 1036, a first cable 1037, and a second cable 1038.

The weights 1016 are positioned side-by-side. Each weight 1016*a* includes an engagement feature (e.g., groove, slot, etc.) 1020 that aligns with the slots 1020 of the immediately adjacent weights 1016*a*. The index arm 1035 includes a neck 1040, which, in one embodiment, is articulated and includes an upper neck 1040*a* and a lower neck 1040*b*. The lower neck 1040*b* includes an engagement member 1050 pivotally coupled to the lower neck 1040*b*. The lower neck 1040*b* is coupled to the second cable 1038, which extends to the index wheel 1034. The first cable 1037 couples at a first end to the index arm 1035 and extends about the pulley 1036.

The upper neck 1040*a* is moveably coupled to the arm 1035. In one embodiment, the upper neck 1040*a* is pivotally coupled to the arm 1035 and the length of the neck 1040 and its pivotal construction allows the engagement member 1050 to be positioned within the slot 1020 of any of the weights 1016*a*. In one embodiment, the upper neck 1040*a* is slidably displaceable along the arm 1035, thereby providing the adjustability needed to bring the engagement member 1050 into proper engagement with any of the slots 1020 of any of the weights 1016*a*. In either case, when a user desires to select a weight resistance for an exercise movement to be performed on the machine, the user rotates the index wheel 1034. Rotation of the index wheel 1034 causes the engagement member 1050 to displace along the aligned slots 1020 until residing within the slot 1020 of the weight 1016*a* offering the appropriate weight resistance.

As with the first two embodiments of the present invention (as depicted in FIGS. 1-37), the index arm 1035 is coupled to a force transfer mechanism that transfers the lifting force exerted by a user on an exercise member to the index arm 1035. For example, in one embodiment, the first cable 1037 extends between the index arm 1035 and the force transfer mechanism. Therefore, as can be understood from FIG. 49, when the user applies an exercise force to the exercise member when performing an exercise movement on the machine, the index arm 1035 displaces vertically, taking the indexed/selected weight 1016*a* upward relative to the non-indexed/non-selected weights 1016*a*.

j. Ninth Embodiment of the Weight Exercise Machine

Figure 51:
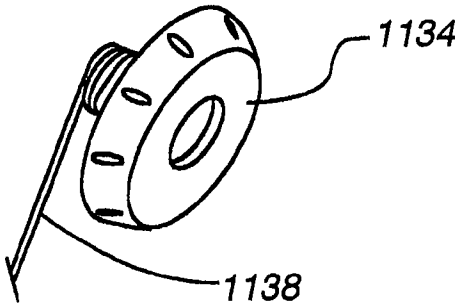
FIG. 51 is an isometric view of a weight index wheel.
Figure 52:
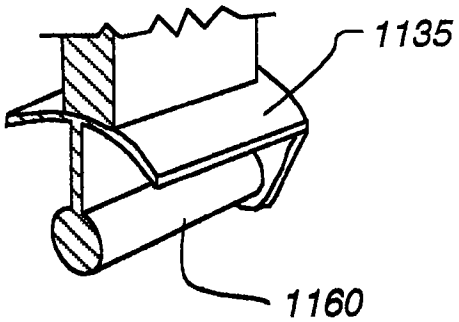
FIG. 52 is an isometric view of an engagement member.
Figure 50:
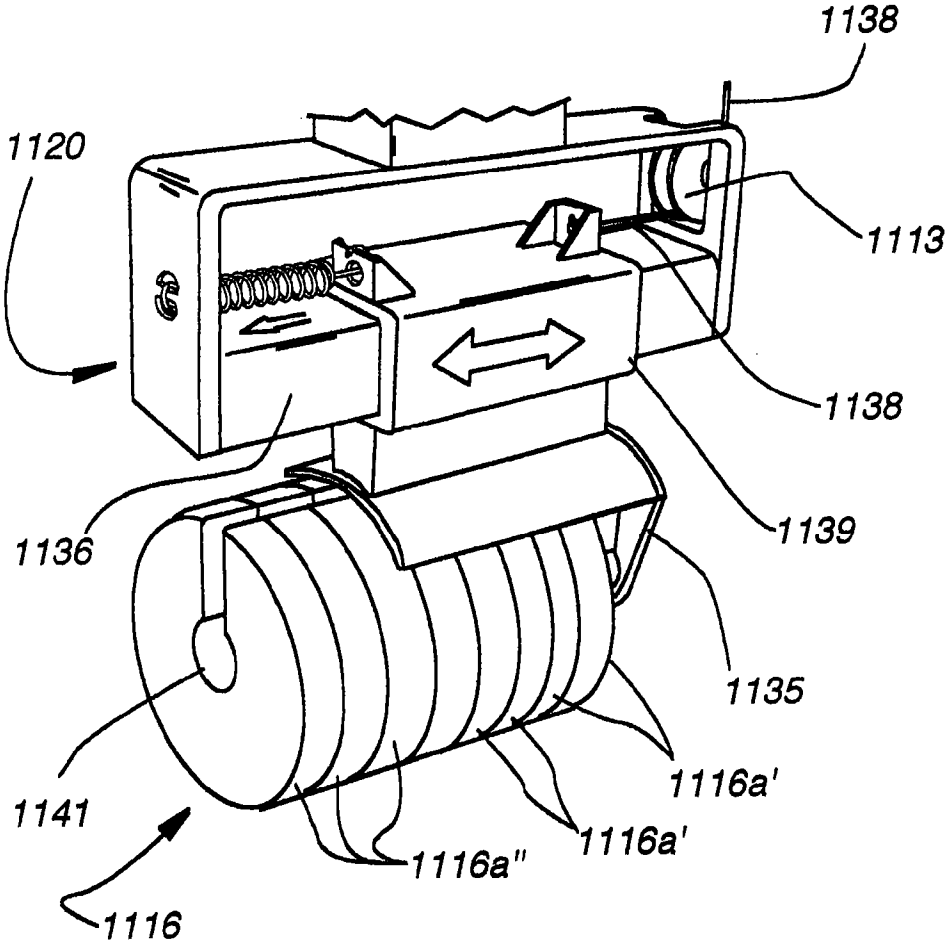
FIG. 50 is an isometric view of weights and weight index mechanism of the weight exercise machine.

For a discussion of the ninth embodiment of the weight exercise machine of the present invention, reference is made to FIGS. 50-52. FIG. 50 is an isometric view of weights 1116 and weight index mechanism 1120 of the weight exercise machine. FIG. 51 is an isometric view of a weight index wheel 1134. FIG. 52 is an isometric view of an engagement member 1135. As shown in FIG. 50, the weight index mechanism 1120 includes an index arm 1136, a pulley 1113, a cable 1138, and a sleeve 1139 from which the engagement member 1135 extends.

The weights 1116 are positioned side-by-side. Each weight 1116*a* includes an engagement feature (e.g., groove, slot, etc.) 1141 that aligns with the slots 1141 of the immediately adjacent weights 1116*a*. The sleeve 1139 is slidably displaceable along the index arm 1136. As indicated in FIG. 52, the engagement member includes a portion 1160 adapted to mate with the slots 1141 of the weights 1116*a*.

As indicated in FIG. 50, as the sleeve 1139 is displaced along the index arm 1136, the portion 1160 of the engagement member 1135 passes along the slots 1141. When a user desires to select a weight resistance for an exercise movement to be performed on the machine, the user rotates the index wheel 1134, which is coupled to the sleeve 1139 via the cable 1138 that passes about the pulley 1113. Rotation of the index wheel 1134 causes the engagement member 1135 to displace along the index arm 1136, which causes the portion 1160 to pass through the aligned slots 1141 until residing within the slots 1141 of a sufficient number of weights 1116*a* to provide the appropriate weight resistance.

As can be understood from FIGS. 50 and 52, the further the engagement member 1135 has passed across the weights 1116, the larger the number of weight slots 1141 within which the portion 1160 resides. As a result, the index arm 1136 is coupled to a larger number of weights 1116 and a greater weight resistance is provided to the user of the machine. Conversely, where the engagement member 1135 has passed across the weights 1116 to a lesser extent, the portion 1160 will reside within a smaller number of weight slots 1141. As a result, the index arm 1136 will be coupled to a smaller number of weights 1116 and a smaller weight resistance is provided to the user of the machine.

As with the first two embodiments of the present invention (as depicted in FIGS. 1-37), the index arm 1136 is coupled to a force transfer mechanism that transfers the lifting force exerted by a user on an exercise member to the index arm 1136. Therefore, as can be understood from FIG. 50, when the user applies an exercise force to the exercise member when performing an exercise movement on the machine, the index arm 1136 displaces vertically, taking the indexed/selected weight 1116*a*' upward relative to the non-indexed/non-selected weights 1116*a*".

k. Tenth Embodiment of the Weight Exercise Machine

Figure 54:
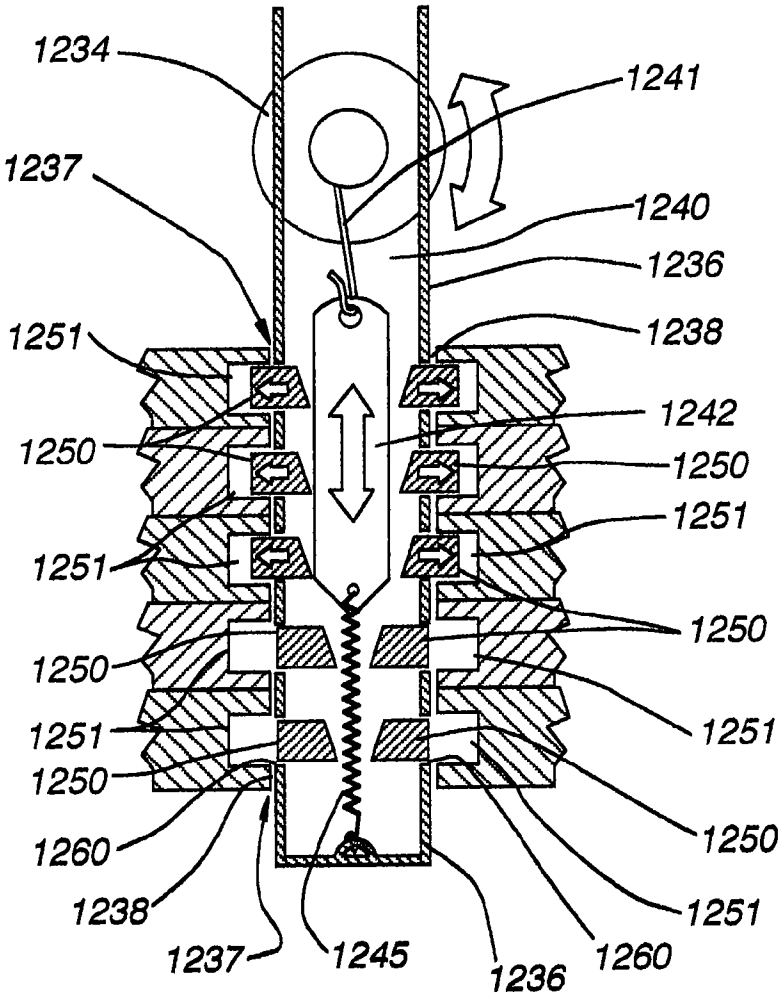
FIG. 54 is a cross-section elevation taken through FIG. 53.
Figure 53:
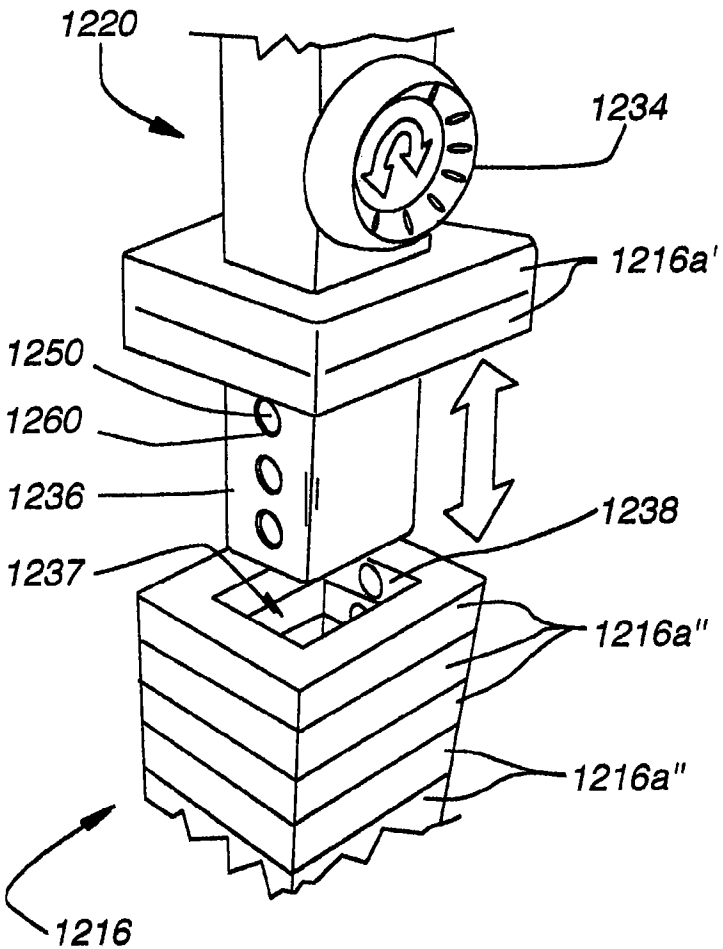
FIG. 53 is an isometric view of weights and weight index mechanism of the weight exercise machine.

For a discussion of the tenth embodiment of the weight exercise machine of the present invention, reference is made to FIGS. 53 and 54. FIG. 53 is an isometric view of weights 1216 and weight index mechanism 1220 of the weight exercise machine. FIG. 54 is a cross-section elevation taken through FIG. 53. As shown in FIG. 53, the weight index mechanism 1220 includes an index wheel 1234 and an index column 1236 vertically displaceable within an interior cavity 1237 formed by the aligned center holes 1238 of the stacked weights 1216*a*.

As indicated in FIG. 54, within a longitudinally extending cavity 1240 of the column 1236, a cable 1241 couples a top end of an indexing member 1242 to the index wheel 1234. A spring 1245 couples the bottom end of the indexing member 1242 to the bottom of the column 1236. Pairs of pins 1250 are located along the length of the column 1236 and are biased to reside within the cavity 1237 such that the exterior end of a pin 1250 is generally flush with the surface of the column 1236, as indicated in FIG. 53. Each pair of pins 1250 is paired with a pair of recesses 1251 in a corresponding weight 1216*a* in the weight stack 1216.

As can be understood from FIG. 53, when a user desires to select a weight resistance for an exercise movement to be performed on the machine, the user rotates the index wheel 1234, which, via the cable 1241, causes indexing member 1242 to displace vertically within the cavity 1240 of the column 1236. Wherever within the cavity 1240 of the column 1236 the indexing member 1242 ends up being positioned, the indexing member 1236 extends the pairs of pins 1250 out of their respective column holes 1260 into the recesses 1251 of the corresponding weights 1216*a*. The pins 1250 residing within the recesses 1251 of a weight 1216*a* couples the column 1236 to the weights 1216*a*.

As with the first two embodiments of the present invention (as depicted in FIGS. 1-37), the column 1236 is coupled to a force transfer mechanism that transfers the lifting force exerted by a user on an exercise member to the column 1236. Therefore, as can be understood from FIGS. 53 and 54, when the user applies an exercise force to the exercise member when performing an exercise movement on the machine, the column 1236 displaces vertically, taking the indexed/selected weights 1216*a*' upward relative to the non-indexed/non-selected weights 1216*a*".

In one embodiment, two or more weight stack 1216 and index column 1236 assemblies will be provided on a single machine to provide an expanded weight resistance level capability and increased weight increment selectability. The index columns 1236 will be coupled as a group to the force transfer mechanism.

l. Eleventh Embodiment of the Weight Exercise Machine

Figure 56:
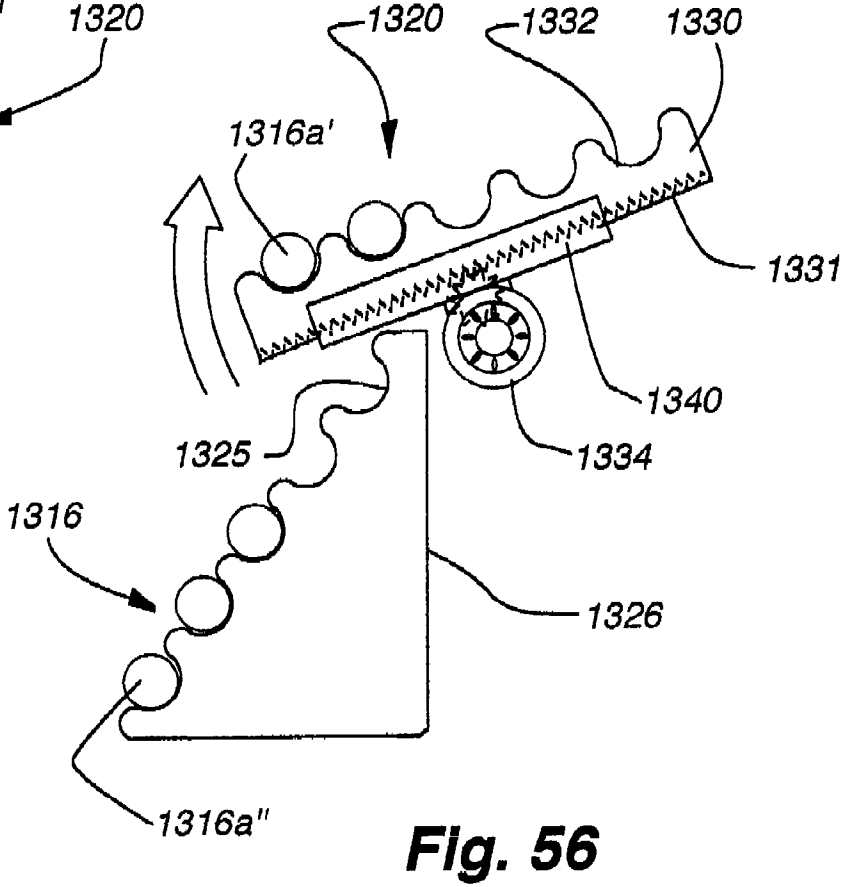
FIG. 56 is a side elevation of weights and index mechanism depicted in FIG. 55.
Figure 55:
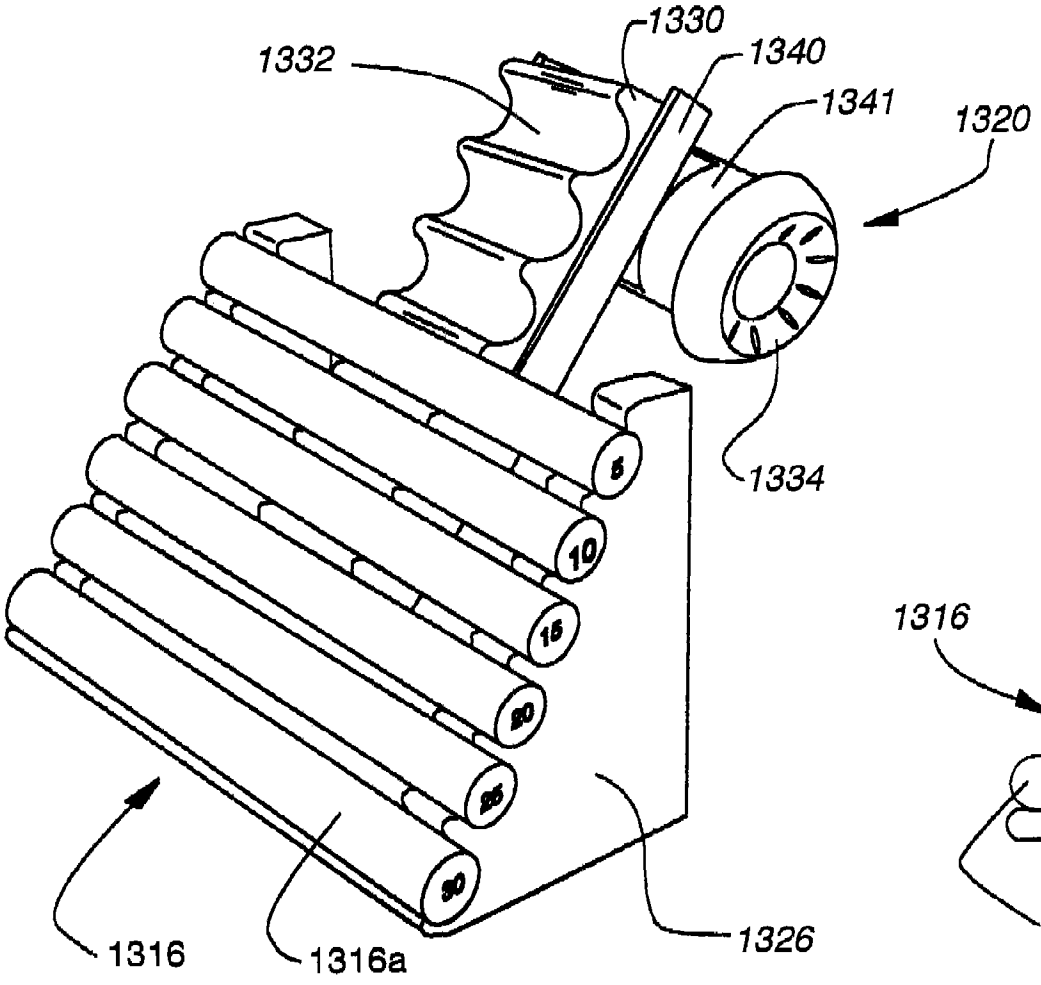
FIG. 55 is an isometric view of weights and weight index mechanism of the weight exercise machine.

For a discussion of the eleventh embodiment of the weight exercise machine of the present invention, reference is made to FIGS. 55 and 56. FIG. 55 is an isometric view of weights 1316 and weight index mechanism 1320 of the weight exercise machine. FIG. 56 is a side elevation of weights 1316 and index mechanism 1320 depicted in FIG. 55.

As shown in FIGS. 55 and 56, the weights 1316 are bars 1316*a* that reside in grooves 1325 in an inclined weight rack 1326 until engaged by the weight index mechanism 1320. The index mechanism 1320 includes an arm 1330 that has a gear rack 1331 along its bottom side and a plurality of grooves 1332 along its top side. The grooves 1332 are for receiving bars 1316 for displacement by a user's exercise force. The arm 1330 is longitudinally displaceable along a frame 1340 that includes an index wheel 1334, which is coupled to a gear that engages the gear rack 1331. The frame 1340 is pivotally mounted about an axle 1341.

As can be understood from FIG. 55, when a user desires to select a weight resistance for an exercise movement to be performed on the machine, the user pivots the index mechanism 1320 about the axle 1341 until the arm 1330 is positioned below the bars 1316*a* at a slope that is slightly greater than the slope of inclined weight-bearing portion of the inclined weight rack 1326. The user then rotates the index wheel 1334, which causes the arm 1330 to extend underneath the desired number of bars 1316*a*. As illustrated by the arrow in FIG. 56, the index mechanism 1320 is then pivoted about the axle 1341 to capture the desired number of bars 1316*a* with the grooves 1332 of the arm 1330. Once the appropriate number of bars 1316*a* is captured, the index mechanism 1320 can be displaced upward by an exercise force exerted by a user of the machine.

As with the first two embodiments of the present invention (as depicted in FIGS. 1-37), the frame 1340 is coupled to a force transfer mechanism that transfers the lifting force exerted by a user on an exercise member to the frame 1340. Therefore, as can be understood from FIG. 56, when the user applies an exercise force to the exercise member when performing an exercise movement on the machine, the index mechanism 1320 displaces vertically, taking the indexed/selected weight bars 1316*a*' upward relative to the non-indexed/non-selected weight bars 1316*a*".

In one embodiment, two or more weight rack 1326 and index mechanism 1320 assemblies will be provided on a single machine to provide an expanded weight resistance level capability and increased weight increment selectability. The multiple weight frames 1340 will be coupled as a group to the force transfer mechanism.

Although various representative embodiments of this invention have been described above with a certain degree of particularity, those skilled in the art could make numerous alterations to the disclosed embodiments without departing from the spirit or scope of the inventive subject matter set forth in the specification and claims. All directional references (e.g., upper, lower, upward, downward, left, right, leftward, rightward, top, bottom, above, below, vertical, horizontal, clockwise, and counterclockwise) are only used for identification purposes to aid the reader's understanding of the embodiments of the present invention, and do not create limitations, particularly as to the position, orientation, or use of the invention unless specifically set forth in the claims. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other. The invention is limited only by the scope of the following claims.

What is claimed is:

1. A weight exercise machine for use by a user, the exercise machine comprising:

a base frame;

an exercise member against which the user exerts an exercise force;

a plurality of weights;

a weight arm moveably coupled to the base frame and operably coupled to the exercise member; and a weight selector selectively actuated to operably couple the weight arm to at least one of the plurality of weights such that displacement of the exercise member from a first position causes the weight arm to move relative to the base frame while remaining coupled to the base frame while remaining coupled to the base frame and the at least one of the plurality of weights to displace, wherein:

each weight of the plurality of weights is selectively operably coupled to the weight arm by the actuation of the weight selector and can be displaced from a rest position using the exercise member without displacing any of the other weights, and more than one of the plurality of weights can be operably coupled to the weight arm to be displaced from the rest position simultaneously.

2. The exercise machine of claim 1, wherein the plurality of weights includes a first weight type and a second weight type comprising a configuration different from the first weight type.

3. The exercise machine of claim 2, wherein the masses of the first and second weight plate types differ.

4. The exercise machine of claim 1, wherein at least a portion of the weight selector is mounted on the weight arm.

5. The exercise machine of claim 1, wherein the weight selector includes an axle, and the axle is rotated to operably couple the weight arm with the at least one of the plurality of weights.

6. The exercise machine of claim 5, wherein the weight selector further includes an adjustment wheel for driving the axle.

7. The exercise machine of claim 5, wherein the weight selector further includes a hook displaced by the axle to engage the at least one of the plurality of weights in order to couple the exercise member with the at least one of the plurality of weights.

8. The exercise machine of claim 5, wherein the axle includes an arcuate surface for engaging a feature on the at least one of the plurality of weights in order to couple the exercise member with the at least one of the plurality of weights.

9. The exercise machine of claim 8, wherein the feature comprises a protrusion.

10. The exercise machine of claim 1, wherein the exercise member is configured for engagement by at least one of a user's hand or arm.

11. The exercise machine of claim 1, further comprising:

a plurality of second weights; and an axle operatively associated with the weight arm and moveable to operably couple at least one of the plurality of second weights with the weight arm.

12. The exercise machine of claim 1, wherein the plurality of weights are arranged to define a generally horizontal weight stack.

13. The exercise machine of claim 1, wherein:

the exercise member is operatively associated with the base frame in the first position; and the exercise member remains operatively associated with the base frame when displaced from the first position.

14. The exercise machine of claim 1, wherein the weight selector engages an outer portion of at least one of the plurality of weights to operably couple the weight arm thereto.

* * * * *

UNITED STATES PATENT AND TRADEMARK OFFICE

CERTIFICATE OF CORRECTION

PATENT NO. : 7,662,074 B2
APPLICATION NO. : 12/142904
DATED : February 16, 2010
INVENTOR(S) : Gregory M. Webb It is certified that error appears in the above-identified patent and that said Letters Patent is hereby corrected as shown below:

Claim 1, column 28, line 20, delete "while remaining coupled to the base frame".

Signed and Sealed this

Thirtieth Day of March, 2010

David J. Kappos

David J. Kappos
*Director of the United States Patent and Trademark Office*